US007052828B2

(12) United States Patent
Yoshioka

(10) Patent No.: US 7,052,828 B2
(45) Date of Patent: May 30, 2006

(54) PHOTOTHERMOGRAPHIC MATERIAL

(75) Inventor: Yasuhiro Yoshioka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/939,855

(22) Filed: Sep. 14, 2004

(65) Prior Publication Data

US 2005/0106515 A1 May 19, 2005

(30) Foreign Application Priority Data

Sep. 16, 2003 (JP) ..... 2003-323255

(51) Int. Cl.
*G03C 1/00* (2006.01)
*G03C 1/06* (2006.01)

(52) U.S. Cl. ..... 430/619; 430/607; 430/616; 430/617; 430/618; 430/620

(58) Field of Classification Search ..... 430/616, 430/617, 618, 619, 620, 607
See application file for complete search history.

(56) References Cited

U.S. PATENT DOCUMENTS 6,329,127 B1 * 12/2001 Ito et al. ..... 430/619
6,649,338 B1 * 11/2003 Mitsuhashi ..... 430/619
2005/0026093 A1 * 2/2005 Ohzeki ..... 430/617

FOREIGN PATENT DOCUMENTS

| | | |
|---|---|---|
| JP | A 2000-284409 | 10/2000 |
| JP | A 2000-284410 | 10/2000 |
| JP | A 2001-312027 | 11/2001 |
| JP | A 2003-186139 | 7/2003 |

* cited by examiner

*Primary Examiner*—Geraldine Letscher
(74) *Attorney, Agent, or Firm*—Margaret A. Burke; Sheldon J. Moss

(57) ABSTRACT

The present invention provides a photothermographic material including at least a photosensitive silver halide, a non-photosensitive silver-supplying compound, a reducing agent and a binder on at least one surface of a support. The photothermographic material further includes at least one kind of halogen releasing compound having a water-solubilizing group and at least one kind of halogen releasing compound having no water-solubilizing group, and a gradation of a characteristic curve is 2.5 to 4.0. The photothermographic material of the invention is excellent in storability, and particularly excellent in storability of high quality images used for image recording for medical diagnosis.

6 Claims, No Drawings

PHOTOTHERMOGRAPHIC MATERIAL

CROSS-REFERENCE TO RELATED APPLICATION

This application claims priority under 35 USC 119 from Japanese Patent Application No. 2003-323255, the disclosure of which is incorporated by reference herein.

BACKGROUND OF THE INVENTION

1. Field of the Invention

The present invention relates to a photothermographic material. More particularly, the invention relates to a photothermographic material which has high image quality and is appliciable for recording images for medical diagnosis.

2. Description of the Related Art

In recent years, it has been strongly desired in the field of films for medical imaging to reduce the amount of used processing liquid waste in consideration of environmental protection and space saving. For this reason, technology regarding photothermographic materials as films for medical diagnosis and for photographic applications, which are capable of efficient exposure with a laser image setter or a laser imager and capable of forming a clear black-toned image with high resolution and high sharpness is desired. Such photothermographic materials can eliminate use of liquid processing chemicals and can provide users with a thermal development system which is simpler and does not contaminate the environment.

Although similar requirements also exist in the field of general image forming materials, an image for medical imaging requires a particularly, high image quality excellent in sharpness and granularity because a delicate image representation is necessitated. Also an image of blue-black tone is preferred in consideration of easy diagnosis. Currently, various hard copy systems utilizing pigments or dyes, such as ink jet printers and electrophotographic systems, are available as general image forming systems, but they are not satisfactory as output systems for medical images.

On the other hand, thermal image forming systems utilizing organic silver salts are described in many documents. Specifically, a photothermographic material generally comprises an image forming layer in which a catalytically active amount of photocatalyst (for example, a silver halide), a reducing agent, a reducible silver salt (for example, an organic silver salt) and, if necessary, a toner for controlling the tone of a developed silver image are dispersed in a matrix of a binder. The photothermographic material, when heated at high temperature (for example, 80° C. or higher) after image exposure, forms a black-toned silver image by an oxidation/reduction reaction between the silver halide or the reducible silver salt (functioning as an oxidizing agent) and the reducing agent. The oxidation/reduction reaction is promoted by a catalytic effect of a latent image formed by exposure on silver halide. As a result, a black silver image is formed in an exposed region. Further, Fuji Medical Dry Imager FM-DP L is an example of a practical medical image forming system using a photothermographic material that has been marketed.

Organic halogen compounds are known as antifoggants for photothermographic materials. For example, Japanese Patent Application Laid-Open (JP-A) Nos. 2000-284410, 2003-186139 and 2001-312027 disclose organic polyhalogen compounds having specified substituents. Further, JP-A No. 2000-284409 discloses preventing black spots, which are a problem peculiar to such an image forming system, from emerging by employing different organic polyhalogen compounds in combination in an ultra-high contrast photothermographic material using a nucleator for use in graphic arts.

SUMMARY OF THE INVENTION

An aspect of the present invention is to provide a photothermographic material comprising on at least one surface of a support, at least a photosensitive silver halide, a non-photosensitive silver-supplying compound, a reducing agent and a binder, wherein the photothermographic material further comprises at least one kind of halogen releasing compound having a water-solubilizing group and at least one kind of halogen releasing compound having no water-solubilizing group, and has a gradation in a photographic characteristic curve of 2.5 to 4.0.

DETAILED DESCRIPTION OF THE INVENTION

An object of the present invention is to solve the conventional problems, and to provide a photothermographic material which is excellent in gradation stability. Particularly, the invention provides a photothermographic material which has a gradation suitable for a medical image recording material and is excellent in stability of gradation.

Gradation at an intermediate image density region is an important factor for an image recording material for medical diagnosis. The image recording material is required to have constant and stable gradation that is not changed by exposure and development conditions.

A problem peculiar to the photothermographic material is variation of performance during storage, since all of the materials required for image forming are contained in the material and are degenerated by interaction there between. Consequently, the use of the photothermographic material has been restricted by the need for refrigerated or frozen storage, and by the need for transportation at a low temperature. Particularly, it has been a quite significant technical problem for medical image recording materials to prevent gradation from being changed during storage. Since the photothermographic material has been widely used as an image recording material for medical diagnosis and the quantity thereof has expanded, it has been desired to eliminate the restrictions on storage conditions and to prolong an effective storage period by improving stability during storage. The inventors of the invention have attained the invention through intensive studies for fulfilling the demands of the market as described above.

The present invention provides a photothermographic material having a stable gradation, and particularly a photothermographic material having a gradation suitable for medical image recording materials and being excellent in stability of gradation.

The present invention will be described in detail below.

(Photothermographic Material)

In the present invention, a photographic characteristic curve is a D-log E curve representing a relationship between the common logarithm (log E) of a light exposure, i.e., the exposure energy, and the optical density (D), i.e., a scattered light photographic density, by plotting the former on the abscissa and the latter on the ordinate. In the present invention, fog is expressed in terms of the density of an unexposed part. An average gradient according to the invention represents a gradient of a line joining the points fog+1.0 and fog+2.0 on the photographic characteristic curve (i.e., the value equals to tan when the angle between the line and the abscissa is).

An average gradient according to the invention is in a range of 2.5 to 4.0, and preferably is in a range of 3.0 to 3.8.

In the invention, it is preferred that the total amount of coated silver is 0.6 $g/m^2$ to 1.9 $g/m^2$, and more preferably is 0.8 $g/m^2$ to 1.5 $g/m^2$.

The photothermographic material of the invention has an image forming layer which comprises at least a photosensitive silver halide, a non-photosensitive silver-supplying compound, a reducing agent and a binder on at least one surface of a support. Further preferably, the image forming layer may have disposed thereon a surface protective layer, or a back layer, a back protective layer or the like may be disposed on the opposite surface of the support.

The constitutions and preferable components of each layer will be explained in detail below.

(Non-Photosensitive Silver-supplying Compound)

1) Composition

The non-photosensitive silver-supplying compound of the invention is a compound which can supply a reducible silver ion to the developing active center (for example, a latent image formed on the surface of silver halide) during thermal development.

The non-photosensitive silver-supplying compound of the invention preferably is an organic silver salt.

The organic silver salt is relatively stable to light but serves as silver ion supplier and forms silver images when heated to 80° C. or higher under the presence of an exposed photosensitive silver halide and a reducing agent. The organic silver salt may be any organic material which can supply silver ions that can be reduced by a reducing agent. Such non-photosensitive organic silver salt is disclosed, for example, in JP-A No. 10-62899 (paragraph Nos. 0048 to 0049), EP-A No. 0803764A1 (page 18, line 24 to page 19, line 37), EP-A No. 0962812A1, JP-A Nos. 11-349591, 2000-7683, and 2000-72711, and the like. A silver salt of organic acid, particularly, a silver salt of long chained fatty acid carboxylic acid (having 10 to 30 carbon atoms, preferably, having 15 to 28 carbon atoms) is preferable. Preferred examples of the silver salt of fatty acid can include, for example, silver lignocerate, silver behenate, silver arachidinate, silver stearate, silver oleate, silver laurate, silver capronate, silver myristate, silver palmitate, silver erucate and mixtures thereof. Among the silver salts of fatty acid, it is preferred to use a silver salt of fatty acid with a silver behenate content of 40 mol % or more. To improve the development characteristic, it is more preferably 50 mol % to 85 mol % and further preferably, 55 mol % to 80 mol %. And, to improve the image storability, it is more preferably 85 mol % to 99 mol %, and further preferably 90 mol % to 98 mol %. Further, it is preferred to use a silver salt of fatty acid with a silver erucate content of 2 mol % or less, more preferably, 1 mol % or less, and further preferably, 0.1 mol % or less.

It is preferred that the content of the silver stearate is 1 mol % or less. When the content of the silver stearate is 1 mol % or less, a silver salt of organic acid having low Dmin, high sensitivity and excellent image storability can be obtained. The content of the silver stearate above-mentioned, is preferably 0.5 mol % or less, more preferably, the silver stearate is not substantially contained.

Further, in the case the silver salt of organic acid includes silver arachidinic acid, it is preferred that the content of the silver arachidinic acid is 6 mol % or less in order to obtain a silver salt of organic acid having low Dmin and excellent image storability. The content of the silver arachidinate is more preferably 3 mol % or less.

2) Shape

There is no particular restriction on the shape of the organic silver salt usable in the invention and it may needle-like, bar-like, tabular or flaky shape.

In the invention, a flaky shaped organic silver salt is preferred. Short needle-like, rectangular, cuboidal or potato-like indefinite shaped particle with the major axis to minor axis ratio being 5 or less is also used preferably. Such organic silver particle has a feature less suffering from fogging during thermal development compared with long needle-like particles with the major axis to minor axis length ratio of more than 5. Particularly, a particle with the major axis to minor axis ratio of 3 or less is preferred since it can improve the mechanical stability of the coating film. In the present specification, the flaky shaped organic silver salt is defined as described below. When an organic acid silver salt is observed under an electron microscope, calculation is made while approximating the shape of an organic acid silver salt particle to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those capable of satisfying the relation: $x(\text{average}) \geqq 1.5$ as an average value x is defined as a flaky shape. The relation is preferably: $30 \geqq x(\text{average}) \geqq 1.5$ and, more preferably, $15 \geqq x(\text{average}) \geqq 1.5$. By the way, needle-like is expressed as $1 \leqq x(\text{average}) < 1.5$.

In the flaky shaped particle, a can be regarded as a thickness of a tabular particle having a main plate with b and c being as the a in average is preferably 0.01 μm to 0.3 μm and, more preferably, 0.1 μm to 0.23 μm. c/b in average preferably 1 to 9, more preferably, 1 to 6, further preferably, 1 to 4 and, most preferably, 1 to 3.

By controlling the equivalent spherical diameter to be 0.05 μm to 1 μm, it causes less agglomeration in the photothermographic material and image storability is improved. The equivalent spherical diameter is preferably 0.1 μm to 1 μm. In the invention, the equivalent spherical diameter can be measured by a method of photographing a sample directly by using an electron microscope and then image-processing negative images.

In the flaky shaped particle, the equivalent spherical diameter of the particle/a is defined as an aspect ratio. The aspect ratio of the flaky particle is, preferably, 1.1 to 30 and, more preferably, 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is, preferably, 100% or less, more preferably, 80% or less and, further preferably, 50% or less. The shape of the organic silver salt can be measured by determining dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient), is preferably, 100% or less, more preferably, 80% or less and, further preferably, 50% or less. The monodispersion can be determined from particle size (volume weighted mean diameter) obtained, for example, by a measuring method of irradiating a laser beam to an organic silver salt dispersed in a liquid, and determining a self correlation function of the scattering of scattered light to the change of time.

3) Preparing Method

Methods known in the art may be applied to the method for producing the organic silver salt used in the invention and to the dispersing method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion, is preferably, 1 mol % or less, more preferably, 0.1 mol % or less per 1 mol of the organic acid silver salt in the solution and, further preferably, positive addition of the photosensitive silver salt is not conducted.

In the invention, the photothermographic material can be prepared by mixing an aqueous dispersion of an organic silver salt and an aqueous dispersion of a photosensitive silver salt and the mixing ratio between the organic silver salt and the photosensitive silver salt can be selected depending on the purpose. The ratio of the photosensitive silver salt to the organic silver salt is, preferably, in the range from 1 mol % to 30 mol %, more preferably, in the range from 2 mol % to 20 mol % and, particularly preferably, 3 mol % to 15 mol %. A method of mixing two or more kinds of aqueous dispersions of organic silver salts and two or more kinds of aqueous dispersions of photosensitive silver salts upon mixing are used preferably for controlling the photographic properties.

4) Addition Amount

While an organic silver salt in the invention can be used in a desired amount, a total coating amount of silver included in organic silver salt and silver halide is preferably in the range from 0.1 $g/m^2$ to 3.0 $g/m^2$, more preferably 0.3 $g/m^2$ to 2.2 $g/m^2$, and further preferably 0.6 $g/m^2$ to 1.9 $g/m^2$. Particularly, the total amount of coated silver preferably is 1.7 $g/m^2$ or less, and more preferably from 1.5 $g/m^2$ or less, to improve the image storability. Using the preferable reducing agent of the invention, it is possible to obtain a sufficient image density even with such a low amount of silver.

(Reducing Agent)

The photothermographic material of the invention contains a reducing agent for the organic silver salt. The reducing agent for organic silver salt may be any substance (preferably, organic substance) capable of the reducing agent are described in JP-A No. 11-65021 (column Nos. 0043 to 0045) and EP-A No. 0803764A1 (page 7, line 34 to page 18, line 12).

In the invention, a so-called hindered phenolic reducing agent or a bisphenol agent having a substituent at the ortho-position to the phenolic hydroxy group is preferred and the compound represented by the following formula (R) is more preferred.

Formula (R)

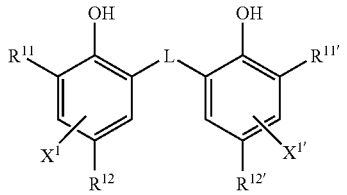

In formula (R), $R^{11}$ and $R^{11'}$ each independently represent an alkyl group having 1 to 20 carbon atoms. $R^{12}$ and $R^{12'}$ each independently represent a hydrogen atom or a group capable of substituting for a hydrogen atom on a benzene ring. L represents a —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group capable of substituting for a hydrogen atom on a benzene ring.

Formula (R) is to be described in detail.

In the following description, when referred to as an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and can include, preferably, aryl group, hydroxy group, alkoxy group, aryloxy group, alkylthio group, arylthio group, acylamino group, sulfoneamide group, sulfonyl group, phosphoryl group, acyl group, carbamoyl group, ester group, ureido group, urethane group and halogen atom.

2) $R^{12}$ and $R^{12'}$, $X^1$ and $X^{1'}$ $R^{12}$ and $R^{12'}$ each independently represent a hydrogen atom or a group capable of substituting for a hydorgen atom on a benzene ring. $X^1$ and $X^{1'}$ each independently represent a hydrogen atom or a group capable of substituting for a hydorgen atom on a benzene ring. Each of the groups capable of substituting for a hydrogen atom on the benzene ring can include, preferably, alkyl group, aryl group, halogen atom, alkoxy group, and acylamino group.

3) L

L represents a —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ can include, for example, methyl group, ethyl group, propyl group, butyl group, heptyl group, undecyl group, isopropyl group, 1-ethylpentyl group, 2,4,4-trimethylpentyl group, cyclohexyl group, 2,4-dimethyl-3-cyclohexenyl group, 3,5-dimethyl-3-cyclohexenyl group and the like. Examples of the substituent for the alkyl group can include, similar to the substituent of $R^{11}$, a halogen atom, an alkoxy group, alkylthio group, aryloxy group, arylthio group, acylamino group, sulfoneamide group, sulfonyl group, phosphoryl group, oxycarbonyl group, carbamoyl group, sulfamoyl group and the like.

4) Preferred Substituents $R^{11}$ and $R^{11'}$ are, preferably, a primary, secondary or tertiary alkyl group having 1 to 15 carbon atoms and can include, specifically, methyl group, isopropyl group, t-butyl group, t-amyl group, t-octyl group, cyclohexyl group, cyclopentyl group, 1-methylcyclohexyl group, 1-methylcyclopropyl group and the like. $R^{11}$ and $R^{11'}$ each represent, more preferably, an alkyl group having 1 to 8 carbon atoms and, among them, methyl group, t-butyl group, t-amyl group, 1-methylcyclohexyl group are further preferred and, methyl group and t-butyl group being most preferred.

$R^{12}$ and $R^{12'}$ are, preferably, an alkyl group having 1 to 20 carbon atoms and can include, specifically, methyl group, ethyl group, propyl group, butyl group, isopropyl group, t-butyl group, t-amyl group, cyclohexyl group, 1-methylcyclohexyl group, benzyl group, methoxymethyl group, methoxyethyl group and the like. More preferred are methyl group, ethyl group, propyl group, isopropyl group, and t-butyl group, and particularly preferred are methyl group and ethyl group.

$X^1$ and $X^{1'}$ are, preferably, a hydrogen atom, a halogen atom, or an alkyl group, and more preferably, a hydrogen atom.

L is preferably a —$CHR^{13}$— group.

$R^{13}$ is, preferably, a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group can include methyl group, ethyl group, propyl group, isopropyl group, 2,4,4-trimethylpentyl group, cyclohexyl group, 2,4-dimethyl-3-cyclohexenyl group, 3,5-dimetyl-3-cyclohexenyl group and the like. Particularly preferable $R^{13}$ is a hydrogen atom, methyl group, ethyl group, propyl group, isopropyl group, or 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ preferably is a primary or secondary alkyl group having 1 to 8 carbon atoms (methyl group, ethyl group, propyl group, isopropyl group, 2,4-dimethyl-3-cyclohexenyl group, or the like).

In the case where $R^{11}$ and $R^{11'}$ are tertiary alkyl group and $R^{12}$ and $R^{12'}$ are an alkyl group other than a methyl group, $R^{13}$ preferably is a hydrogen atom.

In the case where $R^{11}$ and $R^{11'}$ are not a tertiary alkyl group, $R^{13}$ preferably is a hydrogen atom or a secondary alkyl group, and particularly preferably a secondary alkyl group. As the secondary alkyl group for $R^{13}$, isopropyl group and 2,4-dimethyl-3-cyclohexenyl group are preferred.

The reducing agent described above shows different thermal developing performances or developed-silver tones or the like depending on the combination of $R^{11}$, $R^{11'}$, $R^{12}$, $R^{12'}$, and $R^{13}$. Since these performances can be controlled by using two or more kinds of reducing agents at various mixing ratios, it is preferred to use two or more kinds of reducing agents in combination depending on the purpose.

Specific examples of the reducing agents of the invention including the compounds represented by formula (R) according to the invention are shown below, but the invention is not restricted to them.

R-1

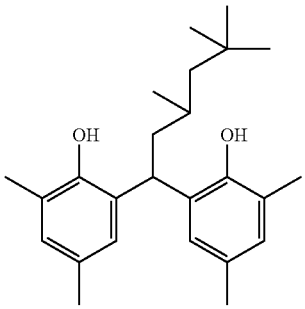

-continued

R-2

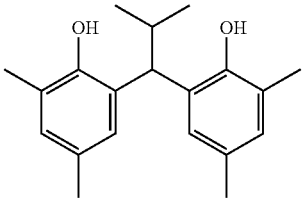

R-3

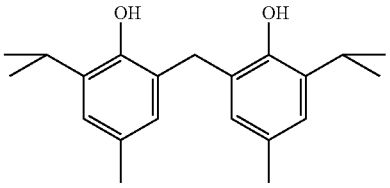

R-4

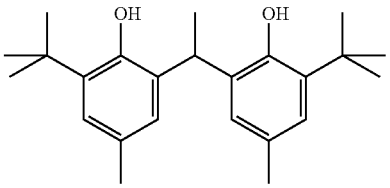

R-5

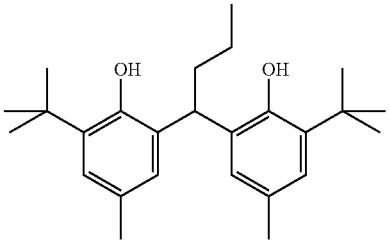

R-6

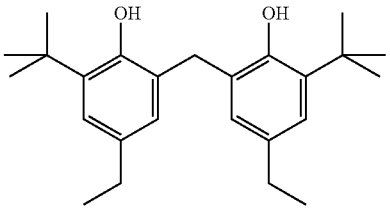

R-7

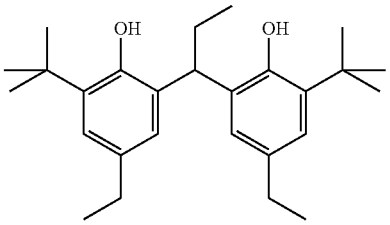

R-8

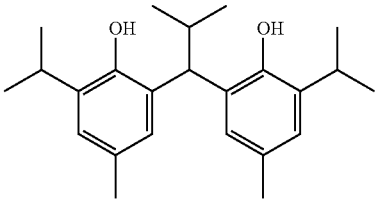

-continued

R-9

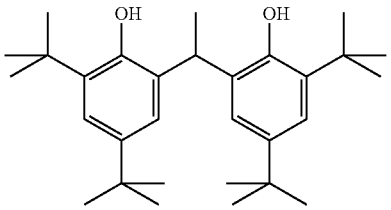

R-10

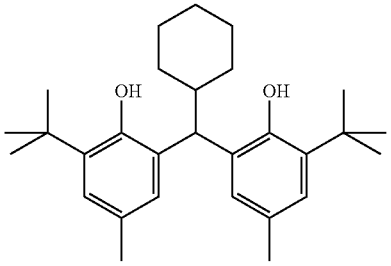

R-11

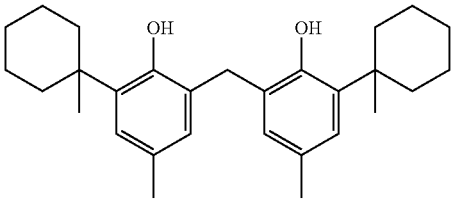

R-12

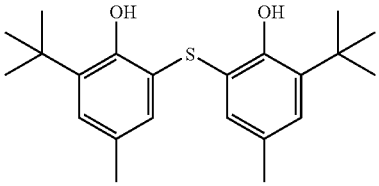

R-13

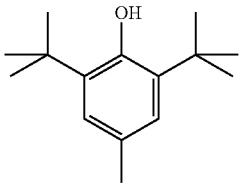

R-14

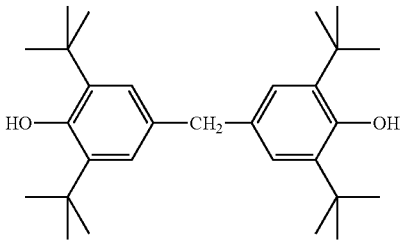

R-15

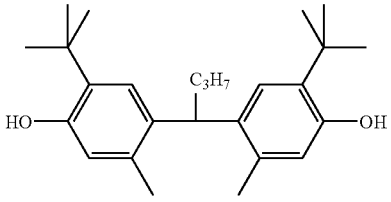

-continued

R-16

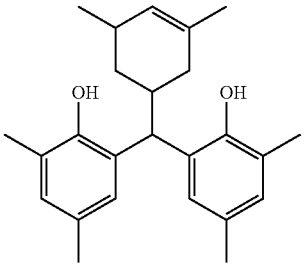

R-17

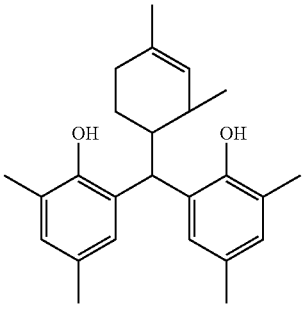

R-18

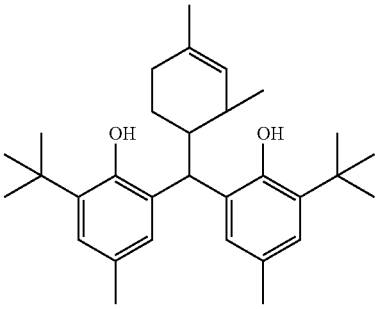

As preferred reducing agents of the invention other than those above, there can be mentioned compounds disclosed in JP-A Nos. 2001-188314, 2001-209145, 2001-350235, and 2002-156727, and EP No. 1278101A2.

In the invention, the addition amount of the reducing agent is, preferably, from 0.1 g/m$^2$ to 3.0 g/m$^2$, more preferably, 0.2 g/m$^2$ to 2.0 g/m$^2$ and, further preferably 0.3 g/m$^2$ to 1.0 g/m$^2$. It is, preferably, contained in a range of 5 mol % to 50 mol %, more preferably, 8 mol % to 30 mol % and, further preferably, 10 mol % to 20 mol % per 1 mol of silver in the surface having the image forming layer. The reducing agent of the invention is preferably contained in the image forming layer.

In the invention, the reducing agent may be incorporated into photothermographic material by being added into the coating solution, such as in the form of solution, emulsion dispersion, solid fine particle dispersion, and the like.

As well known emulsion dispersing method, there can be mentioned a method comprising dissolving the nucleator in an oil such as dibutyl phthalate, tricresyl phosphate, dioctyl sebacate, tri(2-ethylhexyl)phosphate or the like, and an auxiliary solvent such as ethyl acetate cyclohexanone or the like, and then adding a surfactant such as sodium dodecylbenzenesulfonate, sodium oleil-N-methyltaurinate, sodium di(2-ethylhexyl)sulfosuccinate and the like; from which an emulsion dispersion is mechanically produced. During the process, for the purpose of controlling viscosity of oil droplet and refractive index, the addition of polymer such as α-methylstyrene oligomer, poly(t-butylacrylamide) or the like is preferable.

As solid fine particle dispersing method, there can be mentioned a method comprising dispersing the powder of the reducing agent in a proper medium such as water, by means of ball mill, colloid mill, vibrating ball mill, sand mill, jet mill, roller mill, or ultrasonics, thereby obtaining solid dispersion. In this case, there can also be used a protective colloid (such as polyvinyl alcohol), or a surfactant (for instance, an anionic surfactant such as sodium triisopropylnaphthalenesulfonate (a mixture of compounds having the isopropyl groups in different substitution sites)). In the mills enumerated above, generally used as the dispersion media are beads made of zirconia and the like, and Zr and the like eluting from the beads may be incorporated in the dispersion. Although depending on the dispersing conditions, the amount of Zr and the like generally incorporated in the dispersion is in the range from 1 ppm to 1000 ppm. It is practically acceptable so long as Zr is incorporated in an amount of 0.5 mg or less per 1 g of silver.

Preferably, a preservative (for instance, sodium benzoisothiazolinone salt) is added in the water dispersion.

In the invention, furthermore, the reducing agent is preferably used as a solid particle dispersion, and the reducing agent is added in the form of fine particles having mean particle size from 0.01 μm to 10 μm, and more preferably, from 0.05 μm to 5 μm, and further preferably, from 0.1 μm to 2 μm. In the invention, other solid dispersions are preferably used with this particle size range.

(Halogen Releasing Compound)

The photothermographic material of the present invention is characterized by that the material comprises at least one kind of halogen releasing compound having a water-solubilizing group and at least one kind of halogen releasing compound having no water-solubilizing group.

The water-solubilizing group of this invention means a dissociative group having a pKa of 8 or less, or a salt thereof, such as a carboxyl group or a salt thereof, a sulfo group or a salt thereof, a phosphate group or a salt thereof, and the like; a cationic group such as a quaternary ammonium group, a pyridinium group, a guanidine group, an oxonium group, a thiuronium group and the like; a hydroxy group; a non-ionic water-solubilizing group such as a polyoxyalkylene group and the like; and a betaine group, and the like. In addition, the water-solubilizing groups of this invention include a group which can give solubility in water equally or more against above mentioned groups.

The halogen releasing compound having a water-solubilizing group is preferably a compound selected from compounds represented by formula (P) and compounds represented by formula (A).

The halogen releasing compound having no water-solubilizing group is preferably a compound selected from compounds represented by formula (H) and compounds represented by any one of formulae (1a) to (1c).

In the present invention, the rate of combination of halogen releasing compound having a water-solubilizing group and halogen releasing compound having no water-solubilizing group is preferably 0.1/100 to 200/100, more preferably 1/100 to 100/100, and further preferably 2/100 to 50/100.

More preferably, in the photothermographic material of the invention, the halogen releasing compound having a water-solubilizing group is a compound represented by formula (P) and the halogen releasing compound having no water-solubilizing group is a compound represented by formula (H).

As another preferable combination, the halogen releasing compound having a water-solubilizing group is a compound represented by formula (A) and the halogen releasing compound having no water-solubilizing group is a compound selected from compounds represented by any one of formulae (1a) to (1c).

1) Compound Represented by Formula (P)

Formula (P)

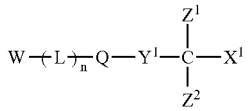

In formula (P), $Z^1$ and $Z^2$ each independently represent a halogen atom, $X^1$ represents a hydrogen atom or an electron-attracting group, $Y^1$ represents a —CO— group or a —$SO_2$— group, Q represents an arylene group, a divalent heterocyclic group or an amino group, L represents a linking group, and W represents a carboxyl group or a salt thereof, a sulfo group or a salt thereof, a phosphate group or a salt thereof, a hydroxy group, a quaternary ammonium group or a polyoxyethylene group. n represents 0 or 1.

Next, the compound represented by formula (P) is explained in detail. In formula (P), $Z^1$ and $Z^2$ each independently represent a halogen atom (fluorine, chlorine, bromine, or iodine). And most preferably, both of $Z^1$ and $Z^2$ are a bromine atom.

In formula (P), $X^1$ represents a hydrogen atom or an electron-attracting group. Herein, an electron-attracting group means the substituent capable to have a positive value of Hammett substituent constant σp, and specifically a cyano group, an alkoxycarbonyl group, an aryloxycarbonyl group, a carbamoyl group, a sulfamoyl group, an arylsufonyl group, a halogen atom, an acyl group, a heterocyclic group and the like are described. In formula (P), $X^1$ is preferably a hydrogen atom or a halogen atom, and most preferably a bromine atom.

In formula (P), $Y^1$ represents a —CO— group or a —$SO_2$— group, and preferably a —$SO_2$— group.

In formula (P), Q represents an arylene group, a divalent heterocyclic group or an amino group. The arylene group represented by Q in formula (P) is preferably a monocyclic or a condensed arylene group having 6 to 30 carbon atoms, and more preferably a monocyclic or a condensed arylene group having 6 to 20 carbon atoms. Examples include a phenylene, a naphthylene, and the like, and particularly preferably a naphthylene. The arylene group represented by Q may have a substituent. As a substituent, any group can be a substituent unless it affects photographic property. Examples include a halogen atom (a fluorine atom, a chlorine atom, a bromine atom, or an iodine atom), an alkyl group (an alalkyl group, a cycloalkyl group, an active methylene group and the like), an alkenyl group, an alkynyl group, an aryl group, a heterocyclic group (which includes an N-substituted-nitrogen-containing heterocyclic group), a heterocyclic group which contains a quaternary nitrogen atom (such as a pyridinio group), an acyl group, an alkoxycarbonyl group, an aryloxycarbonyl group, a cabamoyl group, a carboxyl group or a salt thereof, an imino group, an N-substituted imino group, a thiocabonyl group, a carbazoyl group, a cyano group, a thiocarbamoyl group, an alkoxy group (which includes a group having a repeated unit of ethyleneoxy group or propyleneoxy group), an aryloxy group, a heterocyclic oxy group, an acyloxy group, an alkoxy carbonyloxy group, an aryloxy carbonyloxy group, a carbamoyloxy group, a sulfonyloxy group, an acylamino group, a sulfoneamido group, an ureido group, a thioureido group, an imido group, an alkyloxy carbonylamino group, an aryloxy carbonylamino group, a sulfamoylamino group, a semicarbazide group, a thio semicarbazide group, a hyrazino group, a quaternary ammonio group, an alkyl sulfonylureido group, an aryl sulfonylureido group, a nitro group, an alkylthio group, an arylthio group, a heterocyclic thio group, an acylthio group, an alkylsulfonyl group, an arylsulfonyl group, an alkylsulfinyl group, an arylsulfinyl group, a sulfo group or a salt thereof, a sufamoyl group, a phosphoryl group, a group which contains an amide phosphate structure or a phosphoric ester structure, and a silyl group. These substituents may further be substituted by these substituents. The arylene group represented by Q in formula (P) is particularly preferably an alkyl group, an alkoxy group, an aryloxy group, a halogen atom, a cyano group, a carboxyl group or a salt thereof, a salt of sulfo group, or a phosphate group.

The heterocycle in the divalent heterocyclic group represented by Q in formula (P) is a five to seven membered saturated or unsaturated heterocyclic group which contains at least one of nitrogen, oxygen and sulfur atom. These heterocycles may be monocycles or may be further condensed by another ring. Examples of the heterocycle in the divalent heterocyclic group represented by Q include pyridine, pyrazine, pyrimidine, benzothiazole, benzimidiazole, thiadiazole, quinoline, isoquinoline, triazole, triazine, and the like. These compounds may have a substituent and specifically similar substituents to those of the arylene group represented by Q can be described. Q in formula (P) represents preferably an arylene group and, particularly preferably a phenylene group. In the case where Y is a CO group, Q is preferably an amino group.

L in formula (P) represents a linking group, and examples include an alkylene group (which includes an alkylidene group and a cyclic group having 1 to 30 carbon atoms, preferably 1 to 20 carbon atoms, and particularly preferably 1 to 10 carbon atoms), an arylene group (preferably having 6 to 30 carbon atoms, more preferably 6 to 20 carbon atoms, and particularly preferably 6 to 10 carbon atoms), an alkenylene group (preferably having 2 to 30 carbon atoms, more preferably 2 to 20 carbon atoms, and particularly preferably 2 to 10 carbon atoms), an alkynylene group (preferably having 2 to 30 carbon atoms, more preferably 2 to 20 carbon atoms, and particularly preferably 2 to 10 carbon atoms), a heterocyclic group (preferably having 1 to 30 carbon atoms, more preferably 1 to 20 carbon atoms, and particularly preferably 1 to 10 carbon atoms), a —O— group, a —NR— group, a —CO— group, a —COO— group, a —OCOO— group, a —NRCO— group, a —NRCONR— group, a —OCONR— group, a —S— group, a —SO— group, a —$SO_2$— group, a —$SO_2$NR— group, a group which contains phosphorus atom, and a group formed by combination of the above-mentioned groups and the like. (Herein R represents a hydrogen atom, an alkyl group which may have a substituent, or an aryl group which may have a substituent.)

The linking group represented by L in formula (P) may have a substituent, and specifically similar substituents to those of the arylene group represented by Q can be described.

The linking group represented by L in formula (P) is preferably an alkylene group, an arylene group, a —O— group, a —NRCO— group, a —$SO_2$NR— group, or a group formed by combination of the above-mentioned groups. If possible, it may partly form a ring. n is 0 or 1.

W in formula (P) represents a carboxyl group or a salt thereof (salt of Na, K, ammonium, and the like), a sulfo group or a salt thereof (salt of Na, K, ammonium, and the like), a phosphate group or a salt thereof (salt of Na, K, ammonium, and the like), a hydroxy group, a quarternary ammonium group (for example, tetrabutylammonium, tribenzylammonium, and the like), and a polyethylenoxy group. W preferably is a carboxyl group or a salt thereof, a salt of a sulfo group, or a hydroxy group.

Next, examples of the compound according to the present invention are described below, however, the invention is not limited thereto.

P-1

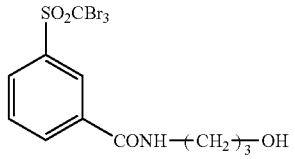

P-2

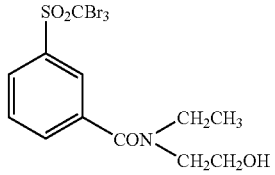

P-3

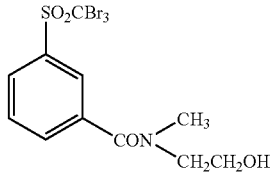

P-4

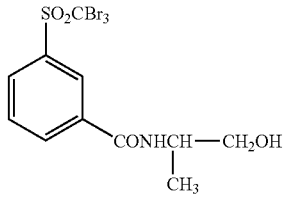

P-5

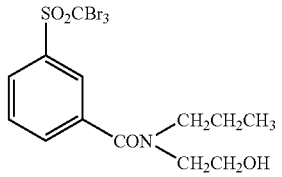

P-6

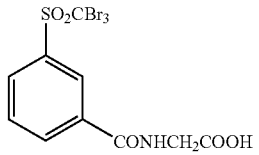

-continued
P-7
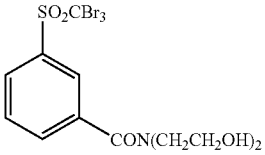
P-8
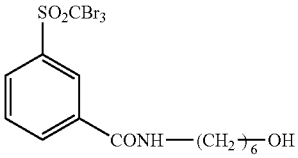
P-9
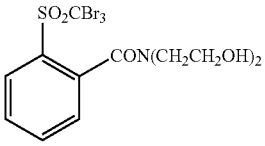
P-10
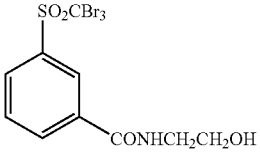
P-11
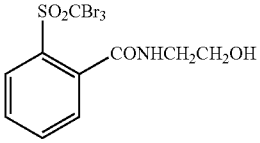
P-12
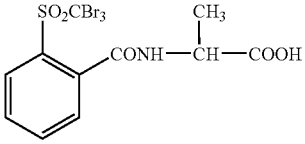
P-13
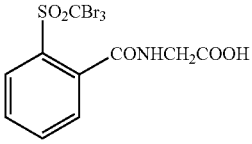
P-14
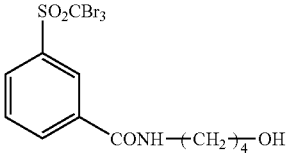
P-15
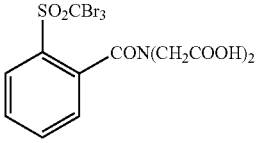
P-16
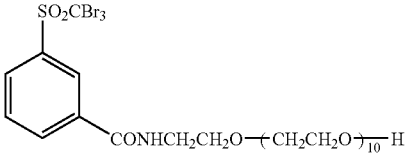
-continued
P-17
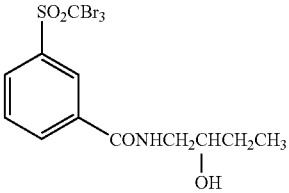
P-18
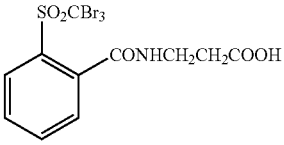
P-19
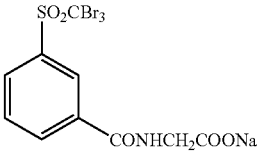
P-20
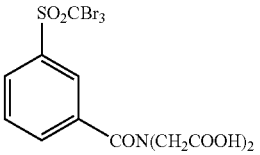
P-21
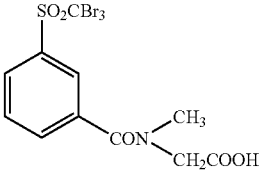
P-22
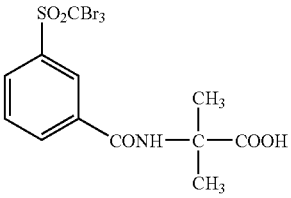
P-23
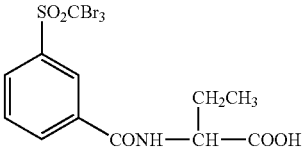
P-24
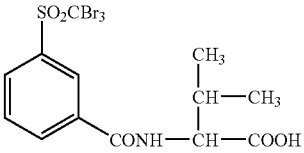
P-25
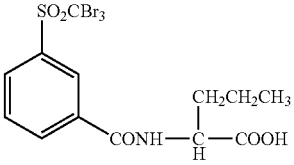

-continued
P-26
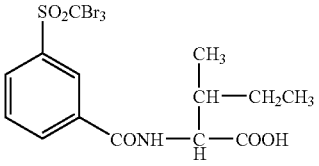
P-27
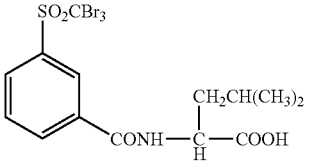
P-28
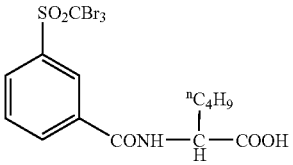
P-29
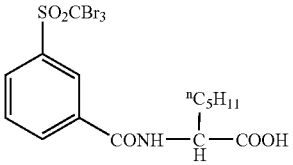
P-30
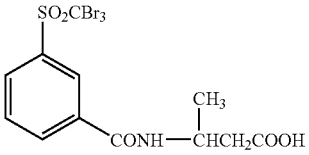
P-31
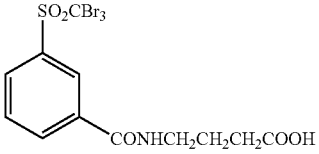
P-32
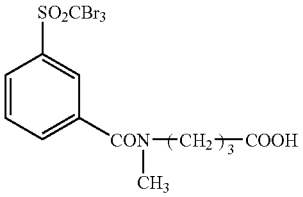
P-33
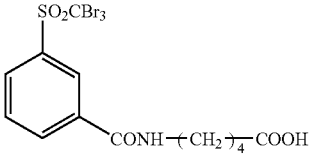
P-34
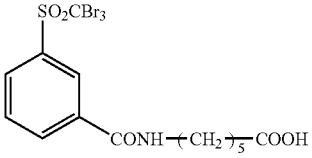
-continued
P-35
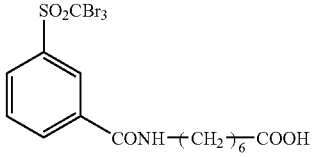
P-36
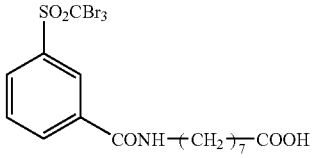
P-37
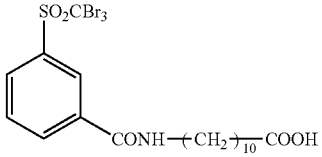
P-38
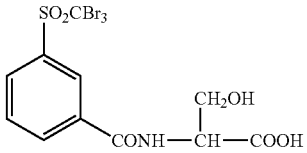
P-39
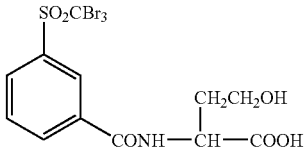
P-40
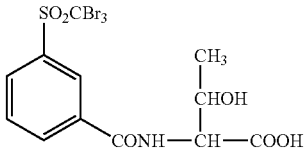
P-41
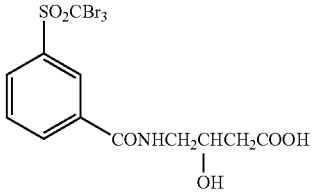
P-42
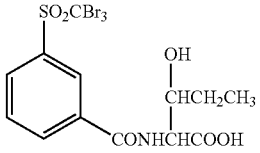
P-43
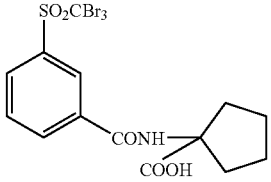

-continued
P-44
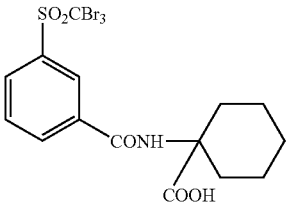
P-45
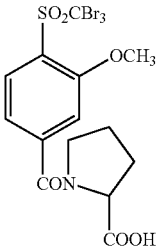
P-46
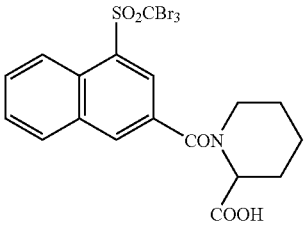
P-47
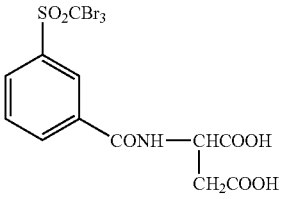
P-48
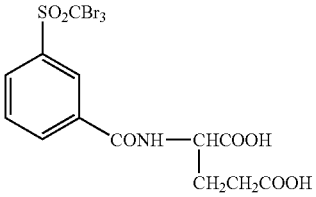
P-49
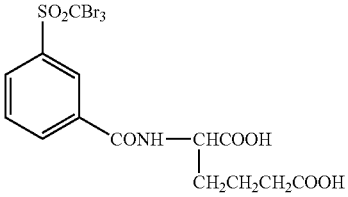
P-50
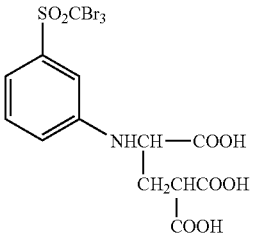
-continued
P-51
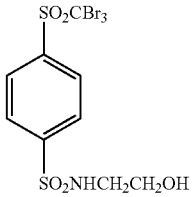
P-52
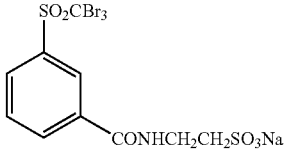
P-53
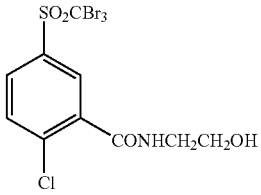
P-54
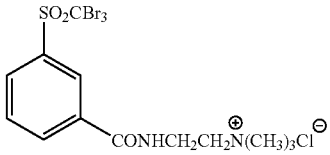
P-55
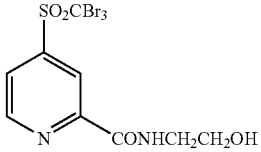
P-56
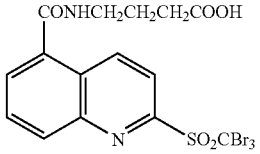
P-57
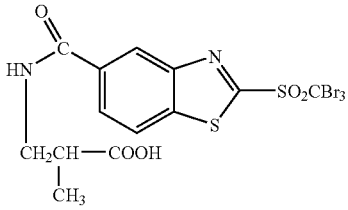
P-58
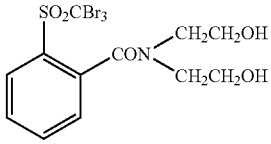
P-59
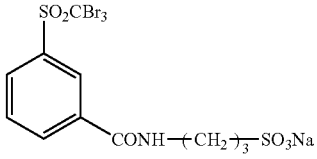

-continued
P-60
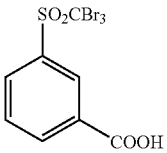
P-61
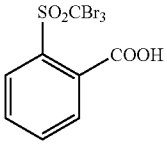
P-62
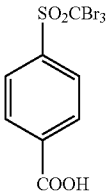
P-63
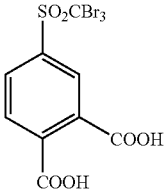
P-64
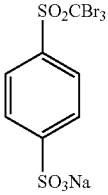
P-65
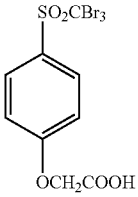
P-66
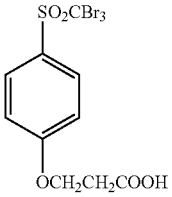
P-67
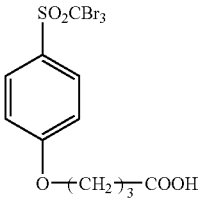
-continued
P-68
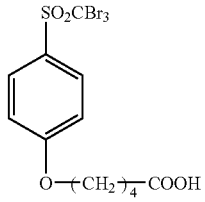
P-69
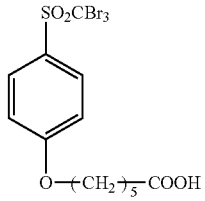
P-70
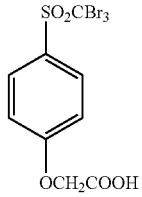
P-71
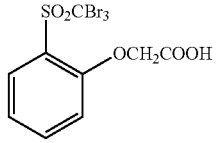
P-72
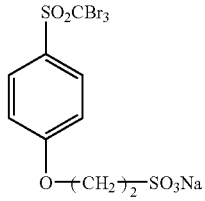
P-73
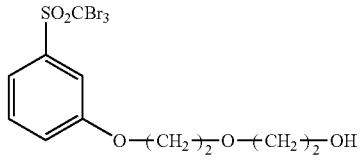
P-74
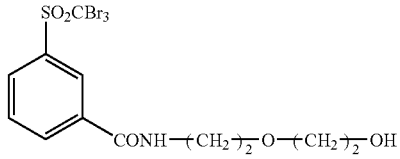
P-75
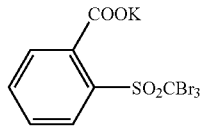
P-76
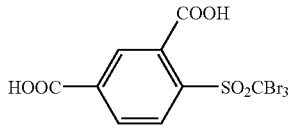

-continued
P-77
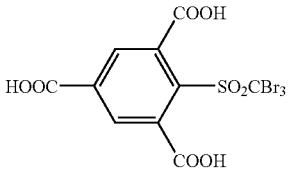
P-78
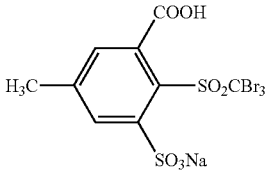
P-79
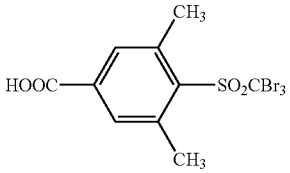
P-80
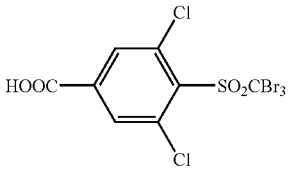
P-81
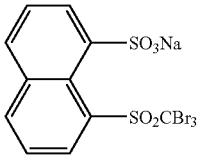
P-82
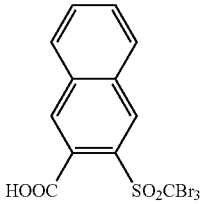
P-83
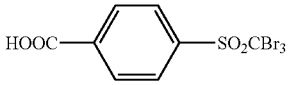
P-84
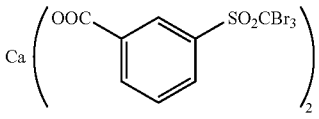
P-85
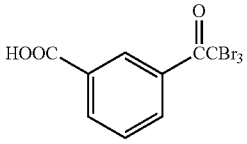
-continued
P-86
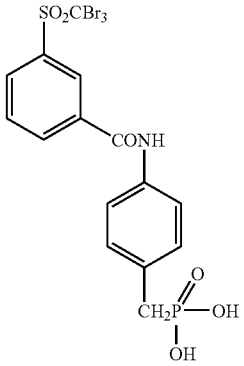
P-87
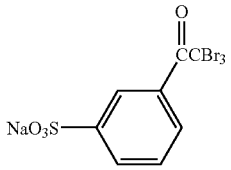
P-88
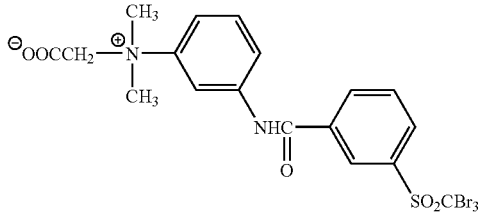
P-89
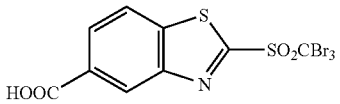
P-90
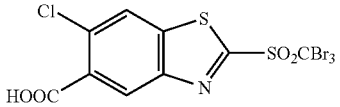
P-91
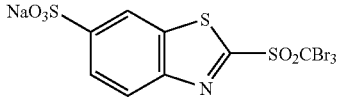
P-92
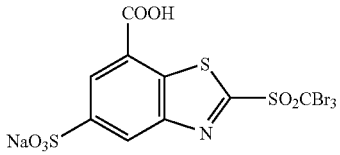
P-93
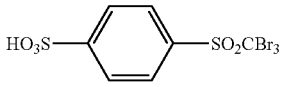
P-94
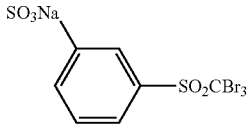

-continued
P-95
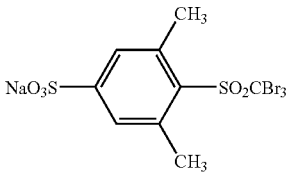
P-96
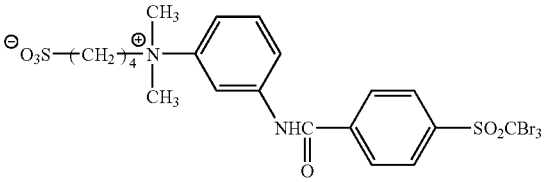
P-97
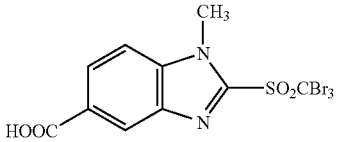
P-98
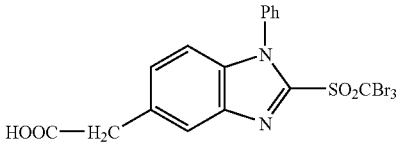
P-99
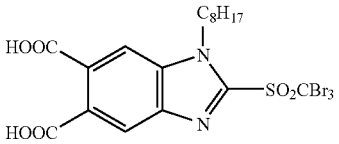
P-100
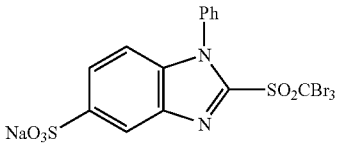
P-101
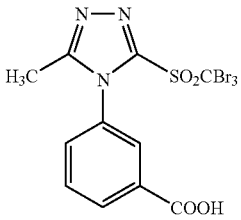
P-102
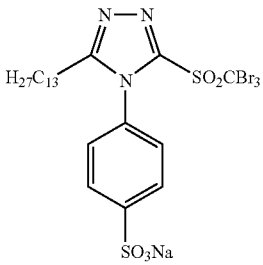
-continued
P-103
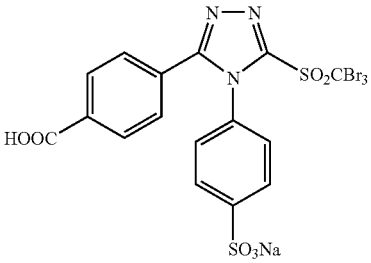
P-104
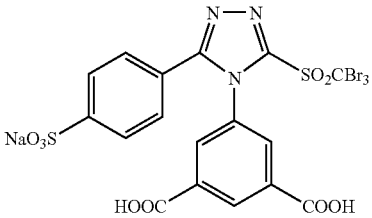
P-105
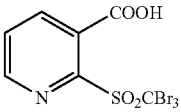
P-106
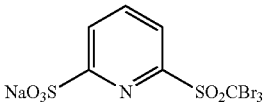
P-107
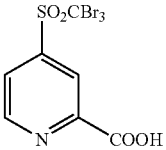
P-108
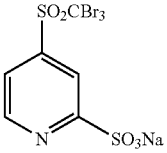
P-109
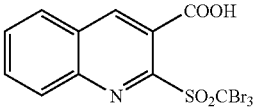
P-110
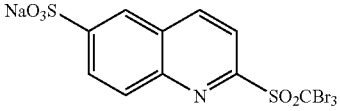
P-111
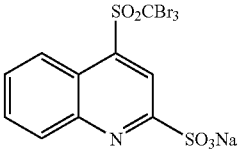

-continued

P-112

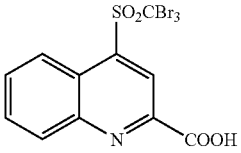

P-113

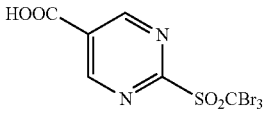

P-114

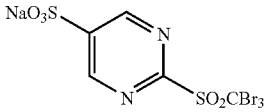

P-115

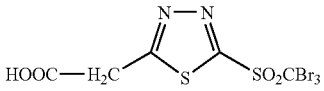

P-116

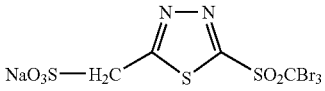

P-117

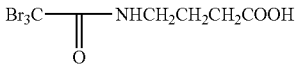

P-118

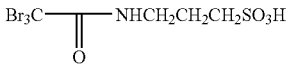

P-119

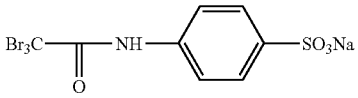

P-120

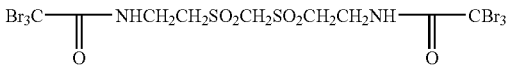

The compounds of the present invention can be synthesized easily by general organic synthesis reactions. A method described in JP-A No. 2000-284409, paragraph No. 102 to 107 can be applied more concretely.

The compound represented by the formula (P) is used by dissolving in water or in an appropriate organic solvent, for example alcohols (methanol, ethanol, propanol, fluorinated alcohol), ketones (acetone, methyl ethyl ketone, methyl isobutyl ketone), dimethyl formamide, dimethyl sulfoxide, methyl cellosolve and the like. A compound which is linked with an acidic group may be neutralized with an equivalent alkali and added as a salt.

Further, the compound represented by formula (P) can be used as an emulsion dispersion which is prepared by a previously known emulsion dispersing method, that is, a method comprising dissolving the compound in an oil such as dibutyl phthalate, tricresyl phosphate, glyceryl triacetate, diethyl phthalate or the like, as well as an auxiliary solvent such as ethyl acetate, cyclohexanone or the like; from which an emulsion dispersion is mechanically produced. Or, the compound can be used as a solid dispersion which is prepared by a known solid dispersing method, that is, a method comprising dispersing the powder of the compound in water, by means of ball mill, colloid mill, sand grinder mill, Mantongoulin, micro fluidizer, or ultrasonics.

The compound represented by formula (P) of the invention may be added to a layer which is disposed on the side having the image forming layer toward the support, that is, to the image forming layer or to any other layer which is disposed on this side, but the compound is preferably added to the image forming layer or the layer adjacent to the image forming layer.

The compound represented by formula (P) of the invention may be added at any amount according to the properties of sensitivity and fog, but it is preferably added from $10^{-4}$ mol to 1 mol, and more preferably from $10^{-3}$ mol to $5\times10^{-1}$ mol, per 1 mol of non-photosensitive silver salt in the image forming layer.

2) Compound Represented by Formula (A)

$$R_1—SO_2—C(R_2)R_3—(CO)_m—(L)_n—SG \qquad \text{Formula (A)}$$

In the above-mentioned formula, $R_1$ is an aliphatic group or a cyclic group, $R_2$ and $R_3$ are each independently a hydrogen atom or a bromine atom, provided that at least one of these is a bromine atom. L is a divalent aliphatic bonding group. m and n are each independently 0 or 1. SG is a solubilizing group having pKa of 8 or less.

In the above-mentioned formula, $R_1$ may be a substituted or unsubstituted aliphatic group or cyclic group, and may be any size as far as the compound represented by formula (A) is soluble in water or easy to disperse. As the substituted or unsubstituted aliphatic group represented by $R_1$, a monovalent group which has a chain having 1 to 20 atoms including a carbon atom, a nitrogen atom, a sulfur atom or an oxygen atom is described. The chain is not restricted but, an alkylene group which has one or plural substituents or an unsubstituted alkylene group (having 1 to 10 carbon atoms), a substituted or unsubstituted alkenylene group (having 2 to 20 carbon atoms), a substituted or unsubstituted alkylenearylene group (having 7 to 20 carbon atoms), a combined group of the above-mentioned groups, and a combination where the above-mentioned group is connected with one or plural connecting groups are described. As the connecting group, amino, amide, carbonyl, sulfonyl, carbonamide, sulfoneamide, thio, oxy, oxycarbonyl, oxysulfonyl and a group which is easily imaged by technical experts in the art are included. These useful aliphatic groups will be understood by technical experts in the art.

Preferable aliphatic group represented by $R_1$ is a substituted or unsubstituted t-butyl group or trifluoromethyl group.

Further, $R_1$ may be a substituted or unsubstituted cyclic group. As the cyclic group, a substituted or unsubstituted aryl group (having 6 to 14 carbon atoms which form a ring), a substituted or unsubstituted cycloalkylene group (having 5 to 10 carbon atoms which form a ring), and a heterocyclic group (having 5 to 10 atoms which form a ring and include a carbon atom, a nitrogen atom, sulfur atom or oxygen atom) are described, and an aromatic and non-aromatic group are described. Various cyclic groups will be easily imaged by technical experts in the art.

Preferable cyclic groups of $R_1$ are a substituted or unsubstituted aryl group having 6 to 10 carbon atoms which form a ring. A substituted or unsubstituted phenyl group is most preferable. A methyl group is a preferable substituent for the above-mentioned phenyl group.

More preferably, $R_1$ is 4-methylphenyl, phenyl, trifluoromethyl, adamantyl, or tertiary butyl.

In formula (A), as far as one of $R_1$ and $R_2$ is bromine, $R_1$ and $R_2$ are independently a hydrogen atom or a bromine atom. It is preferred that both of $R_1$ and $R_2$ are a bromine atom.

In addition to that, L is a substituted or unsubstituted divalent aliphatic bonding group, and it will be defined as similar to $R_1$ except that L is divalent. Therefore, technical experts in the art can select an appropriate L group keeping water solubility and water-dispersing property for this purpose. L is preferably a —NH-alkylene group {in the formula, "alkylene" means a substituted or unsubstituted alkylene having 1 to 10 carbon atoms (more preferably 1 to 3 carbon atoms)}.

In the case where m and n are each independently 1, L is preferably a —N($CH_3$)-alkylene group, or a —NH-alkylene group.

Substituents on $R_1$ and L may be any chemical parts unless it will influence on the function of the above-mentioned compound represented by formula (A). Examples include an alkyl group, an aryl group, a heterocyclic group, a cycloalkyl group, an amino group, a carboxyl group, a hydroxy group, a phospho group, a sulfonamide group, a sulfo group, and the like. The number of substituents will be limited only by the number of available valences (the number of replaceable hydrogen atoms). Preferable substituent group of cyclic $R_1$ group is an alkyl group. Clearly, however, an antifoggants may include a plural number of a sulfo group, a carboxyl group, a phospho group or a phosphoramide group which give water solubility to the molecule.

In formula (A), m and n are independently 0 or 1, and preferably both of m and n are 1.

SG may be a solubilizing group having pKa of 8 or less, which does not inhibit antifogging activity. SG may be a free acid group, or a salt, particularly an appropriate metal salt (for example, alkaline metal salt) or a salt of an ammonium ion. Preferably, SG is a salt. In the case where SG is a free acid group, a salt thereof may be prepared on the spot by neutralization with basic materials which are used generally by technical experts in the art. SG is preferably a carboxyl group, a phospho group, a sulfo group, or a sulfonamide group. In the case where SG is a sulfonamide group, it may be —$SO_2N$—$COR_4M^+$ or —$NSO_2R_4M^+$ (in the formula, $R_4$ is a substituted or unsubstituted aliphatic or cyclic group defined from $R_1$). $R_1$ and $R_4$ may be the same or different groups. More preferably, in the case where both of m and n are 1, SG is a carboxyl group or a sulfo group (or a salt thereof).

$M^+$ is a hydrogen atom or an appropriate cation, such as a metal cation (preferably an alkaline metal cation), or an ammonium ion. In the case where $M^+$ is a hydrogen atom, the obtained free acid is easily solubilized by neutralization with an appropriate base such as potassium hydroxide or sodium hydrogencarbonate.

As for favorable operating embodiment, when both of m and n are 0, SG is a carboxyl group (or a salt thereof), a sulfo group (or a salt thereof), a phospho group (or a salt thereof), —$SO_2N$—$COR_4M^+$, or —$NSO_2R_4M^+$ (in the formula, $M^+$ is the same as defined above) And, when both of m and n are 1, SG is a carboxyl group (or a salt thereof), a sulfo group (or a salt thereof), a phospho group (or a salt thereof), or —$SO_2N$—$COR_4M^+$ (in the formula, $M^+$ is the same as defined above) Further, when m is 1 and n is 0, SG is a carboxyl group (or a salt thereof), a sulfo group (or a salt thereof), a phospho group (or a salt thereof), or —$NSO_2R_4M^+$ (in the formula, $M^+$ is the same as defined above).

Examples of compounds represented by formula (A) useful to conduct the present invention are described below.

A-1

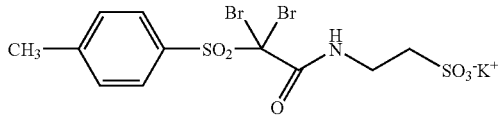

A-2

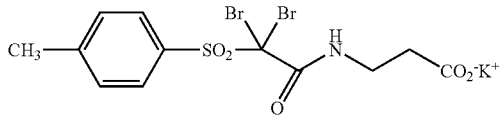

A-3

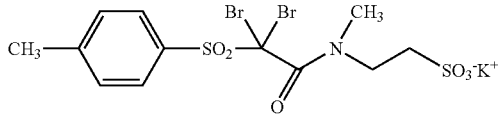

A-4

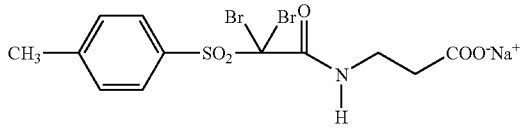

A-5

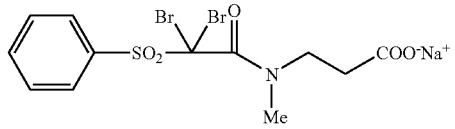

A-6

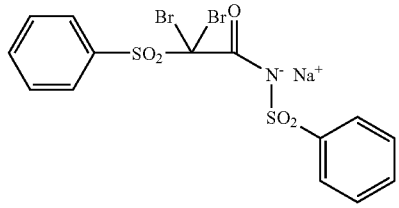

A-7

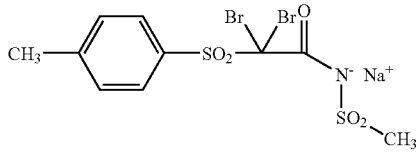

A-8

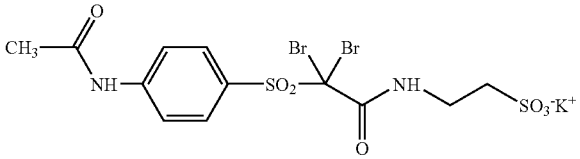

A-9

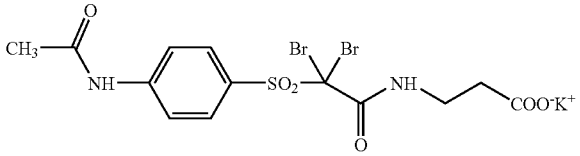

-continued
A-10
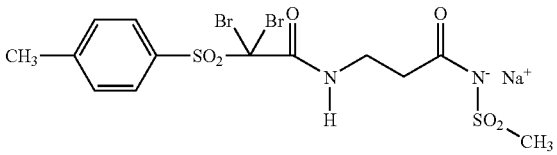
A-11
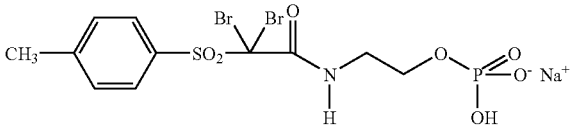
A-12
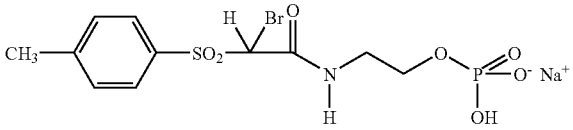
A-13
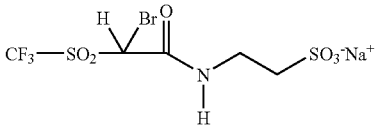
A-14
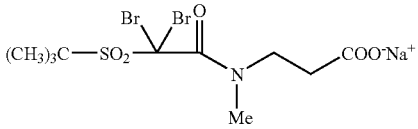
A-15
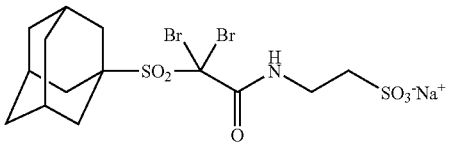
A-16
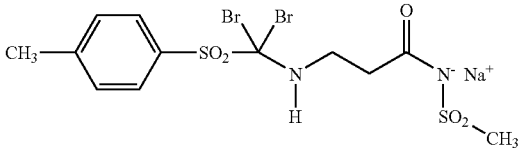
A-17
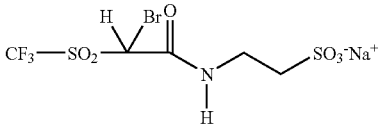
A-18
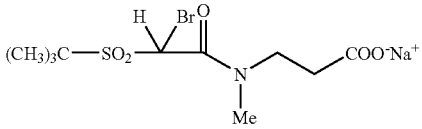
A-19
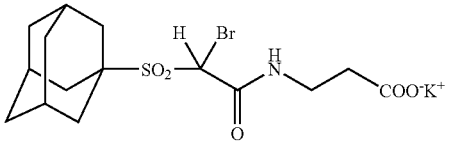
-continued
A-20
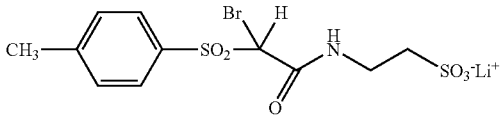
A-21
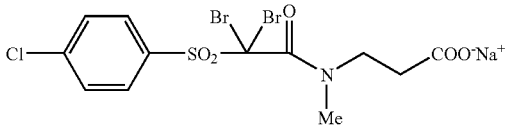
A-22
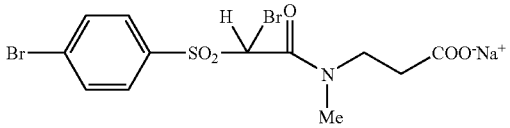
A-23
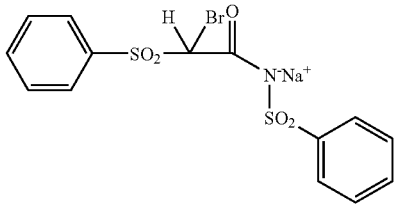
A-24
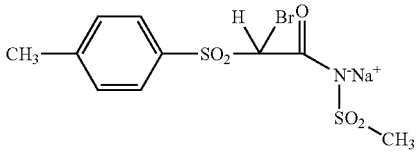
A-25
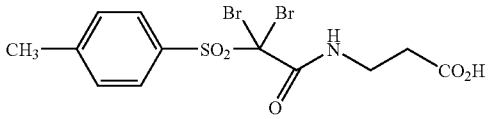
A-26
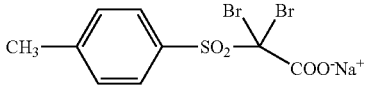
A-27
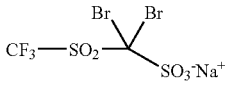
A-28
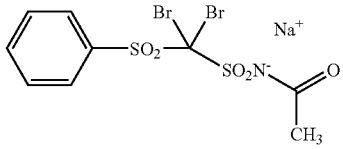
A-29
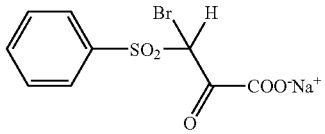
A-30
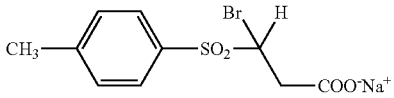

-continued

A-31

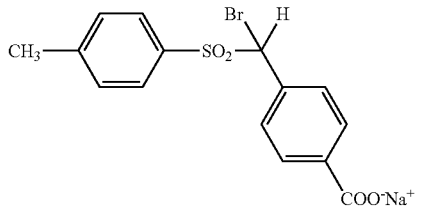

Compounds of formula (A) can be prepared through the starting materials and processes which are easily understood by technical experts. For example, in the case of the compound wherein m is 1 (and n is 0 or 1), a salt of sulfinic acid (for example, sodium salt of p-toluensulfinic acid) is reacted with 2-bromomethylcarbonyl derivative, and then, the resulting sulfone is submitted to bromination with molecular bromine or other appropriate brominating reagents.

Instead of using a salt of sulfinic acid, the same compound is also prepared by condensing an aromatic or aliphatic thiol with 2-bromomethylcarbonyl derivative, and then the resulting thioether is oxidized to obtain a sulfone, followed by bromination.

Some of 2-bromomethylcarbonyl derivatives can be prepared from bromoacetylbromide and the following amines. That is, taurine described by Parton et al. in U.S. Pat. No. 5,091,298, glycine described by Hwang et al. in Journal of the Korean Society of Textile Engineers and Chemists, December 1981, page 13, or methanesulfoneamide described by Harrison et al. in U.S. Pat. No. 5,620,989.

Monobromination is carried out by using one equivalent mole of bromine source or a less active brominating reagent, or by adjusting the brominating condition.

The words "water-soluble" or "dispersible in water" used in this invention mean that the compound is more soluble in water or more dispersible in water than in the polar organic solvent (for example, methyl ethyl ketone or acetone) which is generally used for coating the mixture of compounds of the photothermographic material of the invention.

The compound of formula (A) is generally contained at least 0.001 mol per 1 mol of total amount of coated silver, preferably from 0.001 mol to 0.1 mol per 1 mol of total amount of silver.

The compound of formula (A) is preferably contained in one or plural coating layers of photothermographic material. The compound of formula (A) may be added in the image forming layer, or in the intermediate layer, the underlayer, or the surface protective layer which are disposed on the surface having the image forming layer. The compound of formula (A) has a tendency to move into the image forming layer even if it is added in a non-photosensitive layer, and becomes to reduce Dmin efficiently. Preferably, the compound of formula (A) is added in the image forming layer.

3) Compound Represented by Formula (H)

$$Q—(Y)n\text{-}C(Z_1)(Z_2)X \qquad \text{Formula (H)}$$

In formula (H), Q represents an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group. Provided that the compound represented by formula (H) never has a water-solubilizing group.

In formula (H), Q is preferably an alkyl group having 1 to 6 carbon atoms, an aryl group having 6 to 12 carbon atoms, or a heterocyclic group containing at least one nitrogen atom (pyridine, quinoline or the like).

In formula (H), in the case where Q is an aryl group, Q preferably is a phenyl group substituted by an electron-attracting group whose Hammett substituent constant σp yields a positive value. For the details of Hammett substituent constant, reference can be made to Journal of Medicinal Chemistry (1973), vol. 16, No. 11, pp. 1207 to 1216, and the like. As such electron-attracting groups, examples can include, halogen atoms, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, a sulfamoyl group, and the like. Preferable as the electron-attracting groups are a halogen atom, a carbamoyl group and an arylsulfonyl group, and particularly preferred among them is a carbamoyl group.

X preferably is an electron-attracting group. As the electron-attracting group, preferable are a halogen atom, an aliphatic aryl sulfonyl group, a heterocyclic sulfonyl group, an aliphatic aryl acyl group, a heterocyclic acyl group, an aliphatic aryl oxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ are preferably a bromine atom, or an iodine atom, and more preferred are a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$—or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and preferably represents 1.

In formula (H), in the case where Q is an alkyl group, preferable Y is —C(═O)N(R)—. And in the case where Q is an aryl group or a heterocyclic group, preferable Y is —$SO_2$—.

In formula (H), the form where the residues, that are obtained by removing a hydrogen atom from the compound, bind each other (generally called as bis type, tris type, or tetrakis type) is also preferably used. Specific examples of the compound expressed by formula (H) of the invention are shown below.

H-1

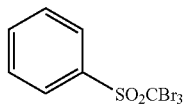

H-2

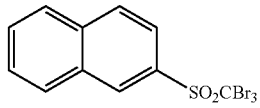

H-3

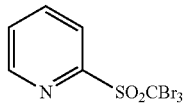

-continued

H-4

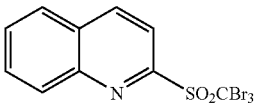

H-5

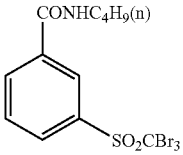

H-6

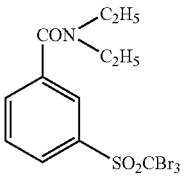

H-7

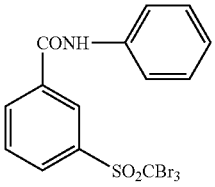

H-8

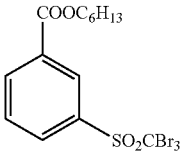

H-9

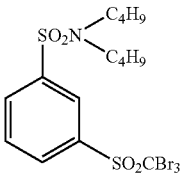

H-10

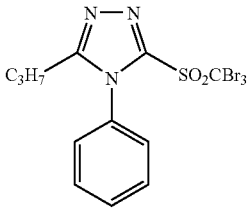

H-11

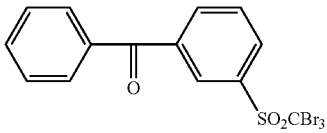

H-12

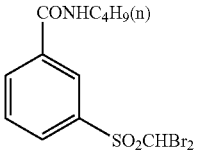

-continued

H-13

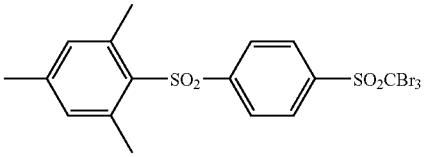

The compound expressed by formula (H) of the invention is preferably used in an amount from $10^{-4}$ mol to 1 mol, more preferably $10^{-3}$ mol to 0.5 mol, and further preferably $1\times10^{-2}$ mol to 0.2 mol, per 1 mol of non-photosensitive silver salt incorporated in the image forming layer.

The compound represented by formula (H) of the invention is preferably added in the form of solid fine particle dispersion.

4) Compound Represented by Formulae (1a), (1b) or (1c)

The compounds represented by formulae (1a), (1b) and (1c) in the embodiment of the present invention are described below.

$$R—Y_1—(L_1)_{n1}—CX_1X_2X_3 \qquad \text{Formula (1a)}$$

wherein, $X_1$, $X_2$ and $X_3$ each independently represent a hydrogen atom or a substituent, provided that at least one of $X_1$, $X_2$ and $X_3$ is a halogen atom. $L_1$ represents a sulfonyl group. n1 represents 0 or 1. $Y_1$ represents —N($R_1$)—, a sulfur atom, an oxygen atom, a selenium atom, or —($R_2$)C═C($R_3$)—, and $R_1$, $R_2$ and $R_3$ each independently represent a hydrogen atom or a substituent. R represents a hydrogen atom, a halogen atom, an aliphatic group, an aryl group, or a heterocyclic group.

$$R—Y_2—L_2—CX_1X_2X_3 \qquad \text{Formula (1b)}$$

wherein, $X_1$, $X_2$ and $X_3$ each independently represent a hydrogen atom or a substituent, provided that at least one of $X_1$, $X_2$ and $X_3$ is a halogen atom. $L_2$ represents a carbonyl group or a sulfinyl group. $Y_2$ represents —N($R_1$)—, a sulfur atom, an oxygen atom, a selenium atom, or —($R_2$)C═C($R_3$)—, and $R_1$, $R_2$ and $R_3$ each independently represent a hydrogen atom or a substituent. R represents a hydrogen atom, a halogen atom, an aliphatic group, an aryl group, or a heterocyclic group.

$$R—Y_3—(L_3)_{n2}—CX_1X_2X_3 \qquad \text{Formula (1c)}$$

wherein, $X_1$, $X_2$ and $X_3$ each independently represent a hydrogen atom or a substituent, provided that at least one of $X_1$, $X_2$ and $X_3$ represents a halogen atom. $L_3$ represents a sulfonyl group, a carbonyl group, or a sulfinyl group. n2 represents 2 or 3. $Y_3$ represents a single bond, —N($R_1$)—, a sulfur atom , an oxygen atom, a selenium atom, or —($R_2$)C═C($R_3$)—, and $R_1$, $R_2$ and $R_3$ each independently represent a hydrogen atom or a substituent. R represents a hydrogen atom, a halogen atom, an aliphatic group, an aryl group, or a heterocyclic group.

(Compound Represented by Formulae (1a) and (1b))

The compound represented by formulae (1a) and (1b) will be described below.

In formulae (1a) and (1b) described above, $X_1$, $X_2$ and $X_3$ each independently represent a hydrogen atom or a substituent, provided that at least one of $X_1$, $X_2$ and $X_3$ represents a halogen atom. The halogen atom is F, Cl, Br or I. In the case where more than two or more are substituted, the halogen atoms may be the same or different, preferably, Cl or Br, and more preferably Br.

A subtituent other than a halogen atom may be any substituent, but is preferably an alkyl group, an alkenyl group, an aryl group, an alkoxy group, an acyl group, an alkoxycarbonyl group, an aryloxy group, an aryloxycarbonyl group, a carbamoyl group, a sulfamoyl group, an acyloxy group, an acylamino group, an alkoxycarbonylamino group, an aryloxycarbonylamino group, a sulfonylamino group, an ureido group, a phosphoramido group, a sulfinyl group, a hydroxy group, or a heterocyclic group.

Among these, an electron-attracting group is preferable, such as a trihalomethyl group, an acyl group, an alkoxycarbonyl group aryloxycarbonyl group, carbamoyl group, sulfamoyl group and the like.

Particularly preferably, all of $X_1$, $X_2$ and $X_3$ are halogen atoms, and more preferably, all of $X_1$, $X_2$ and $X_3$ are Br.

$Y_1$ and $Y_2$ each independently represent —N($R_1$)—, a sulfur atom, an oxygen atom, a selenium atom, or —($R_2$)C═C($R_3$)—. $R_1$, $R_2$, and $R_3$ are each independently a hydrogen atom or a substituent. $Y_1$ and $Y_2$ are independently preferably —N($R_1$)—, an oxygen atom, or a vinyl group, and particularly preferably —N($R_1$)—. In the case where $Y_1$ represents —N($R_1$)— in formula (1a), $R_1$ is preferably an alkyl group, and more preferably, R and $R_1$ bond together to form an alicyclic group. In the case where $Y_2$ represents —N($R_1$)— in formula (1b), $R_1$ is preferably a hydrogen atom.

R represents a hydrogen atom, a halogen atom, an aliphatic group [a substituted or an unsubstituted aliphatic group, and may be linear, branched, or cyclic alkyl group (preferably a substituted or an unsubstituted alkyl group having 1 to 30 carbon atoms, for example, methyl, ethyl, n-propyl, isopropyl, t-butyl, n-octyl, eicosyl, 2-chloroethyl, 2-cyanoethyl, 2-ethylhexyl, cyclohexyl, cyclopentyl, 4-n-dodecylcyclohexyl, bicyclo[1,2,2]heptan-2-yl, bicyclo[2,2,2]octan-3-yl, and the like), alkenyl group (preferably a substituted or an unsubstituted alkenyl group having 2 to 30 carbon atoms, for example, vinyl, aryl, prenyl, geranyl, oleyl, 2-cyclopenten-1-yl, 2-cyclohexen- 1-yl, bicyclo[2,2,1]hept-2-en-1-yl, bicyclo[2,2,2]oct-2-en-4-yl, and the like), alkinyl group (preferably a substituted or an unsubstituted alkenyl group having 2 to 30 carbon atoms, for example, ethynyl, propargyl, a trimethylsilylethyl group and the like)], aryl group (preferably a substituted or an unsubstituted aryl group having 6 to 30 carbon atoms, for example, phenyl, p-tolyl, naphtyl, m-chlorophenyl, o-hexadecanylaminophenyl, and the like), or heterocyclic group (preferably a substituted or an unsubstituted, an aromatic or non-aromatic five or six-membered heterocyclic group, wherein the heterocyclic group means a univalent heterocyclic group derived from a heterocyclic compound by removal of one hydrogen atom, for example, a furyl group, a thienyl group, a pyrimidinyl group, a benzothiazolyl group, a pyridyl group, a triazinyl group, a thiazol group, a benzothiazol group, an oxazol group, a benzoxazol group, an imidazol group, a benzoimidazol group, a pyrazol group, an indazol group, an indol group, a purine group, a quinoline group, an isoquinoline group, a quinazoline group, a piperidyl group and the like).

In the aforementioned formulae (1a) and (1b), R preferably is an aliphatic group, an aryl group, or a heterocyclic group, more preferably an alkyl group or an aryl group, and particularly preferably an alkyl group. In the case where R is an aliphatic group, an aryl group or a heterocyclic group, it is preferred that R further has (preferably, two to four in total) —$Y_1$—$(L_1)_{n1}$—$CX_1X_2X_3$ group or —$Y_2$—$L_2$—$CX_1X_2X_3$ group. In this case, R preferably has additionally one or more —$Y_1$—$(L_1)_{n1}$—$CX_1X_2X_3$ groups in formula (1a), and R preferably has additionally one or more —$Y_2$—$L_2$—$CX_1X_2X_3$ groups in formula (1b), wherein each of $Y_1$, $L_1$, n1, $X_1$, $X_2$, $X_3$, $Y_2$ and $L_2$ represent the same as those in formulae (1a) and (1b).

$L_1$ represents a sulfonyl group, and $L_2$ represents a carbonyl group or a sulfinyl group. n1 represents 0 or 1, and preferably 1.

(Compound Represented by Formula (1c))

The compounds represented by formula (1c) are described below. In formula (1c), $X_1$, $X_2$, $X_3$ and R represent the same as defined in formulae (1a) and (1b), and preferable range of R is also the same as defined therein.

In the case where R is an aliphatic group, an aryl group, or a heterocyclic group, R preferably has plural (preferably two to four) —$Y_3$—$(L_3)_{n2}$—$CX_1X_2X_3$, wherein, each of $Y_3$, $n_2$, $X_1$, $X_2$, $X_3$ and $L_3$ are the same as those in formula (1c).

$Y_3$ in formula (1c) represents the same as $Y_2$ in formula (1b). $Y_3$ preferably is a single bond, —N($R_1$)—, an oxygen atom, or a vinyl group, and particularly preferably a single bond. In the case where $Y_3$ is —N($R_1$)—, $R_1$ preferably represents a hydrogen atom or an alkyl group. And where $R_1$ represents an alkyl group, R and $R_1$ preferably bond together to form an alicyclic group. $L_3$ represents a sulfonyl group, a carbonyl group, or a sulfinyl group, and more preferably a sulfonyl group. n2 represents 2 or 3, and preferably 2.

In the present invention, more preferable compound among the compounds represented by formulae (1a) to (1c) is a compound represented by formulae (1a) or (1b), and particularly preferable is a compound represented by formula (1b).

Halogeno compounds represented by formulae (1a) to (1c) may comprise a ballasted group, wherein the ballasted group means a substituent having a size equivalent to 8 or more carbon atoms in total, preferably 8 to 100 carbon atoms, more preferably 8 to 60 carbon atoms, and further more preferably 10 to 40 carbon atoms. Preferable ballasted group include an aliphatic hydrocarbon group (for example, an alkyl group, an alkenyl group, an alkinyl group and etc), an aryl group, a heterocyclic group, or combination of these groups with an ether group, a thioether group, a carbonyl group, an amino group, a sulfonyl group, a phosphonyl group or the like. The ballasted group may be a polymer. Practical examples of ballasted group are described, for example, in Reseach Disclosure, 1995/2, 37938, pages 82 to 89, JP-A Nos. 1-280747, and 1-283548, and the like. The preferable ballasted group has 7 to 50 carbon atoms in total, and more preferable ballasted group has 10 to 30 carbon atoms in total. The ballasted group may be added as a substituent represented by $R_1$, $R_2$ and $R_3$ in —N($R_1$)— and —($R_2$)C═C($R_3$)— represented by $Y_1$ or $Y_2$ in formulae (1a) to (1c), or as an aliphatic group represented by R, or as a substituent represented by $X_1$, $X_2$, and $X_3$.

Specific examples of the compound represented by formulae (1a) to (1c) are described below. However, the present invention is not limited thereto.

1a-1

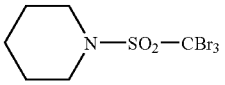

-continued
1a-2
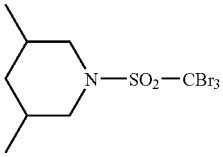
1a-3
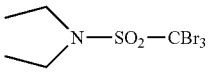
1a-4
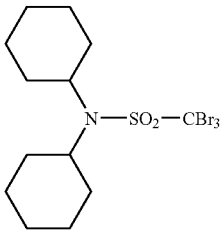
1a-5
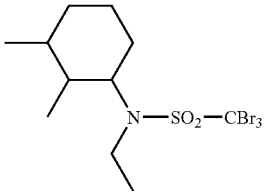
1a-6
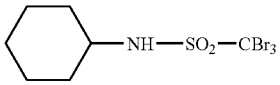
1a-7
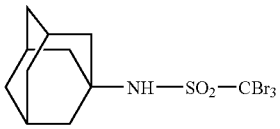
1a-8
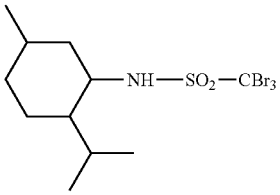
1a-9
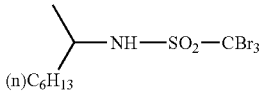
1a-10
$(n)C_7H_{15}—CH_2—NH—SO_2—CBr_3$
1a-11
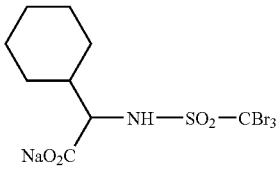
1a-12
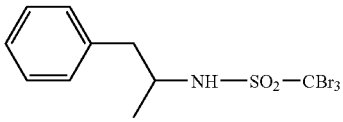
-continued
1a-13
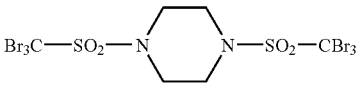
1a-14
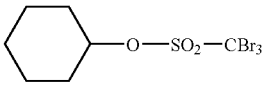
1a-15
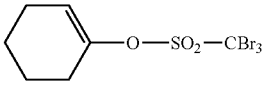
1a-16
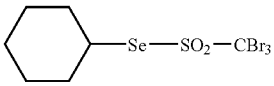
1a-17
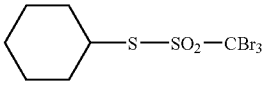
1a-18
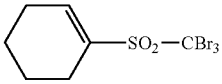
1a-19
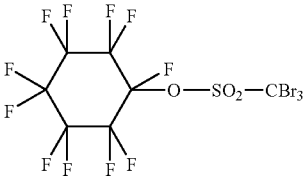
1a-20
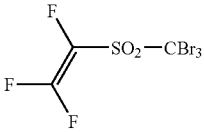
1a-21
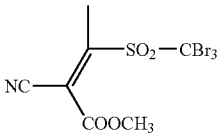
1a-22
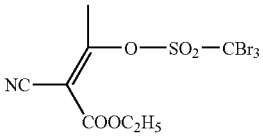
1a-23
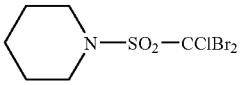
1a-24
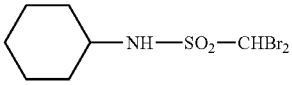

-continued
1a-25
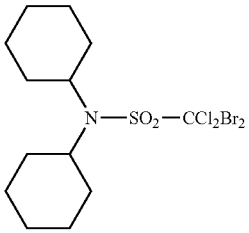
1a-26
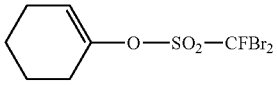
1a-27
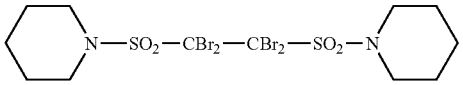
1a-28
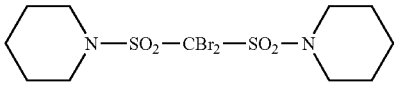
1a-29
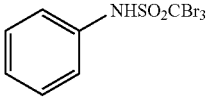
1a-30
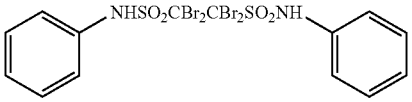
1a-31
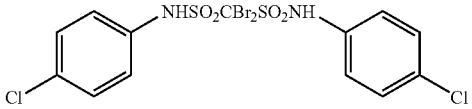
1a-32
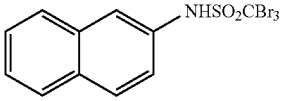
1a-33
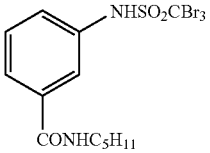
1a-34
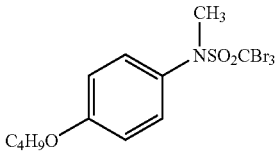
1a-35
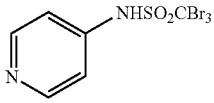
1a-36
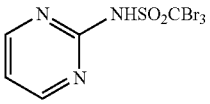
-continued
1a-37
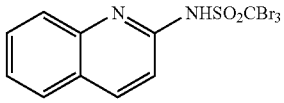
1a-38
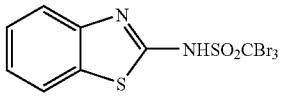
1b-1
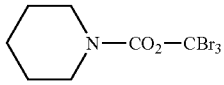
1b-2
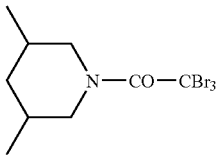
1b-3
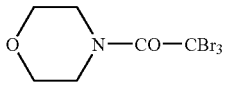
1b-4
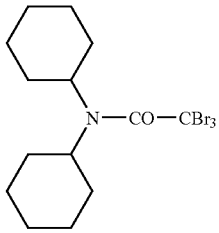
1b-5
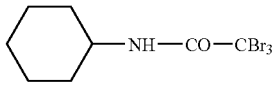
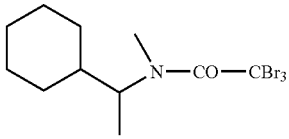
1b-7
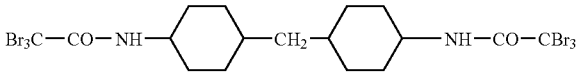
1b-8
1b-9
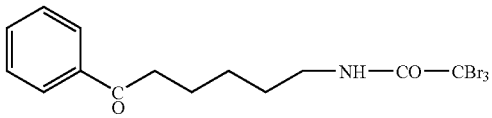
1b-10
1b-11
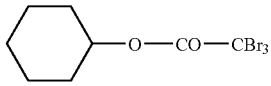
1b-12
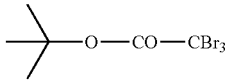

-continued
1b-13
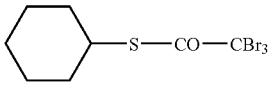
1b-14
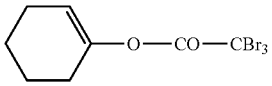
1b-15
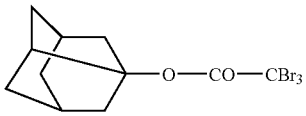
1b-16
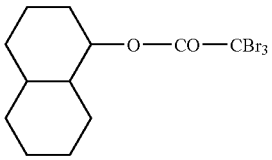
1b-17
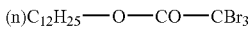
1b-18
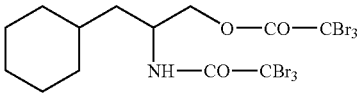
1b-19
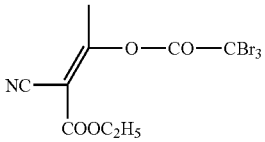
1b-20
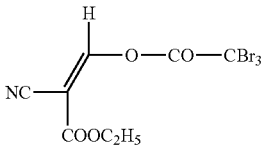
1b-21
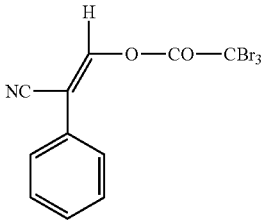
1b-22
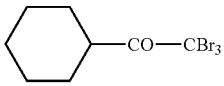
1b-23
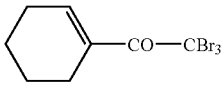
1b-24
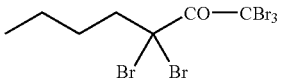
1b-25
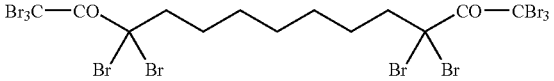
-continued
1b-26
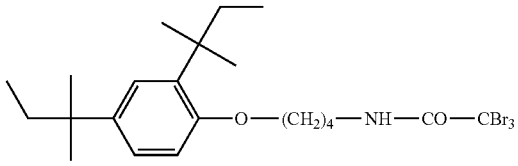
1b-27
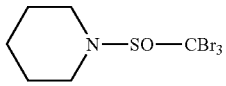
1b-28
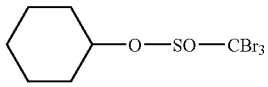
1b-29
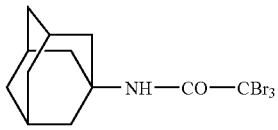
1b-30
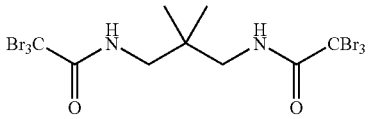
1b-31
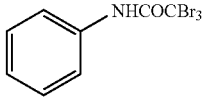
1b-32
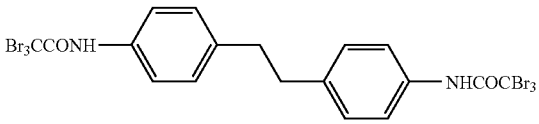
1b-33
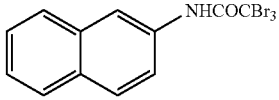
1b-34
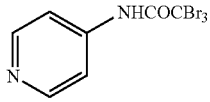
1b-35
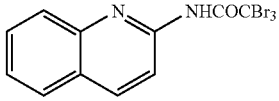
1b-36
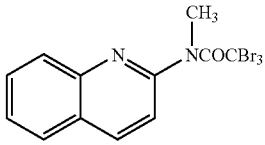
1b-37
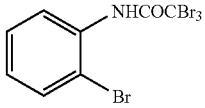

-continued 1b-38

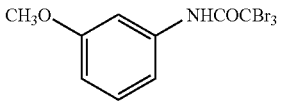

1b-39

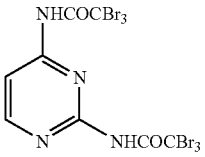

1b-40

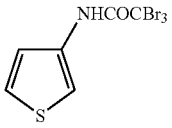

1c-1

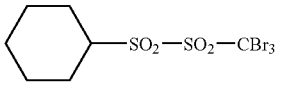

1c-2

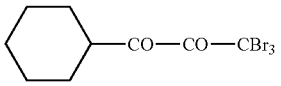

1c-3

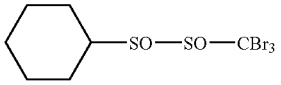

1c-4

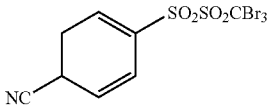

1c-5

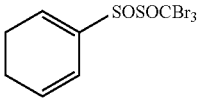

1c-6

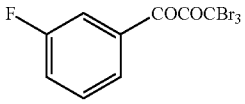

1c-7

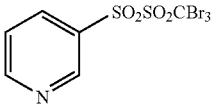

The compound represented by formula (1a), (1b) or (1c) is preferably used in the range from $10^{-4}$ mol to 1 mol, more preferably from $10^{-3}$ mol to 0.5 mol , and still more preferably from $1\times10^{-2}$ mol to 0.2 mol, per 1 mol of non-photosensitive silver salt in the image forming layer.

In the invention, a method of incorporating the compound represented by formulae (1a) to (1c) into a photothermographic material is described in a method of incorporating a reducing agent described above. Regarding the organic polyhalogen compound, it is preferably added in the form of solid fine particle dispersion.

(Development Accelerator)

In the photothermographic material of the invention, sulfoneamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphthalic compounds represented by formula (2) described in the specification of JP-A No. 2001-264929 are used preferably as a development accelerator. Further, it is also preferred to use as a development accelerator a phenolic compound described in the specifications of JP-A Nos. 2002-311533 and 2002-341484. Particularly, naphtholic compound described in the specification of JP-A No. 2003-66558 is preferred. The development accelerator described above is used in the range from 0.1 mol % to 20 mol %, preferably, from 0.5 mol % to 10 mol % and, more preferably, from 1 mol % to 5 mol % with respect to the reducing agent. The introducing methods to the photothermographic material can include, similar methods to those for the reducing agent and, it is particularly preferred to add as a solid dispersion or an emulsion dispersion. In the case of adding as an emulsion dispersion, it is preferred to add as an emulsion dispersion dispersed by using a high boiling solvent which is solid at an ordinary temperature and an auxiliary solvent at a low boiling point, or to add as a so-called oilless emulsion dispersion not using the high boiling solvent.

In the present invention, it is more preferred to use as a development accelerator, hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (AC-1) and (AC-2).

$$Q_1—NHNH—Q_2 \qquad \text{Formula (AC-1)}$$

(wherein, $Q_1$ represents an aromatic group or a heterocyclic group coupling at a carbon atom to —NHNH—$Q_2$ and $Q_2$ represents a carbamoyl group, an acyl group, an alkoxycarbonyl group, an aryloxycarbonyl group, a sulfonyl group or a sulfamoyl group).

In formula (AC-1), the aromatic group or the heterocyclic group represented by $Q_1$ is, preferably, 5 to 7 membered unsaturated ring. Preferred examples are benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring, thiophene ring, and the like. Condensed ring in which the rings described above are condensed to each other is also preferred.

The rings described above may have substituents and in a case where they have two or more substituents, the substituents may be identical or different with each other. Examples of the substituents can include halogen atom, alkyl group, aryl group, carboamide group, alkylsulfoneamide group, arylsulfonamide group, alkoxy group, aryloxy group, alkylthio group, arylthio group, carbamoyl group, sulfamoyl group, cyano group, alkylsulfonyl group, arylsulfonyl group, alkoxycarbonyl group, aryloxycarbonyl group and acyl group. In a case where the substituents are groups capable of substitution, they may have further substituents and examples of preferred substituents can include halogen atom, alkyl group, aryl group, carbonamide group, alkylsulfoneamide group, arylsulfoneamide group, alkoxy group, aryloxy group, alkylthio group, arylthio group, acyl group, alkoxycarbonyl group, aryloxycarbonyl group, carbamoyl group, cyano group, sulfamoyl group, alkylsulfonyl group, arylsulfonyl group and acyloxy group.

The carbamoyl group represented by $Q_2$ is a carbamoyl group preferably having 1 to 50 carbon atoms and, more preferably, having 6 to 40 carbon atoms, and examples can include not-substituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-( 2,4-tert-pentylphenoxy)propyl}carbamoyl, N-(2-hexyldecyl) carbamoyl, N-phenylcarbamoyl, N-(4-dodecyloxyphenyl) carbamoyl, N-(2-chloro-5-dodecyloxycarbonylphenyl) carbamoyl, N-naphthylcarbaoyl, N-3-pyridylcarbamoyl and N-benzylcarbamoyl.

The acyl group represented by $Q_2$ is an acyl group, preferably, having 1 to 50 carbon atoms and, more preferably, 6 to 40 carbon atoms and can include, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. Alkoxycarbonyl group represented by $Q_2$ is an alkoxycarbonyl group, preferably, of 2 to 50 carbon atom and, more preferably, of 6 to 40 carbon atoms and can include, for example, methoxycarbonyl, ethoxycarbonyl, isobutyloxycarbonyl, cyclehexyloxycarbonyl, dodecyloxycarbonyl and benzyloxycarbonyl.

The aryloxy carbonyl group represented by $Q_2$ is an aryloxycarbonyl group, preferably, having 7 to 50 carbon atoms and, more preferably, having 7 to 40 carbon atoms and can include, for example, phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group, preferably having 1 to 50 carbon atoms and, more preferably, having 6 to 40 carbon atoms and can include, for example, methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is sulfamoyl group, preferably having 0 to 50 carbon atoms, more preferably, 6 to 40 carbon atoms and can include, for example, not-substituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5 to 7-membered unsaturated ring represented by $Q_1$ at the position capable of substitution. In a case where the group has two or more substituents, such substituents may be identical or different with each other.

Next, preferred range for the compound represented by formula (AC-1) is to be described. 5 to 6 membered unsaturated ring is preferred for $Q_1$, and benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thioazole ring, oxazole ring, isothiazole ring, isooxazole ring and a ring in which the ring described above is condensed with a benzene ring or unsaturated hetero ring are further preferred. Further, $Q_2$ is preferably a carbamoyl group and, particularly, a carbamoyl group having hydrogen atom on the nitrogen atom is particularly preferred.

Formula (AC-2)

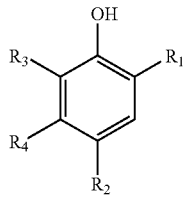

In formula (AC-2), $R_1$ represents an alkyl group, an acyl group, an acylamino group, a sulfoneamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$, $R_4$ each represents a group capable of substituting for a hydrpgen atom on a benzene ring which is mentioned as the example of the substituent for formula (AC-1). $R_3$ and $R_4$ may link together to form a condensed ring.

$R_1$ is, preferably, an alkyl group having 1 to 20 carbon atoms (for example, methyl group, ethyl group, isopropyl group, butyl group, tert-octyl group, or cyclohexyl group), an acylamino group (for example, acetylamino group, benzoylamino group, methylureido group, or 4-cyanophenylureido group), a carbamoyl group (for example, n-butylcarbamoyl group, N,N-diethylcarbamoyl group, phenylcarbamoyl group, 2-chlorophenylcarbamoyl group, or 2,4-dichlorophenylcarbamoyl group), an acylamino group (including ureido group or urethane group) being more preferred. $R_2$ is, preferably, a halogen atom (more preferably, chlorine atom, bromine atom), an alkoxy group (for example, methoxy group, butoxy group, n-hexyloxy group, n-decyloxy group, cyclohexyloxy group or benzyloxy group), or an aryloxy group (phenoxy group or naphthoxy group).

$R_3$ preferably is a hydrogen atom, a halogen atom or an alkyl group having 1 to 20 carbon atoms, and most preferably a halogen atom. $R_4$ is preferably a hydrogen atom, alkyl group or an acylamino group, and more preferably an alkyl group or an acylamino group. Examples of the preferred substituent thereof are identical with those for $R_1$. In a case where $R_4$ is an acylamino group, $R_4$ may preferably link with $R_3$ to form a carbostyryl ring.

In a case where $R_3$ and $R_4$ in formula (AC-2) link together to form a condensed ring, a naphthalene ring is particularly preferred as the condensed ring. The same substituent as the example of the substituent referred to for formula (AC-1) may bond to the naphthalene ring. In the case where formula (AC-2) is a naphtholic compound, $R_1$ is preferably a carbamoyl group. Among them, benzoyl group is particularly preferred. $R_2$ is preferably an alkoxy group or an aryloxy group and, particularly preferably an alkoxy group.

Preferred specific examples for the development accelerator of the invention are described below. The invention is not restricted to them.

AC-1

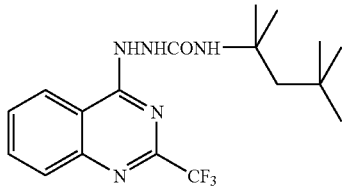

AC-2

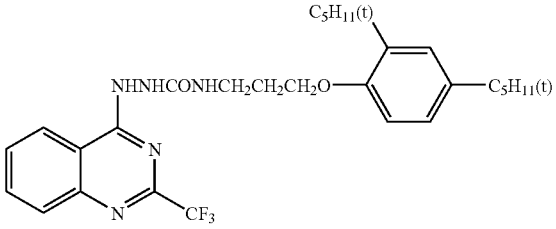

AC-3

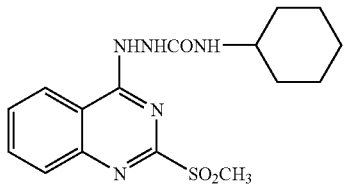

AC-4

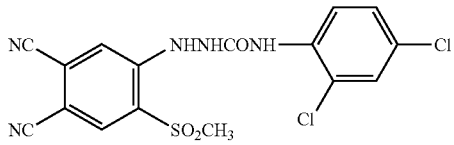

AC-5

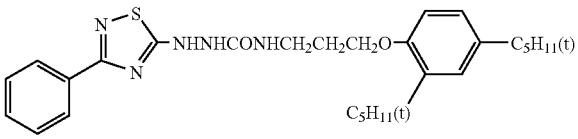

AC-6

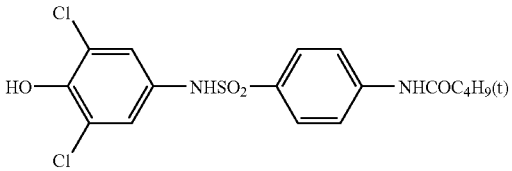

AC-7

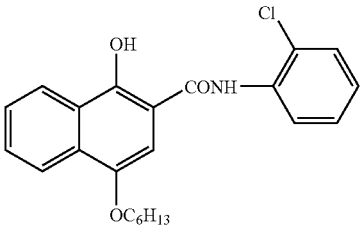

-continued

AC-8

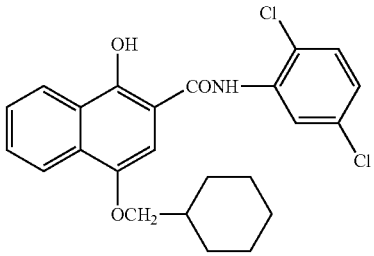

AC-9

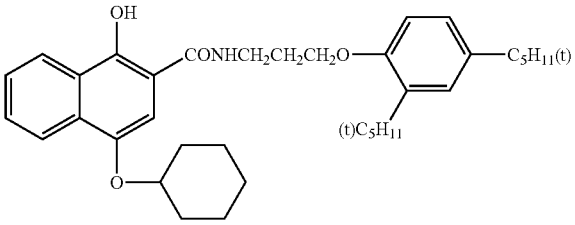

AC-10

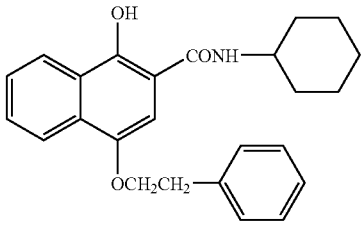

AC-11

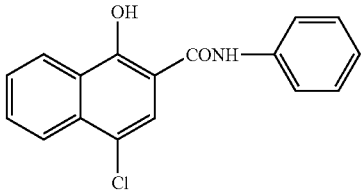

AC-12

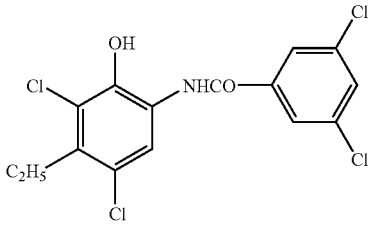

(Hydrogen Bonding Compound)

In the invention, in the case where the reducing agent has an aromatic hydroxy group (—OH) or an amino group (—NHR, R represents each one of hydrogen atom and alkyl group), particularly in the case where the reducing agent is a bisphenol described above, it is preferred to use in combination, a non-reducing compound having a group capable of reacting with these groups of the reducing agent, and that is also capable of forming a hydrogen bond therewith.

As a group forming a hydrogen bond with a hydroxyl group or an amino group, there can be mentioned a phosphoryl group, a sulfoxido group, a sulfonyl group, a carbonyl group, an amido group, an ester group, an urethane group, an ureido group, a tertiary amino group, a nitrogen-containing aromatic group, and the like. Particularly preferred among them is phosphoryl group, sulfoxido group, amido group (not having >N—H moiety but being blocked in the form of >N—Ra (where, Ra represents a substituent other than H)), urethane group (not having >N—H moiety but being blocked in the form of >N—Ra (where, Ra represents a substituent other than H) ), and ureido group (not having >N—H moiety but being blocked in the form of >N—Ra (where, Ra represents a substituent other than H)).

In the invention, particularly preferable as the hydrogen bonding compound is the compound expressed by formula (D) shown below.

Formula (D)

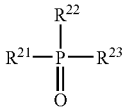

In formula (D), $R^{21}$ to $R^{23}$ each independently represent an alkyl group, an aryl group, an alkoxy group, an aryloxy group, an amino group, or a heterocyclic group, which may be substituted or not substituted.

In the case where $R^{21}$ to $R^{23}$ have a substituent, examples of the substituents include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., methyl group, ethyl group, isopropyl group, t-butyl group, t-octyl group, phenyl group, a 4-alkoxyphenyl group, a 4-acyloxyphenyl group, and the like.

Specific examples of an alkyl group expressed by $R^{21}$ to $R^{23}$ include methyl group, ethyl group, butyl group, octyl group, dodecyl group, isopropyl group, t-butyl group, t-amyl group, t-octyl group, cyclohexyl group, 1-methylcyclohexyl group, benzyl group, phenetyl group, 2-phenoxypropyl group, and the like.

As aryl groups, there can be mentioned phenyl group, cresyl group, xylyl group, naphthyl group, 4-t-butylphenyl group, 4-t-octylphenyl group, 4-anisidyl group, 3,5-dichlorophenyl group, and the like.

As alkoxyl groups, there can be mentioned methoxy group, ethoxy group, butoxy group, octyloxy group, 2-ethylhexyloxy group, 3,5,5-trimethylhexyloxy group, dodecyloxy group, cyclohexyloxy group, 4-methylcyclohexyloxy group, benzyloxy group, and the like.

As aryloxy groups, there can be mentioned phenoxy group, cresyloxy group, isopropylphenoxy group, 4-t-butylphenoxy group, naphthoxy group, biphenyloxy group, and the like.

As amino groups, there can be mentioned are dimethylamino group, diethylamino group, dibutylamino group, dioctylamino group, N-methyl-N-hexylamino group, dicyclohexylamino group, diphenylamino group, N-methyl-N-phenylamino, and the like.

Preferred as $R^{21}$ to $R^{23}$ are an alkyl group, an aryl group, an alkoxy group, and an aryloxy group. Concerning the effect of the invention, it is preferred that at least one or more of $R^{21}$ to $R^{23}$ are an alkyl group or an aryl group, and more preferably, two or more of them are an alkyl group or an aryl group. From the viewpoint of low cost availability, it is preferred that $R^{21}$ to $R^{23}$ are of the same group.

Specific examples of hydrogen bonding compounds represented by formula (D) of the invention and others are shown below, but it should be understood that the invention is not limited thereto.

D-1

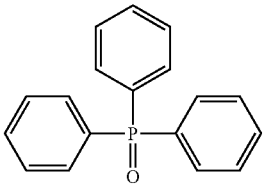

D-2

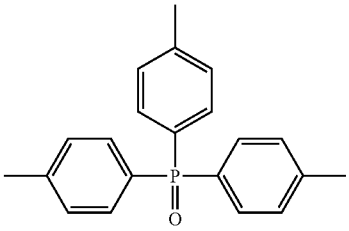

D-3

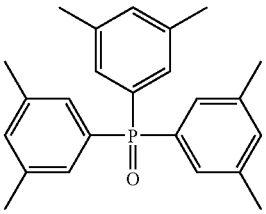

D-4

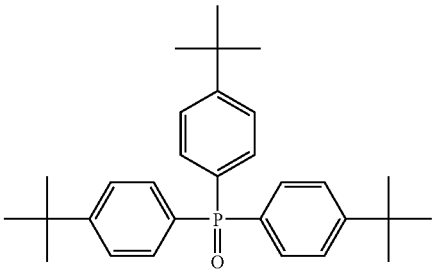

D-5

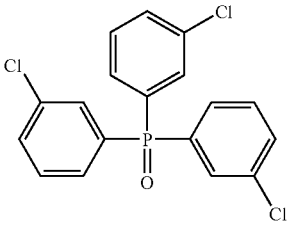

D-6

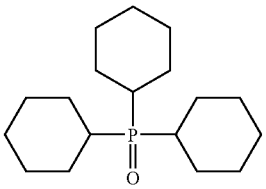

-continued

D-7

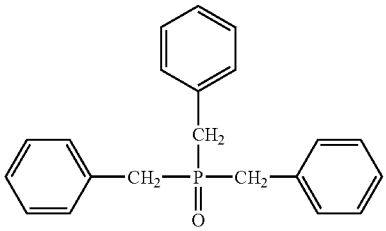

D-8

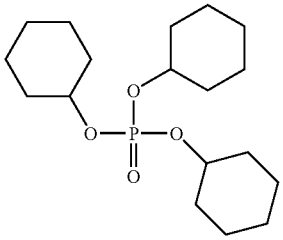

D-9

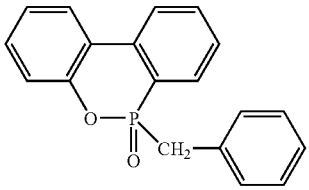

D-10

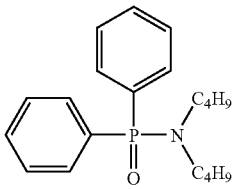

D-11

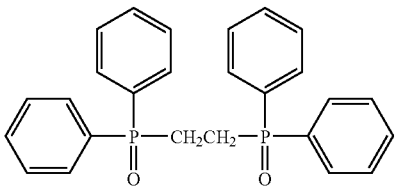

D-12

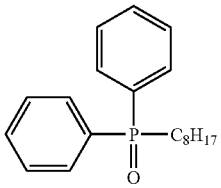

D-13

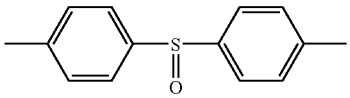

D-14

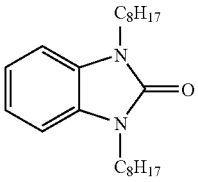

-continued

D-15

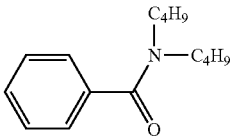

Specific examples of hydrogen bonding compounds other than those enumerated above can be found in those described in EP No. 1096310 and in JP-A Nos. 2002-156727 and 2002-318431.

The compound expressed by formula (D) used in the invention can be used in the photothermographic material by being incorporated into the coating solution in the form of solution, emulsion dispersion, or solid fine particle dispersion similar to the case of reducing agent, however, it is preferred to be used in the form of solid dispersion. In the solution, the compound expressed by formula (D) forms a hydrogen-bonded complex with a compound having a phenolic hydroxyl group or an amino group, and can be isolated as a complex in crystalline state depending on the combination of the reducing agent and the compound expressed by formula (D).

It is particularly preferred to use the crystal powder thus isolated in the form of solid fine particle dispersion, because it provides stable performance. Further, it is also preferred to use a method of leading to form complex during dispersion by mixing the reducing agent and the compound expressed by formula (D) in the form of powders and dispersing them with a proper dispersion agent using sand grinder mill or the like.

The compound expressed by formula (D) is preferably used in the range from 1 mol % to 200 mol %, more preferably from 10 mol % to 150 mol %, and further preferably, from 20 mol % to 100 mol %, with respect to the reducing agent.

(Silver Halide)

1) Halogen Composition

For the photosensitive silver halide used in the invention, there is no particular restriction on the halogen composition and silver chloride, silver bromochloride, silver bromide, silver iodobromide, silver iodochlorobromide and silver iodide can be used. Among them, silver bromide, silver iodobromide and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably, 0.01 μm to 0.15 μm and, further preferably, 0.02 μm to 0.12 μm. The grain size as used herein means an average diameter of a circle converted such that it has a same area as a projected area of the silver halide grain (projected area of a main plane in a case of a tabular grain).

4) Grain Shape

The shape of the silver halide grain can include, for example, cubic, octahedral, tabular, spherical, rod-like or potato-like shape. The cubic grain is particularly preferred in the invention. A silver halide grain rounded at corners can also be used preferably. While there is no particular restriction on the index of plane (Mirror's index) of an crystal surface of the photosensitive silver halide grain, it is preferred that the ratio of {100} face is higher, in which the spectral sensitizing efficiency is higher in a case of adsorption of a spectral sensitizing dye. The ratio is preferably 50% or more, more preferably, 65% or more, and further preferably, 80% or more. The ratio of the Mirror's index {100} face can be determined by the method of utilizing the adsorption dependency of {111} face and {100} face upon adsorption of a sensitizing dye described by T. Tani; in J. Imaging Sci., vol. 29, page 165 (1985).

5) Heavy Metal

The photosensitive silver halide grain of the invention can contain metals or complexes of metals belonging to groups 8 to 10 of the periodic table (showing groups 1 to 18). The metal or the center metal of the metal complex from groups 8 to 10 of the periodic table is preferably rhodium, ruthenium or iridium. The metal complex may be used alone, or two or more kinds of complexes comprising identical or different species of metals may be used together. A preferred content is in the range from $1\times10^{-9}$ mol to $1\times10^{-3}$ mol per one mol of silver. The heavy metals, metal complexes and the adding method thereof are described in JP-A No. 7-225449, in paragraph Nos. 0018 to 0024 of JP-A No.11-65021 and in paragraph Nos. 0227 to 0240 of JP-A No. 11-119374.

In the present invention, a silver halide grain having a hexacyano metal complex is present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra (n-butyl)ammonium ion), which are easily misible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters and amides) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of emulsion formation step prior to a chemical sensitization step, of conducting chalcogen sensitization such as sulfur sensitization, selenium sensitization and tellurium sensitization or noble metal sensitization such as gold sensitization, during washing step, during dispersion step and before chemical sensitization step. In order not to grow the fine silver halide grain, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just before completion of grain formation, it can be adsorbed to the outermost surface of the silver halide grain and most of them form an insoluble salt with silver ions on the surface of the grain. Since the hexacyano iron (II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No.11-84574, in paragraph Nos. 0025 to 0031 of JP-A No.11-65021, and paragraph Nos. 0242 to 0250 of JP-A No.11-119374.

6) Gelatin

As the gelatin contained the photosensitive silver halide emulsion used in the invention, various kinds of gelatins can be used. It is necessary to maintain an excellent dispersion state of a photosensitive silver halide emulsion in an organic silver salt containing coating solution, and gelatin having a molecular weight of 10,000 to 1,000,000 is preferably used. And phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those capable of spectrally sensitizing silver halide grains in a desired wavelength region upon adsorption to silver halide grains having spectral sensitivity suitable to spectral characteristic of an exposure light source can be selected advantageously. The sensitizing dyes and the adding method are disclosed, for example, JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP-A No. 0803764A1, and in JP-A Nos. 2001-272747, 2001-290238 and 2002-23306. The sensitizing dyes described above may be used alone or two or more of them may be used in combination. In the invention, sensitizing dye can be added preferably after desalting step and before coating step, and more preferably after desalting step and before the completion of chemical ripening.

In the invention, the sensitizing dye may be added at any amount according to the property of sensitivity and fogging, but it is preferably added from $10^{-6}$ mol to 1 mol, and more preferably from $10^{-4}$ mol to $10^{-1}$ mol, per 1 mol of silver halide in the image forming layer.

The photothermographic material of the invention may also contain super sensitizers in order to improve spectral sensitizing effect. The super sensitizers usable in the invention can include those compounds described in EP-A No. 587338, U.S. Pat. Nos. 3,877,943 and 4,873,184 and JP-A Nos. 5-341432, 11-109547, and 10-111543.

8) Chemical Sensitization

The photosensitive silver halide grain in the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formulae (II), (III), and (IV) in JP-A No. 5-313284 are more preferred.

The photosensitive silver halide grain in the invention is preferably chemically sensitized by gold sensitizing method alone or in combination with the chalcogen sensitization described above. As the gold sensitizer, those having a pxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization and (4) just before coating.

The amount of sulfur, selenium and tellurium sensitizer used in the invention may vary depending on the silver halide grain used, the chemical ripening condition and the like and it is used by about $10^{-8}$ mol to $10^{-2}$ mol, preferably, $10^{-7}$ mol to $10^{-3}$ mol per 1 mol of silver halide.

The addition amount of the gold sensitizer may vary depending on various conditions and it is generally about $10^{-7}$ mol to $10^{-3}$ mol and, more preferably, $10^{-6}$ mol to $5\times10^{-4}$ mol per 1 mol of silver halide.

There is no particular restriction on the condition for the chemical sensitization in the invention and, appropriately, pH is 5 to 8, pAg is 6 to 11 and temperature is at 40° C. to 95° C.

In the silver halide emulsion used in the invention, a thiosulfonic acid compound may be added by the method shown in EP-A No. 293917.

A reductive compound is used preferably for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion production process from crystal growth to the preparation step just before coating. Further, it is preferred to apply reduction sensitization by ripening while keeping pH to 7 or higher or pAg to 8.3 or lower for the emulsion, and it is also preferred to apply reduction sensitization by introducing a single addition portion of silver ions during grain formation.

9) Compound that can be One-electron-oxidized to Provide a One-electron Oxidation Product which Releases One or More Electrons The photothermographic material of the invention preferably contains a compound that can be one-electron-oxidized to provide a one-electron oxidation product which releases one or more electrons. The said compound can be used alone or in combination with various chemical sensitizers described above to increase the sensitivity of silver halide.

As the compound that can be one-electron-oxidized to provide a one-electron oxidation product which releases one or more electrons is a compound selected from the following Groups 1 and 2.

(Group 1) a compound that can be one-electron-oxidized to provide a one-electron oxidation product which further releases one or more electrons, due to being subjected to a subsequent bond cleavage reaction;

(Group 2) a compound that can be one-electron-oxidized to provide a one-electron oxidation product, which further releases one or more electrons after being subjected to a subsequent bond formation.

The compound of Group 1 will be explained below.

In the compound of Group 1, as for a compound that can be one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122) ; U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc. Preferred ranges of these compounds are the same as the preferred ranges described in the quoted specifications.

In the compound of Group 1, as for a compound that can be one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8), and the compound represented by formula (9) among the compounds which can undergo the chemical reaction represented by reaction formula (1). And the preferable range of these compounds is the same as the preferable range described in the quoted specification.

Formula (1)

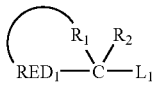

Formula (2)

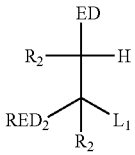

Formula (3)

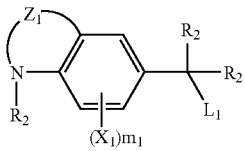

Formula (4)

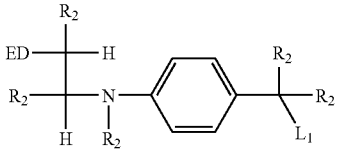

Formula (5)

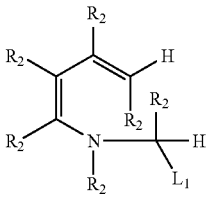

Formula (6)

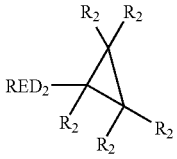

Formula (7)

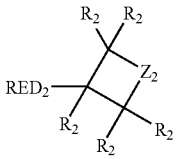

Formula (8)

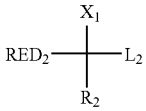

-continued

Formula (9)

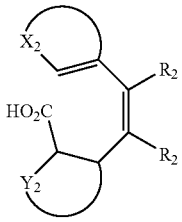

In the formula, $RED_1$ and $RED_2$ represent a reducible group. $R_1$ represents a nonmetallic atomic group forming a cyclic structure equivalent to a tetrahydro derivative or an octahydro derivative of a 5 or 6 membered aromatic ring (including a hetero aromatic ring) with a carbon atom (C) and $RED_1$. $R_2$ represents a hydrogen atom or a substituent. In the case where plural $R_2$ exist in the same molecule, these may be identical or different with each other. $L_1$ represents a leaving group. ED represents an electron-donating group. $Z_1$ represents an atomic group capable to form a 6 membered ring with a nitrogen atom and two carbon atoms of a benzene ring. $X_1$ represents a substituent, and $m_1$ represents an integral number of 0 to 3. $Z_2$ represents —$CR_{11}R_{12}$—, —$NR_{13}$—, or —O—. $R_{11}$ and $R_{12}$ each independently represent a hydrogen atom or a substituent. $R_{13}$ represents a hydrogen atom, an alkyl group, an aryl group or a heterocyclic group. $X_1$ represents an alkoxy group, an aryloxy group, a heterocyclic oxy group, an alkylthio group, an arylthio group, a heterocyclic thio group, an alkylamino group, an arylamino group or a heterocyclic amino group. $L_2$ represents a carboxyl group or a salt thereof, or a hydrogen atom. $X_2$ represents a group to form a 5 membered heterocycle with C═C. M represents a radical, a radical cation or a cation.

Next, the compound of Group 2 is explained.

In the compound of Group 2, as for a compound that can be one-electron-oxidized to provide a one-electron oxidation product which further releases one or more electrons, after being subjected to a subsequent bond cleavage reaction, specific examples can include the compound represented by formula (10) (same as formula (1) described in JP-A No.2003-140287), and the compound represented by formula (10) which can undergo the chemical reaction represented by reaction formula (1). The preferable range of these compounds is the same as the preferable range described in the quoted specification.

Formula (10)

$X—L_2—Y$

Reaction formula (1)

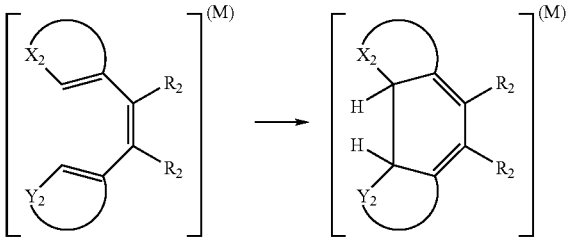

Reaction formula (1)

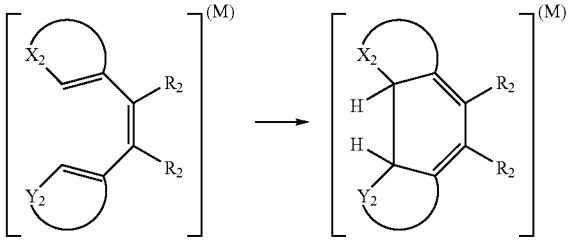

-continued

Formula (11)

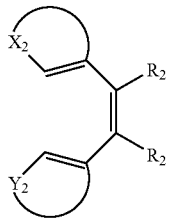

In the formula described above, X represents a reducible group which can be one-electron-oxidized. Y represents a reactive group containing a carbon-carbon double bond part, a carbon-carbon triple bond part, an aromatic group part or benzo-condensed nonaromatic heterocyclic group which can react with one-electron-oxidized product formed by one-electron-oxidation of X to form a new bond. $L_2$ represents a linking group to link X and Y. $R_2$ represents a hydrogen atom or a substituent. In the case where plural $R_2$ exist in a same molecule, these may be identical or different with each other. $X_2$ represents a group to form a 5 membered heterocycle with C═C. $Y_2$ represents a group to form a 5 or 6 membered aryl group or heterocyclic group with C═C. M represents a radical, a radical cation or a cation.

The compounds of Groups 1 and 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 and 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different with each other.

As preferable adsorptive group, a nitrogen containing heterocyclic group substituted by a mercapto group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group and the like) or a nitrogen containing heterocyclic group having —NH— group as a partial structure of heterocycle capable to form a silver imidate (>NAg) (e.g., a benzotriazole group, a benzimidazole group, an indazole group and the like) are described. A 5-mercaptotetrazole group, a 3-mercapto-1,2,4-triazole group and a benzotriazole group are particularly preferable and a 3-mercapto-1,2,4-triazole group and a 5-mercaptotetrazole group are most preferable.

As an adsorptive group, the group which has two or more mercapto groups as a partial structure in a molecule is also particularly preferable. Herein, a mercapto group (—SH) may become a thione group in the case where it can tautomerize. As preferred examples of adsorptive group having two or more mercapto groups as a partial structure (dimercapto-substituted nitrogen containing heterocyclic group and the like), a 2,4-dimercaptopyrimidine group, a 2,4-dimercaptotriazine group and a 3,5-dimercapto-1,2,4-triazole group are described.

Further, a quaternary salt structure of nitrogen or phosphor is also preferably used as an adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group and the like) and a nitrogen containing heterocyclic group containing quaternary nitrogen atom are described. As a quaternary salt structure of phosphor, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group and the like) are described. A quaternary salt structure of nitrogen is more preferably used and a 5 or 6 membered aromatic heterocyclic group containing a quaternary nitrogen atom is further preferably used. Particularly preferably, a pyrydinio group, a quinolinio group and an isoquinolinio group are used. These nitrogen containing heterocyclic groups containing a quaternary nitrogen atom may have any substituent.

As examples of counter anion of quaternary salt, halogen ion, carboxylate ion, sulfonate ion, sulfate ion, perchlorate ion, carbonate ion, nitrate ion, $BF_4^-$, $PF_6^-$, $Ph_4B^-$ and the like are described. In the case where the group having negative charge at carboxylate group and the like exists in a molecule, an inner salt may be formed with it. As a counter ion outside of a molecule, chloro ion, bromo ion and methanesulfonate ion are particularly preferable.

The preferred structure of the compound represented by Group 1 and 2 compound having a quaternary salt of nitrogen or phosphor as an adsorptive group is represented by formula (X).

$$(P—Q_1—)_i—R(—Q_2—S)_j \qquad \text{Formula (X)}$$

In formula (X), P and R each independently represent a quaternary salt structure of nitrogen or phosphor, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(═O)—, —$SO_2$—, —SO—, —P(═O)— and the group which consists of combination of these groups. Herein, $R_N$ represents a hydrogen atom, an alkyl group, an aryl group or a heterocyclic group. S represents a residue which is obtained by removing one atom from the compound represented by Group 1 or 2. i and j are an integral number of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms.

The compounds of Groups 1 and 2 may be used at any time during preparation of the photosensitive silver halide emulsion and production of the photothermographic material. For example, the compound may be used in a photosensitive silver halide grain formation step, in a desalting step, in a chemical sensitization step, and before coating, etc. The compound may be added in several times, during these steps. The compound is preferably added, after the photosensitive silver halide grain formation step and before the desalting step; in the chemical sensitization step (just before the chemical sensitization to immediately after the chemical sensitization); or before coating. The compound is more preferably added, just before the chemical sensitization step to before mixing with the non-photosensitive organic silver salt.

It is preferred that the compound of Groups 1 and 2 used in the invention is dissolved in water, a water-soluble solvent such as methanol and ethanol, or a mixed solvent thereof, to be added. In the case where the compound is dissolved in water and solubility of the compound is increased by increasing or decreasing a pH value of the solvent, the pH value may be increased or decreased to dissolve and add the compound.

The compound of Groups 1 and 2 used in the invention is preferably used to the image forming layer comprising the photosensitive silver halide and the non-photosensitive organic silver salt. The compound may be added to a surface protective layer, or an intermediate layer, as well as the image forming layer comprising the photosensitive silver halide and the non-photosensitive organic silver salt, to be diffused to the image forming layer in the coating step. The compound may be added before or after addition of a sensitizing dye. Each compound is contained in the image forming layer preferably in an amount of $1\times10^{-9}$ mol to $5\times10^{-1}$ mol, more preferably $1\times10^{-8}$ mol to $5\times10^{-2}$ mol, per 1 mol of silver halide.

10) Compound Having Adsorptive Group and Reducible Group

The photothermographic material of the present invention preferably comprises a compound having an adsorptive group and a reducible group in a molecule. It is preferred that the compound having an adsorptive group and a reducible group used in the invention is represented by the following formula (I).

A—(W)*n*-B Formula (I)

In formula (I), A represents a group capable of adsorption to a silver halide (hereafter, it is called an adsorptive group), W represents a divalent linking group, n represents 0 or 1, and B represents a reducible group.

In formula (I), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom and a tellurium atom, a sulfide group, a disulfide group, a cationic group, an ethynyl group and the like are described.

The mercapto group as an adsorptive group means a mercapto group (and a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or nonaromatic heterocyclic group having at least a 5 to 7 membered ring, e.g., an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group and the like are described. A heterocyclic group having a quaternary nitrogen atom may also be adopted, wherein a mercapto group as a substituent may dissociate to form a mesoion. As a counter ion, whereby a mercapto group forms a salt thereof, a cation such as an alkali metal, an alkali earth metal, a heavy metal and the like ($Li^+$, $Na^+$, $K^+$, $Mg^{2+}$, $Ag^+$, $Zn^{2+}$ and the like), an ammonium ion, a heterocyclic group comprising a quaternary nitrogen atom, a phosphonium ion and the like are described.

Further, the mercapto group as an adsorptive group may become a thione group by a tautomerization.

The thione group as an adsorptive group may also contain a chain or a cyclic thioamide group, a thioureido group, a thiouretane group or a dithiocarbamic acid ester group.

The heterocyclic group containing at least one atom selected from a nitrogen atom, a sulfur atom, a selenium atom and a tellurium atom represents a nitrogen atom containing heterocyclic group having —NH— group, as a partial structure of heterocycle, capable to form a silver iminate (>NAg) or a heterocyclic group, having —S— group, —Se— group, —Te— group or ═N— group as a partial structure of heterocycle, and capable to coordinate to a silver ion by a chelate bonding. As the former examples, a benzotriazole group, a triazole group, an indazole group, a pyrazole group, a tetrazole group, a benzimidazole group, a purine group and the like are described. As the latter examples, a thiophene group, a thiazole group, a benzoxazole group, a thiadiazole group, an oxadiazole group, a triazine group, a selenoazole group, a benzoselenazole group, a tellurazole group, a benzotellurazole group and the like are described.

The sulfide group or disulfide group as an adsorptive group contains all groups having "—S—" or "—S—S—" as a partial structure.

The cationic group as an adsorptive group means the group containing a quaternary nitrogen atom, such as an ammonio group or a nitrogen containing heterocyclic group containing a quaternary nitrogen atom. As examples of the heterocyclic group containing a quaternary nitrogen atom, a pyridinio group, a quinolinio group, an isoquinolinio group, an imidazolio group and the like are described.

The ethynyl group as an adsorptive group means —C≡CH group and the said hydrogen atom may be substituted.

The adsorptive group described above may have any substituent.

Further, as typical examples of an adsorptive group, the compounds described in pages 4 to 7 in the specification of JP-A No.11-95355 are described.

As an adsorptive group represented by A in formula (I), a heterocyclic group substituted by a mercapto group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group and the like) or a nitrogen atom containing heterocyclic group having a —NH— group capable to form an imino-silver (>NAg) as a partial structure of heterocycle (e.g., a benzotriazole group, a benzimidazole group, an indazole group and the like) is preferable, and more preferable as an adsorptive group is a 2-mercaptobenzimidazole group or a 3,5-dimercapto-1,2,4-triazole group.

In formula (I), W represents a divalent linking group. The said linking group may be any divalent linking group, as far as it does not give a bad effect toward a photographic property. For example, a divalent linking group, which includes a carbon atom, a hydrogen atom, an oxygen atom a nitrogen atom and a sulfur atom, can be used. As typical examples, an alkylene group having 1 to 20 carbon atoms (e.g., a methylene group, an ethylene group, a trimethylene group, a tetramethylene group, a hexamethylene group and the like), an alkenylene group having 2 to 20 carbon atoms, an alkinylene group having 2 to 20 carbon atoms, an arylene group having 6 to 20 carbon atoms (e.g., a phenylene group, a nephthylene group and the like), —CO—,—$SO_2$—, —O—, —S—, —$NR_1$—, and the combination of these linking groups are described. Herein, $R_1$ represents a hydrogen atom, an alkyl group, a heterocyclic group, or an aryl group.

The divalent linking group represented by W may have any substituent.

In formula (I), a reducible group represented by B represents the group capable to reduce a silver ion. As the examples, a formyl group, an amino group, a triple bonding group such as an acetylene group, a propargyl group and the like, a mercapto group, hydroxylamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols and polyphenols such as hydroquinones, catechols, resorcinols, benzenetriols, bisphenols are contained), aclhydrazines, carbamoylhydrazides and a residue which is obtained by removing one hydrogen atom from 3-pyrazolidones and the like can be described. They may have any substituent.

The oxidation potential of a reducible group represented by B in formula (I), can be measured by using the measuring method described in Akira Fujishima, "DENKIKAGAKU SOKUTEIHO", pages 150 to 208, GIHODO SHUPPAN and NIHON KAGAKUKAI, "ZIKKEN KAGAKUKOUZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the condition of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E1/2) can be calculated by that obtained voltamograph.

When a reducible group represented by B in the present invention is measured by the method described above, an oxidation potential preferably is in the range of about −0.3 V to about 1.0 V, more preferably about −0.1 V to about 0.8 V, and most preferably about 0 V to about 0.7 V.

In formula (I), a reducible group represented by B preferably is hydroxylamines, hydroxamic acids, hydroxyureas, hydroxysemicarbazides, reductones, phenols, acylhydrazines, carbamoylhydrazides, or a residue which is obtained by removing one hydrogen atom from 3-pyrazolidones and the like.

The compound of formula (I) in the present invention may have the ballasted group or polymer chain in it generally used in the nonmoving photographic additives as a coupler. And as a polymer, for example, the polymer described in JP-A No. 1-100530 can be described.

The compound of formula (I) in the present invention may be bis type or tris type. The molecular weight of the compound represented by formula (I) in the present invention is preferably 100 to 10,000 and more preferably 120 to 1,000 and particularly preferably 150 to 500.

The examples of the compound represented by formula (I) in the present invention are shown below, but the present invention is not limited in these.

(1)

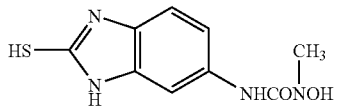

(2)

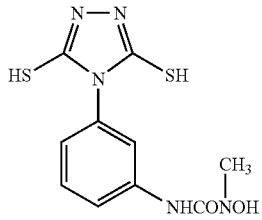

(3)

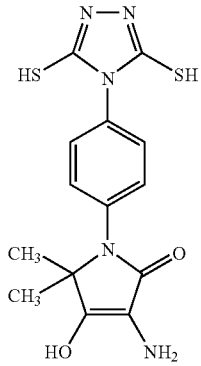

(4)

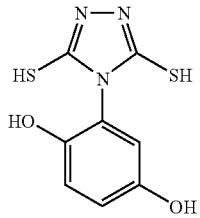

(5)

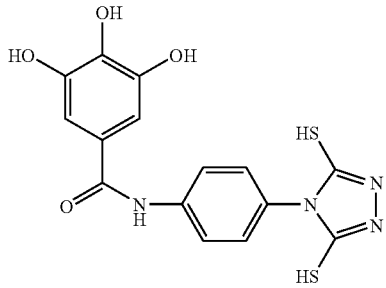

-continued (6)

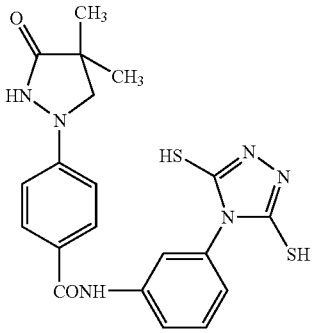

(7)

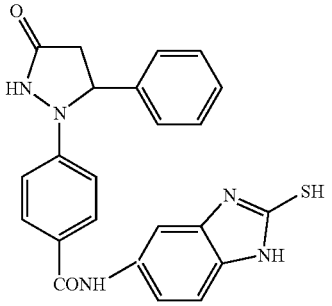

(8)

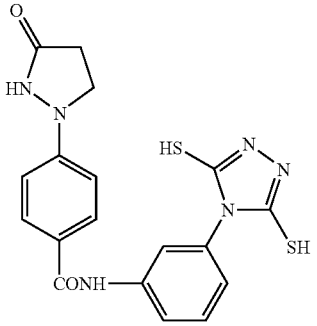

(9)

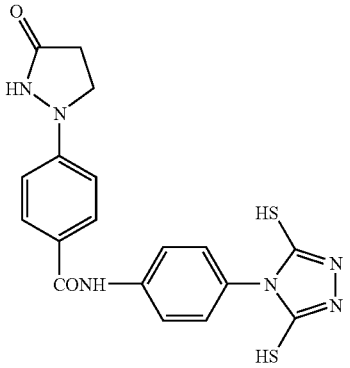

(10)

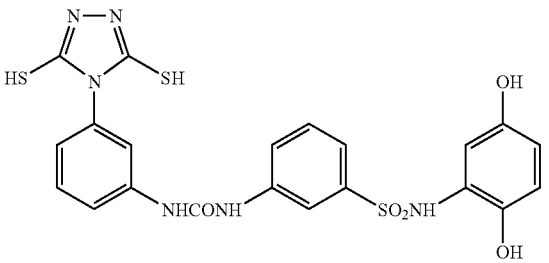

-continued (11)

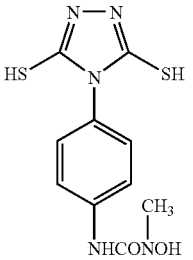

(12)

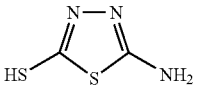

(13)

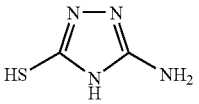

Further, example compounds 1 to 30 and 1"-1 to 1"-77 shown in EP No. 1308776A2, pages 73 to 87 are also described as preferable examples of the compound having an adsorptive group and a reducible group according to the invention.

These compounds can be easily synthesized by the known method. The compound of formula (I) in the present invention can be used alone as only one kind of the compound, but it is preferred to use two or more kinds of the compounds at the same time. When two or more kinds of the compounds are used in combination, those may be added to the same layer or the different layers, whereby adding methods may be different from each other.

The compound represented by formula (I) in the present invention preferably is added to an image forming layer and more preferably is to be added at an emulsion preparing process. In the case, wherein these compounds are added at an emulsion preparing process, these compounds may be added at any step in the process. For example, the silver halide grain formation step, a step before starting of desalting step, the desalting step, the step before chemical ripening, the chemical ripening step, the step before preparing a final emulsion and the like are described. Also, the addition can be performed in the plural divided times during the process. It is preferred to be added in the image forming layer, but also to be diffused at a coating step from a protective layer or an intermediate layer adjacent to the image forming layer, wherein these compounds are added in the protective layer or the intermediate layer in combination with their addition to the image forming layer.

The preferred addition amount is largely depend on the adding method described above or the kind of the compound, but is generally in the range of $1\times10^{-6}$ mol to 1 mol, preferably $1\times10^{-5}$ mol to $5\times10^{-1}$ mol, and more preferably $1\times10^{-4}$ mol to $1\times10^{-1}$ mol, per 1 mol of photosensitive silver halide.

The compound represented by formula (I) in the present invention can be added by dissolving in water or water-soluble solvent such as methanol, ethanol and the like or a mixed solution thereof. At this time, pH may be arranged suitably by an acid or an alkaline and a surfactant can be coexisted. Further, these compounds may be added as an emulsified dispersion by dissolving them in an organic solvent having a high boiling point and also may be added as a solid dispersion.

11) Combined Use of a Plurality of Silver Halides

The photosensitive silver halide emulsion in the photothermographic material used in the invention may be used alone as one kind, or two or more kinds of them (for example, those of different average grain sizes, different halogen compositions, of different crystal habits and of different conditions for chemical sensitization) may be used together. Gradation can be controlled by using plural kinds of photosensitive silver halide of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably, from 0.05 $g/m^2$ to 0.4 $g/m^2$ and, further preferably, from 0.07 $g/m^2$ to 0.3 $g/m^2$. The photosensitive silver halide is used in the range from 0.01 mol to 0.5 mol, preferably, from 0.02 mol to 0.3 mol, and further preferably from 0.03 mol to 0.2 mol, per 1 mol of the organic silver salt.

13) Mixing Silver Halide and Organic Silver Salt

The method of mixing the silver halide and the organic silver salt can include a method of mixing a separately prepared photosensitive silver halide and an organic silver salt by a high speed stirrer, ball mill, sand mill, colloid mill, vibration mill, or homogenizer, or a method of mixing a photosensitive silver halide completed for preparation at any timing in the preparation of an organic silver salt and preparing the organic silver salt. The effect of the invention can be obtained preferably by any of the methods described above. Further, a method of mixing two or more kinds of aqueous dispersions of organic silver salts and two or more kinds of aqueous dispersions of photosensitive silver salts upon mixing is used preferably for controlling the photographic properties.

14) Mixing Silver Halide into Coating Solution

In the invention, the time of adding silver halide to the coating solution for the image forming layer is preferably in the range from 180 minutes before to just prior to the coating, more preferably, 60 minutes before to 10 seconds before coating. But there is no restriction for mixing method and mixing condition as far as the effect of the invention appears sufficient. As an embodiment of a mixing method, there is a method of mixing in the tank controlling the average residence time to be desired. The average residence time herein is calculated from addition flux and the amount of solution transferred to the coater. And another embodiment of mixing method is a method using a static mixer, which is described in 8th edition of "Ekitai kongou gijutu" by N. Harnby and M. F. Edwards, translated by. Kouji Takahashi (Nikkankougyou shinbunsya, 1989).

(Binder)

Any type of polymer may be used as the binder for the layer containing organic silver salt in the photothermographic material of the invention. Suitable as the binder are those that are transparent or translucent, and that are generally colorless, such as natural resin or polymer and their copolymers; synthetic resin or polymer and their copolymer; or media forming a film; for example, included are gelatin, rubber, poly(vinyl alcohol), hydroxyethyl cellulose, cellulose acetate, cellulose acetate butyrate, poly(vinyl pyrrolidone), casein, starch, poly(acrylic acid), poly(methylmethacrylic acid), poly(vinyl chloride), poly(methacrylic acid), styrene-maleic anhydride copolymers, styrene-acrylonitrile copolymers, styrene-butadiene copolymers, poly(vinyl acetal)(e.g., poly(vinyl formal) and poly(vinyl butyral)), poly(ester), poly(urethane), phenoxy resin, poly(vinylidene chloride), poly(epoxide), poly(carbonate), poly(vinyl acetate), poly(olefin), cellulose esters, and poly(amide). A binder may be used with water, an organic solvent or emulsion to form a coating solution.

In the invention, the glass transition temperature (Tg) of the binder of the image forming layer is preferably from 0° C. to 80° C., more preferably, from 10° C. to 70° C., and further preferably, from 15° C. to 60° C.

In the specification, Tg is calculated according to the following equation.

$$1/Tg=\Sigma(Xi/Tgi)$$

Where, the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The polymer used for the binder maybe of two or more kinds of polymers, if necessary. And, the polymer having Tg of 20° C. or more and the polymer having Tg of less than 20° C. can be used in combination. In a case where two or more kinds of polymers differing in Tg may be blended for use, it is preferred that the weight-average Tg is in the range mentioned above.

In the invention, it is preferred that the image forming layer is formed by first applying a coating solution containing 30% by weight or more of water in the solvent and by then drying.

In the case where the image forming layer is formed by first applying a coating solution containing 30% by weight or more of water in the solvent and by then drying, and furthermore, in the case where the binder of the image forming layer is soluble or dispersible in an aqueous solvent (water solvent), the performance can be ameliorated particularly in the case a polymer latex having an equilibrium water content of 2% by weight or lower under 25° C. and 60% RH is used. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-admixing organic solvent. As water-admixing organic solvents, there can be mentioned, for example, alcohols such as methyl alcohol, ethyl alcohol, propyl alcohol, and the like; cellosolves such as methyl cellosolve, ethyl cellosolve, butyl cellosolve, and the like; ethyl acetate, dimethylformamide, and the like.

The term aqueous solvent is also used in the case the polymer is not thermodynamically dissolved, but is present in a so-called dispersed state.

The term "equilibrium water content under 25° C. and 60% RH" as referred herein can be expressed as follows:

$$\text{Equilibrium water content under 25° C. and 60\% RH}=[(W1-W0)/W0]\times 100 \text{ (\% by weight)}$$

wherein, W1 is the weight of the polymer in moisture-controlled equilibrium under the atmosphere of 25° C. and 60% RH, and W0 is the absolutely dried weight at 25° C. of the polymer.

For the definition and the method of measurement for water content, reference can be made to Polymer Engineering Series 14, "Testing methods for polymeric materials" (The Society of Polymer Science, Japan, published by Chijin Shokan).

The equilibrium water content under 25° C. and 60% RH is preferably 2% by weight or lower, but is more preferably, 0.01% by weight to 1.5% by weight, and is most preferably, 0.02% by weight to 1% by weight.

The binders used in the invention are, particularly preferably, polymers capable of being dispersed in aqueous solvent. Examples of dispersed states may include a latex, in which water-insoluble fine particles of hydrophobic polymer are dispersed, and such in which polymer molecules are dispersed in molecular states or by forming micelles, but preferred are latex-dispersed particles. The mean particle size of the dispersed particles is in the range from 1 nm to 50,000 nm, preferably 5 nm to 1,000 nm, more preferably 10 nm to 500 nm, and further preferably 50 nm to 200 nm. There is no particular limitation concerning particle size distribution of the dispersed particles, and may be widely distributed or may exhibit a monodisperse particle size distribution. From the viewpoint of controlling the physical properties of the coating solution, preferred mode of usage includes mixing two or more types of particles each having monodisperse particle distribution.

In the invention, preferred embodiment of the polymers capable of being dispersed in aqueous solvent includes hydrophobic polymers such as acrylic polymers, poly(ester), rubber (e.g., SBR resin), poly(urethane), poly(vinyl chloride), poly(vinyl acetate), poly(vinylidene chloride), poly (olefin), and the like. As the polymers above, usable are straight chain polymers, branched polymers, or crosslinked polymers; also usable are the so-called homopolymers in which single monomer is polymerized, or copolymers in which two or more types of monomers are polymerized. In the case of a copolymer, it may be a random copolymer or a block copolymer. The molecular weight of these polymers is, in number average molecular weight, in the range from 5,000 to 1,000,000, preferably from 10,000 to 200,000. Those having too small molecular weight exhibit insufficient mechanical strength on forming the image forming layer, and those having too large molecular weight are also not preferred because the filming properties result poor. Further, crosslinking polymer latexes are particularly preferred for use.

<Examples of Latex>

Specific examples of preferred polymer latex are given below, which are expressed by the starting monomers with % by weight given in parenthesis. The molecular weight is given in number average molecular weight. In the case polyfunctional monomer is used, the concept of molecular weight is not applicable because they build a crosslinked structure. Hence, they are denoted as "crosslinking", and the molecular weight is omitted. Tg represents glass transition temperature.

P-1; Latex of -MMA(70)-EA(27)-MAA(3)-(molecular weight 37000, Tg 61° C.)

P-2; Latex of -MMA(70)-2EHA(20)-St(5)-AA(5)-(molecular weight 40000, Tg 59 ° C.)

P-3; Latex of -St(50)-Bu(47)-MAA(3)-(crosslinking, Tg -17° C.)

P-4; Latex of -St(68)-Bu(29)-AA(3)-(crosslinking, Tg 17° C.)

P-5; Latex of -St(71) -Bu(26)-AA(3)-(crosslinking, Tg 24° C.)

P-6; Latex of -St(70)-Bu(27)-IA(3)-(crosslinking)

P-7; Latex of -St(75) -Bu(24)-AA(1)-(crosslinking, Tg 29° C.)

P-8; Latex of -St(60)-Bu(35)-DVB(3)-MAA(2)-(crosslinking)

P-9; Latex of -St(70)-Bu(25)-DVB(2)-AA(3)-(crosslinking)

P-10; Latex of -VC(50)-MMA(20)-EA(20)-AN(5)-AA (5)-(molecular weight 80000)

P-11; Latex of -VDC(85)-MMA(5)-EA(5)-MAA(5)-(molecular weight 67000)

P-12; Latex of -Et(90)-MAA(10)-(molecular weight 12000)

P-13; Latex of -St(70)-2EHA(27)-AA(3)-(molecular weight 130000, Tg 43° C.)

P-14; Latex of -MMA(63)-EA(35)-AA(2)-(molecular weight 33000, Tg 47° C.)

P-15; Latex of -St(70.5)-Bu(26.5)-AA(3)-(crosslinking, Tg 23° C.)

P-16; Latex of -St(69.5)-Bu(27.5)-AA(3)-(crosslinking, Tg 20.5° C.)

In the structures above, abbreviations represent monomers as follows. MMA: methyl metacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of poly(ester), there can be mentioned FINETEX ES650, 611, 675, and 850 (all manufactured by Dainippon Ink and Chemicals, Inc.), WD-size and WMS (all manufactured by Eastman Chemical Co.), and the like; as examples of poly (urethane), there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride) , there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of poly(olefin), there can be mentioned Chemipearl S120 and SA100 (all manufactured by Mitsui Petrochemical Industries, Ltd.), and the like.

The polymer latexes above may be used alone, or may be used by blending two or more types depending on needs.

<Preferable Latex>

Particularly preferable as the polymer latex for use in the invention is that of styrene-butadiene copolymer. The weight ratio of monomer unit for styrene to that of butadiene constituting the styrene-butadiene copolymer is preferably in the range from 40:60 to 95:5. Further, the monomer unit of styrene and that of butadiene preferably account for 60% by weight to 99% by weight with respect to the copolymer. Moreover, the polymer latex of the invention contains acrylic acid or methacrylic acid, preferably, in the range from 1% by weight to 6% by weight, and more preferably, from 2% by weight to 5% by weight, with respect to the total weight of the monomer unit of styrene and that of butadiene. The preferred range of the molecular weight is similar to that described above.

As the latex of styrene-butadiene copolymer preferably used in the invention, there can be mentioned P-3 to P-8 and P-15, or commercially available LACSTAR-3307B, 7132C, Nipol Lx416, and the like.

In the image forming layer of the photothermographic material according to the invention, if necessary, there can be added hydrophilic polymers such as gelatin, polyvinyl alcohol, methyl cellulose, hydroxypropyl cellulose, carboxymethyl cellulose, and the like. The hydrophilic polymers above are added at an amount of 30% by weight or less, preferably 20% by weight or less, with respect to the total weight of the binder incorporated in the image forming layer.

According to the invention, the layer containing organic silver salt (image forming layer) is preferably formed by using polymer latex for the binder. According to the amount of the binder for the image forming layer, the weight ratio for total binder to organic silver salt (total binder/organic silver salt) is preferably in the range of 1/10 to 10/1, more preferably 1/3 to 5/1, and further preferably 1/1 to 3/1.

The layer containing organic silver salt is, in general, a photosensitive layer (image forming layer) containing a photosensitive silver halide, i.e., the photosensitive silver salt; in such a case, the weight ratio for total binder to silver halide (total binder/silver halide) is in the range from 400 to 5, more preferably, from 200 to 10.

The total amount of binder in the image forming layer of the invention is preferably in the range from 0.2 $g/m^2$ to 30 $g/m^2$, more preferably from 1 $g/m^2$ to 15 $g/m^2$, and further preferably from 2 $g/m^2$ to 10 $g/m^2$. As for the image forming layer of the invention, there may be added a crosslinking agent for crosslinking, a surfactant, or the like to improve coating properties.

<Preferable Solvent for Coating Solution>

In the invention, a solvent of a coating solution for the image forming layer (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or more and still more preferably 70% by weight or more. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there can be mentioned those disclosed as patents in paragraph number 0070 of JP-A No. 10-62899 and in line 57 of page 20 to line 7 of page 21 of EP-A No. 0803764A1, the compounds described in JP-A Nos. 9-281637 and 9-329864, in U.S. Pat. No. 6,083,681, and in EP No. 1048975.

As other antifoggants, there can be mentioned a mercury (II) salt described in paragraph number 0113 of JP-A No. 11-65021, benzoic acids described in paragraph number 0114 of the same literature, a salicylic acid derivative described in JP-A No. 2000-206642, a formaline scavenger compound expressed by formula (S) in JP-A No. 2000-221634, a triazine compound related to claim 9 of JP-A No. 11-352624, a compound expressed by general formula (III), 4-hydroxy-6-methyl-1,3,3a, 7-tetrazaindene and the like, as described in JP-A No. 6-11791.

The photothermographic material of the invention may further contain an azolium salt in order to prevent fogging. As azolium salts, there can be mentioned a compound expressed by formula (XI) as described in JP-A No. 59-193447, a compound described in JP-B No. 55-12581, and a compound expressed by formula (II) in JP-A No. 60-153039. The azolium salt may be added to any part of the photothermographic material, but as the addition layer, preferred is to select a layer on the side having thereon the image forming layer, and more preferred is to add to the image forming layer. The azolium salt may be added at any time of the process of preparing the coating solution; in the case where the azolium salt is added into the image forming layer, any time of the process may be selected from the preparation of the organic silver salt to the preparation of the coating solution, but preferred is to add the salt after preparing the organic silver salt and just before coating. As the method for adding the azolium salt, any method using a powder, a solution, a fine-particle dispersion, and the like, may be used. Furthermore, it may be added as a solution having mixed therein other additives such as sensitizing dyes, reducing agents, toners, and the like. In the invention, the azolium salt may be added at any amount, but preferably, it is added in a range from $1\times10^{-6}$ mol to 2 mol, and more preferably, from $1\times10^{-3}$ mol to 0.5 mol per 1 mol of silver.

(Other Additives)

1) Mercapto Compounds, Disulfides and Thiones

In the invention, mercapto compounds, disulfide compounds, and thione compounds may be added in order to control the development by suppressing or enhancing development, to improve spectral sensitizing efficiency, and to improve storage properties before and after development. Descriptions can be found in paragraph Nos. 0067 to 0069 of JP-A No. 10-62899, a compound expressed by formula (I) of JP-A No. 10-186572 and specific examples thereof shown in paragraph Nos. 0033 to 0052, in lines 36 to 56 in page 20 of EP-A No. 0803764A1. Among them, mercapto-substituted heterocyclic aromatic compounds, which are described in JP-A Nos. 9-297367, 9-304875, 2001-100358, 2002-303954, 2002-303951 and the like, are particularly preferred.

2) Toner

In the photothermographic material of the present invention, the addition of a toner is preferred. The description of the toner can be found in JP-A No.10-62899 (paragraph Nos. 0054 to 0055), EP-A No.0803764A1 (page 21, lines 23 to 48), and JP-A Nos.2000-356317 and 2000-187298. Preferred are phthalazinones (phthalazinone, phthalazinone derivatives and metal salts thereof, e.g.,4-(1-naphthyl)phthalazinone,6-chlorophthalazinone, 5,7-dimethoxyphthalazinone and 2,3-dihydro-1,4-phthalazinedione); combinations of phthalazinones and phthalic acids(e.g., phthalic acid, 4-methylphthalic acid, 4-nitrophthalic acid, diammonium phthalate, sodium phthalate, potassium phthalate and tetrachlorophthalic anhydride); phthalazines(phthalazine, phthalazine derivatives and metal salts thereof, e.g., 4-(1-naphthyl)phthalazine, 6-isopropylphthalazine, 6-ter-butylphthalazine, 6-chlorophthalazine, 5,7-dimethoxyphthalazine and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or scratch resistance during thermal development, it is preferred to use a lubricant such as a liquid paraffin, a long chain fatty acid, an amide of fatty acid, an ester of fatty acid and the like. Paticularly preferred are a liquid paraffin obtained by removing components having low boiling point and a fatty acid ester having a branch structure and a molecular weight of 1000 of more.

As for plasticizers and lubricants usable in the image forming layer and in the non-photosensitive layer, compounds described in paragraph No. 0117 of JP-A No. 11-65021 and in JP-A No. 2000-5137 are preferable.

4) Dyes and Pigments

From the viewpoint of improving color tone, preventing the generation of interference fringes and preventing irradiation on laser exposure, various types of dyes and pigments (for instance, C.I. Pigment Blue 60, C.I. Pigment Blue 64, and C.I. Pigment Blue 15:6) may be used in the image forming layer of the invention. Detailed description can be found in W0 No. 98/36322, JP-A Nos. 10-268465 and 11-338098, and the like.

(Preparation of Coating Solution and Coating)

The temperature for preparing the coating solution for the image forming layer of the invention is preferably from 30° C. to 65° C., more preferably, from 35° C. or more to less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and other Constituting Components)

The image forming layer of the invention is constructed on a support by one or more layers. In the case of constituting the layer by a single layer, it comprises an organic silver salt, a photosensitive silver halide, a reducing agent, and a binder, which may further comprise additional materials as desired if necessary, such as a toner, a film forming promoting agent, and other auxiliary agents. In the case of constituting the image forming layer from two or more layers, the first image forming layer (in general, a layer placed adjacent to the support) contains an organic silver salt and a photosensitive silver halide, and some of the other components must be incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the photosensitive layers as described in U.S. Pat. No. 4,460,681.

The photothermographic material according to he invention may have a non-photosensitive layer in addition to the image forming layer. The non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided to the side opposite to the image forming layer.

Furthermore, a layer that functions as an optical filter may be provided as (a) or (b) above. An antihalation layer may be provided as (c) or (d) to the photosensitive material.

1) Surface Protective Layer

The photothermographic material of the invention may further comprise a surface protective layer with an object to prevent adhesion of the image forming layer. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but polyvinyl alcohol (PVA) may be used preferably instead, or in combination. As gelatin, there can be used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105 and the partially saponified PVA-205 and PVA-335, as well as modified polyvinyl alcohol MP-203 (trade name of products from Kuraray Ltd.). The amount of coated polyvinyl alcohol (per 1 $m^2$ of support) in the surface protective layer (per one layer) is preferably in the range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in the range from 0.3 $g/m^2$ to 5.0 $g/m^2$, and more preferably, from 0.3 $g/m^2$ to 2.0 $g/m^2$.

Further, it is preferred to use a lubricant such as a liquid paraffin and an ester of fatty acid in the surface protective layer. The addition amount of the lubricant is in the range of 1 $mg/m^2$ to 200 $mg/m^2$, preferably 10 $mg/m^2$ to 150 $mg/m^2$ and, more preferably 20 $mg/m^2$ to 100 $mg/m^2$.

2) Antihalation Layer

The photothermographic material of the present invention may comprise an antihalation layer provided to the side farther from the light source with respect to the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case the exposure wavelength is in the infrared region, an infrared-absorbing dye may be used, and in such a case, preferred are dyes having no absorption in the visible region.

In the case of preventing halation from occurring by using a dye having absorption in the visible region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in the range from 0.15 to 2, and more preferably from 0.2 to 1. The addition amount of dyes to obtain optical density in the above range is generally from 0.001 g/m$^2$ to 1 g/m$^2$.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In the case of thermal decolorization by the combined use of a decoloring dye and a base precursor, it is advantageous from the viewpoint of thermal decoloring efficiency to further use the substance capable of lowering the melting point by at least 3° C. when mixed with the base precursor (e.g., diphenylsulfone, 4-chlorophenyl(phenyl)sulfone, 2-naphthylbenzoate and the like) as disclosed in JP-A No. 11-352626.

3) Back Layer

Back layers usable in the invention are described in paragraph Nos. 0128 to 0130 of JP-A No. 11-65021.

In the invention, coloring matters having maximum absorption in the wavelength range from 300 nm to 450 nm may be added in order to improve color tone of developed silver images and a deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in the range from 0.1 mg/m$^2$ to 1 g/m$^2$, preferably to the back layer which is provided to the side opposite to the image forming layer.

Further, in order to control the basic color tone, it is preferred to use a dye having an absorption peak in the wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming surface side, or in the back surface side.

The photothermographic material of the invention is preferably a so-called one-side photosensitive material, which comprises at least one layer of image forming layer containing silver halide emulsion on one side of the support, and a back layer on the other side.

4) Matting Agent

A matting agent may be preferably added to the photothermographic material of the invention in order to improve transportability. Description on the matting agent can be found in paragraphs Nos. 0126 to 0127 of JP-A No.11-65021. The addition amount of the matting agent is preferably in the range from 1 mg/m$^2$ to 400 mg/m$^2$, more preferably, from 5 mg/m$^2$ to 300 mg/m$^2$, with respect to the coating amount per 1 m$^2$ of the photothermographic material.

There is no particular restriction on the shape of the matting agent usable in the invention and it may fixed form or non-fixed form. Preferred is to use those having fixed form and globular shape.

Volume weighted mean equivalent spherical diameter of the matting agent used in the image forming layer surface is preferably in the range from 0.3 μm to 10 μm, and more preferably, from 0.5 μm to 7 μm. Further, the particle distribution of the matting agent is preferably set as such that the variation coefficient may become from 5% to 80%, and more preferably, from 20% to 80%. The variation coefficient, herein, is defined by (the standard deviation of particle diameter)/(mean diameter of the particle)×100. Furthermore, two or more kinds of matting agents having different mean particle size can be used in the image forming layer surface. In this case, it is preferred that the difference between the mean particle size of the biggest matting agent and the mean particle size of the smallest matting agent is from 2 μm to 8 μm, and more preferred, from 2 μm to 6 μm.

Volume weighted mean equivalent spherical diameter of the matting agent used in the back surface is preferably in the range from 1 μm to 15 μm, and more preferably, from 3 μm to 10 μm. Further, the particle distribution of the matting agent is preferably set as such that the variation coefficient may become from 3% to 50%, and more preferably, from 5% to 30%. Furthermore, two or more kinds of matting agents having different mean particle size can be used in the back surface. In this case, it is preferred that the difference between the mean particle size of the biggest matting agent and the mean particle size of the smallest matting agent is from 2 μm to 14 μm, and more preferred, from 2 μm to 9 μm.

The matt degree of the image forming layer surface is not restricted as far as star-dust trouble occurs, but the matt degree of 30 seconds to 2000 seconds is preferred, particularly preferred, 40 seconds to 1500 seconds as Beck's smoothness. Beck's smoothness can be calculated easily, by seeing Japan Industrial Standared (JIS) P8119 "The method of testing Beck's smoothness for papers and sheets using Beck's test apparatus", or TAPPI standard method T479.

The matt degree of the back layer in the invention is preferably in the range of 1200 seconds or less and 10 seconds or more; more preferably, 800 seconds or less and 20 seconds or more; and further preferably, 500 seconds or less and 40 seconds or more, as expressed by Beck smoothness.

In the invention, the matting agent is incorporated preferably in the outermost surface layer of the photothermographic material, a layer functioning as the outermost surface layer, or a layer near to the outer surface. And, the matting agent is preferably incorporated in a layer that functions as the so-called protective layer.

5) Polymer Latex

In the photothermographic material of the invention, it is preferred to incorporate polymer latex in the surface protective layer or in the back layer. As such polymer latexes, descriptions can be found in "Gousei Jushi Emulsion (Synthetic resin emulsion)" (Taira Okuda and Hiroshi Inagaki, Eds., published by Koubunshi Kankoukai (1978)), "Gousei Latex no Ouyou (Application of synthetic latex)" (Takaaki Sugimura, Yasuo Kataoka, Souichi Suzuki, and Keiji Kasahara, Eds., published by Koubunshi Kankoukai (1993)), and "Gousei Latex no Kagaku (Chemistry of synthetic latex)" (Souichi Muroi, published by Koubunshi Kankoukai (1970)). More specifically, there can be mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl methacrylate (25.4% by weight)/styrene (8.6% by weight)/2-hydroethyl methacrylate (5.1% by weight)/acrylic acid copolymer, a latex of methyl methacrylate (64.0% by weight)/styrene (9.0% by weight)/butyl acrylate (20.0% by weight)/2-hydroxyethyl methacrylate(5.0% by weight)/acrylic acid copolymer, and the like. Furthermore, as the binder for the surface protective layer, there can be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer preferably is contained in an amount of 10% by weight to 90% by weight, particularly preferably, of 20% by weight to 80% by weight of the total weight of binder.

6) Surface pH

The surface pH of the photothermographic material according to the invention preferably yields a pH of 7.0 or lower, more preferably, 6.6 or lower, before thermal development treatment. Although there is no particular restriction concerning the lower limit, the pH value is about 3, and the most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener can be used in each of image forming layer, protective layer, back layer, and the like. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193 and the like, epoxy compounds of U.S. Pat. No. 4,791,042 and the like, and vinyl sulfone based compounds of JP-A No. 62-89048.

The hardener is added as a solution, and the solution is added to the coating solution for the protective layer 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Kouji Takahashi) "Liquid Mixing Technology" (Nikkan Kougyou Shinbunsya, 1989), and the like.

8) Surfactant

As the surfactant, the solvent, the support, the antistatic or electrically conductive layer, and the method for obtaining color images applicable in the invention, there can be mentioned those disclosed in paragraph Nos. 0132, 0133, 0134, 0135, and 0136, respectively, of JP-A No. 11-65021. The lubricant is described in paragraph Nos. 0061 to 0064 of JP-A No. 11-84573 and in paragraph Nos. 0049 to 0062 of JP-A No. 2000-208857.

In the invention, it is preferred to use fluorocarbon surfactants. Specific examples of fluorocarbon surfactants can be found in those described in JP-A Nos. 10-197985, 2000-19680, and 2000-214554. Polymer fluorocarbon surfactants described in JP-A No. 9-281636 can be also used preferably. For the photothermographic material in the invention, the fluorocarbon surfactants described in JP-A Nos. 2002-82411 and 2003-57780 are preferably used. Especially, the usage of the fluorocarbon surfactants described in JP-A No. 2003-057780 in an aqueous coating solution is preferred viewed from the standpoint of capacity in static control, stability of the coating side state and sliding facility.

According to the invention, the fluorocarbon surfactant can be used on either of image forming layer surface or back layer surface, but is preferred to use on the both surfaces. Further, it is particularly preferred to use in combination with electrically conductive layer including aforementioned metal oxides. In this case the amount of the fluorocarbon surfactant on the surface of the electrically conductive layer can be reduced or removed.

The addition amount of the fluorocarbon surfactant is preferably in the range from 0.1 $mg/m^2$ to 100 $mg/m^2$ on each surface of image forming layer and back layer, more preferably 0.3 $mg/m^2$ to 30 $mg/m^2$, further preferably 1 $mg/m^2$ to 10 $mg/m^2$.

9) Antistatic Agent

The photothermographic material of the invention preferably contains an electrically conductive layer including metal oxides or electrically conductive polymers. The antistatic layer may serve as an undercoat layer, or a back surface protective layer, and the like, but can also be placed specially. As an electrically conductive material of the antistatic layer, metal oxides having enhanced electric conductivity by the method of introducing oxygen defects or different types of metallic atoms into the metal oxides are preferably for use. Examples of metal oxides are preferably selected from ZnO, $TiO_2$ and $SnO_2$. As the combination of different types of atoms, preferred are ZnO combined with Al, In; $SnO_2$ with Sb, Nb, P, halogen atoms, and the like; $TiO_2$ with Nb, Ta, and the like; Particularly preferred for use is $SnO_2$ combined with Sb. The addition amount of different types of atoms is preferably in the range from 0.01 mol % to 30 mol %, and particularly preferably, in the range from 0.1 mol % to 10 mol %. The shape of the metal oxides can include, for example, spherical, needle-like, or plate-like shape. The needle-like particles, with the rate of (the major axis)/(the minor axis) is 2.0 or more, and more preferably, 3.0 to 50, is preferred viewed from the standpoint of the electric conductivity effect. The metal oxides is used preferably in the range from 1 $mg/m^2$ to 1000 $mg/m^2$, more preferably from 10 $mg/M^2$ to 500 $mg/m^2$, and further preferably from 20 $mg/m^2$ to 200 $mg/m^2$. The antistatic layer can be laid on either side of the image forming layer surface or the back surface, it is preferred to set between the support and the back layer. Examples of the antistatic layer in the invention include described in JP-A Nos. 11-65021, 56-143430, 56-143431, 58-62646, and 56-120519, and in paragraph Nos. 0040 to 0051 of JP-A No. 11-84573, U.S. Pat. No. 5,575,957, and in paragraph Nos. 0078 to 0084 of JP-A No. 11-223898.

10) Support

As the transparent support, favorably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684 and the like. The moisture content of the support is preferably 0.5% by weight or less when coating for image forming layer and back layer is conducted on the support.

11) Other Additives

Furthermore, an antioxidant, a stabilizing agent, a plasticizer, a UV absorbent, or a film forming promoting agent may be added to the photothermographic material. Each of the additives is added to either of the image forming layer or the non-photosensitive layer. Reference can be made to W0 No. 98/36322, EP No. 803764A1, JP-A Nos. 10-186567 and 10-18568, and the like.

12) Coating Method

The photothermographic material of the invention may be coated by any method. More specifically, various types of coating operations inclusive of extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and most preferably used is slide coating. Example of the shape of the slide coater for use in slide coating is shown in FIG. 11b.1, page 427, of the same literature. If desired, two or more layers can be coated simultaneously by the method described in pages 399 to 536 of the same literature, or by the method described in U.S. Pat. No. 2,761,791 and British Patent No. 837095. Particularly preferred in the invention is the method described in JP-A Nos. 2001-194748, 2002-153808, 2002-153803, and 2002-182333.

The coating solution for the image forming layer according to the invention is preferably a so-called thixotropic fluid. For the details of this technology, reference can be made to JP-A No. 11-52509. Viscosity of the coating solution for the image forming layer according to the invention at a shear velocity of 0.1 $S^{-1}$ is preferably from 400 mPa·s to 100,000 mPa·s, and more preferably, from 500 mPa·s to 20,000 mPa·s. At a shear velocity of 1000 $S^{-1}$, the viscosity is preferably from 1 mPa·s to 200 mPa·s, and more preferably, from 5 mPa·s to 80 mPa·s.

In the case of mixing two types of liquids on preparing the coating solution, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to defoaming treatment to maintain the coated surface in a fine state. Preferred defoaming treating method in the invention is described in JP-A No. 2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying wind and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in the range from 60° C. to 100° C. at the film surface, and time period for heating is preferably in the range from 1 second to 60 seconds. More preferably, the temperature of the heat treatment is in the range 70° C. to 90° C. at the film surface and time period for heating is 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and continuously produce the photothermographic material of the invention.

The photothermographic material is preferably of monosheet type (i.e., a type which can form image on the photothermographic material without using other sheets such as an image-receiving material).

13) Wrapping Material

In order to suppress fluctuation from occurring on the photographic property during a preservation of the photosensitive material of the invention before thermal development, or in order to improve curling or winding tendencies, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and most preferably, 1.0 $mL \cdot atm^{-1}m^{-2}day^{-1}$ or lower. Preferably, vapor transmittance is 10 g $atm^{-1}m^{-2}day^{-1}$ or lower, more preferably, 5 $g \cdot atm^{-1}m^{-2}day^{-1}$ or lower, and most preferably, 1 g $atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP Nos. 803764A1 and 883022A1, WO No. 98/36322, JP-A Nos. 56-62648, 58-62644, 09-43766, 09-281637, 09-297367, 09-304869, 09-311405, 09-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2001-200414, 2001-234635, 2002-020699, 2001-275471, 2001-275461, 2000-313204, 2001-292844, 2000-324888, 2001-293864, and 2001-348546.

(Image Forming Method)

1) Exposure

Although the photothermographic material of the invention may be subjected to exposure by any methods, laser beam is preferred as an exposure light source. As laser beam according to the invention, He—Ne laser of red through infrared emission, red laser diode, or Ar', He—Ne, He—Cd laser of blue through green emission, blue laser diode can be used. Preferred laser is red to infrared laser diode and the peak wavelength of laser beam is 600 nm to 900 nm, preferably 620 nm to 850 nm.

In recent years, development has been made particularly on a light source module with an SHG (a second harmonic generator) and a laser diode integrated into a single piece whereby a laser output apparatus in a short wavelength region has come into the limelight. A blue laser diode enables high definition image recording and makes it possible to obtain an increase in recording density and a stable output over a long lifetime, which results in expectation of an expanded demand in the future. The peak wavelength of blue laser beam is preferably 300 nm to 500 nm, and particularly preferably 400 nm to 500 nm.

Laser beam which oscillates in a longitudinal multiple modulation by a method such as high frequency superposition is also preferably employed.

2) Thermal Development

Although the development of the photothermographic material of the invention is usually performed by elevating the temperature of the photothermographic material exposed imagewise, any method may be used for this thermal development process. The temperature for the development is preferably 80° C. to 250° C., more preferably 100° C. to 140° C., and further preferably 110° C. to 130° C. Time period for development is preferably 1 second to 60 seconds, more preferably 3 seconds to 30 seconds, further preferably 5 seconds to 25 seconds, and particularly preferably 7 seconds to 15 seconds.

In the process for thermal development, either drum type heaters or plate type heaters may be used. However, plate type heater processes are more preferred. Preferable process for the thermal development by a plate type heater may be a process described in JP-A NO. 11-133572, which discloses a thermal developing apparatus in which a visible image is obtained by bringing a photothermographic material with a formed latent image into contact with a heating means at a thermal developing portion, wherein the heating means comprises a plate heater, and plurality of retainer rollers are oppositely provided along one surface of the plate heater, the thermal developing apparatus is characterized in that thermal development is performed by passing the photothermographic material between the retainer rollers and the plate heater. It is preferred that the plate heater is divided into 2 to 6 portions, with the leading end having the lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A NO. 54-30032, which allows for excluding moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and it is desirable that the top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, to use the photothermographic materials of the invention in combination, which are highly sensitive and less susceptible to the environmental temperature, is preferred.

3) System

Examples of a medical laser imager equipped with an exposing portion and a thermal developing portion include Fuji Medical Dry Laser Imager FM-DP L and DRYPIX 7000. In connection with FM-DP L, description is found in Fuji Medical Review No. 8, pages 39 to 55. It goes without mentioning that those techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

Application of the Invention

The image forming method in which the photothermographic material of the invention is used is preferably employed as image forming methods for photothermographic materials for use in medical imaging, photothermographic materials for use in industrial photographs, photothermographic materials for use in graphic arts, as well as for COM, through forming black and white images by silver imaging.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (weight ratio) at 25° C.) was obtained according to a conventional manner using terephthalic acid and ethylene glycol. The product was pelletized, dried at 130° C. for 4 hours, melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

| <Preparations of Coating Solution for Undercoat Layer> | |
|---|---|
| Formula (1) (for undercoat layer on the image forming layer side) | |
| Pesresin A-520 manufactured by Takamatsu Oil & Fat Co., Ltd. (30% by weight solution) | 46.8 g |
| BAIRONAARU MD-1200 manufactured by Touyou Bouseki Co., Ltd. | 10.4 g |
| Polyethylene glycol monononylphenylether (average ethylene oxide number = 8.5) (1% by weight solution) | 11.0 g |
| MP-1000 manufactured by Soken Chemical & Engineering Co., Ltd. (PMMA polymer fine particle, mean particle diameter of 0.4 μm) | 0.91 g |
| distilled water | 931 mL |
| Formula (2) (for first layer on the back surface) | |
| Styrene-butadiene copolymer latex (solid content of 40% by weight, styrene/butadiene weight ratio = 68/32) | 130.8 g |
| 2,4-Dichloro-6-hydroxy-S-triazine sodium salt (8% by weight aqueous solution) | 5.2 g |
| Sodium laurylbenzenesulfonate (1% by weight aqueous solution) | 10 mL |
| Polystyrene particle dispersion (mean particle diameter of 2 μm, 20% by weight) | 0.5 g |
| distilled water | 854 mL |
| Formula (3) (for second layer on the back surface) | |
| $SnO_2$/SbO (9/1 weight ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| Sodium dodecylbenzenesulfonate (1% by weight aqueous solution) | 10 mL |
| NaOH (1% by weight) | 7 g |
| Proxel (manufactured by Imperial Chemical Industries PLC) | 0.5 g |
| distilled water | 881 mL |

<Undercoating>

Both surfaces of the biaxially tentered polyethylene terephthalate support having the thickness of 175 μm were subjected to the corona discharge treatment as described above. Thereafter, the aforementioned formula (1) of the coating solution for the undercoat was coated on one surface (image forming layer surface) with a wire bar so that the amount of wet coating became 6.6 mL/m$^2$ (per one surface), and dried at 180° C. for 5 minutes. Then, the aforementioned formula (2) of the coating solution for the undercoat was coated on the reverse face (back surface) with a wire bar so that the amount of wet coating became 5.7 mL/m$^2$, and dried at 180° C. for 5 minutes. Furthermore, the aforementioned formula (3) of the coating solution for the undercoat was coated on the reverse face (back surface) with a wire bar so that the amount of wet coating became 8.4 mL/m$^2$, and dried at 180° C. for 6 minutes. Thus, an undercoated support was produced.

(Back Layer)

1) Preparations of Coating Solution for Back Layer

<Preparation of Dispersion of Solid Fine Particles (a) of Base Precursor>

To base precursor-1 in an amount of 2.5 kg, and 300 g of a surfactant (trade name: DEMOL N, manufactured by Kao Corporation), 800 g of diphenyl sulfone and 1.0 g of benzoisothiazolinone sodium salt, was added distilled water to give the total amount of 8.0 kg and mixed. The mixed liquid was subjected to beads dispersion using a horizontal sand mill (UVM-2: manufactured by IMEX Co., Ltd.). Process for dispersion included feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

The dispersion was continued until the ratio of the optical density at 450 nm and the optical density at 650 nm for the spectral absorption of the dispersion ($D_{450}/D_{650}$) became 3.0 upon spectral absorption measurement. Thus resulting dispersion was diluted with distilled water so that the concentration of the base precursor became 25% by weight, and filtrated (with a polypropylene filter having a mean fine pore diameter of 3 μm) for eliminating dust to put into practical use.

<Preparation of Dispersion of Solid Fine Particle of Dye>

Cyanine dye-1 in an amount of 6.0 kg, and 3.0 kg of sodium p-dodecylbenzenesulfonate, 0.6 kg of DEMOL SNB (a surfactant manufactured by Kao Corporation), and 0.15 kg of a defoaming agent (trade name: SURFYNOL 104E, manufactured by Nissin Chemical Industry Co., Ltd.) were mixed with distilled water to give the total liquid amount of 60 kg. The mixed liquid was subjected to dispersion with 0.5 mm zirconia beads using a horizontal sand mill (UVM-2: manufactured by IMEX Co., Ltd.).

The dispersion was dispersed until the ratio of the optical density at 650 nm and the optical density at 750 nm for the spectral absorption of the dispersion ($D_{650}/D_{750}$) became 5.0 or more upon spectral absorption measurement. Thus resulting dispersion was diluted with distilled water so that the concentration of the cyanine dye became 6% by weight, and filtrated with a filter (mean fine pore diameter: 1 μm) for eliminating dust to put into practical use.

<Preparation of Coating Solution for Antihalation Layer>

A vessel was kept at 40° C., and thereto were added 40 g of gelatin, 20 g of monodispersed polymethyl methacrylate fine particles (mean particle size of 8 μm, standard deviation of particle diameter of 0.4), 0.1 g of benzoisothiazolinone and 490 mL of water to allow gelatin to be dissolved. Additionally, 2.3 mL of a 1 mol/L aqueous sodium hydroxide solution, 40 g of the aforementioned dispersion of the solid fine particle of the dye, 90 g of the aforementioned dispersion of the solid fine particles (a) of the base precursor, 12 mL of a 3% by weight aqueous solution of sodium polystyrenesulfonate, and 180 g of a 10% by weight solution of SBR latex were admixed. Just prior to the coating, 80 mL of a 4% by weight aqueous solution of N,N-ethylenebis (vinylsulfone acetamide) was admixed to give a coating solution for the antihalation layer.

<Preparation of Coating Solution for Back Surface Protective Layer>

A vessel was kept at 40° C., and thereto were added 40 g of gelatin, 35 mg of benzoisothiazolinone and 840 mL of water to allow gelatin to be dissolved. Additionally, 5.8 mL of a 1 mol/L aqueous sodium hydroxide solution, 5 g of a 10% by weight emulsion of liquid paraffin, 5 g of a 10% by weight emulsion of trimethylolpropane triisostearate, 10 mL of a 5% by weight aqueous solution of di(2-ethylhexyl) sodium sulfosuccinate, 20 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 32 g of a 19% by weight solution of methyl methacrylate/styrene/butyl acrylate/hydroxyethyl methacrylate/acrylic acid copolymer (weight ratio of the copolymerization of 57/8/28/5/2) latex were admixed. Just prior to the coating, 25 mL of a 4% by weight aqueous solution of N,N-ethylenebis(vinylsulfone acetamide) was admixed to give a coating solution for the back surface protective layer.

2) Coating of Back Layer

The back surface side of the undercoated support as described above was subjected to simultaneous double coating so that the coating solution for the antihalation layer gave the amount of coated gelatin of 0.52 g/m$^2$, and so that the coating solution for the back surface protective layer gave the amount of coated gelatin of 1.7 g/m$^2$, followed by drying to produce a back layer.

(Image Forming Layer, Intermediate Layer, and Surface Protective Layer)

1. Preparations of Materials for Coating

1) Silver Halide Emulsion

<<Preparation of Silver Halide Emulsion-1>>

To 1421 mL of distilled water were added 3.1 mL of a 1% by weight potassium bromide solution, 3.5 mL of 0.5 mol/L sulfuric acid and 31.7 g of phthalated gelatin. The solution was kept at 30° C. while stirring in a stainless steel reaction pot, and thereto were added total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A method of controlled double jet was executed through adding total amount of the solution C at a constant flow rate over 20 minutes, accompanied by adding the solution D while maintaining the pAg at 8.1. Hexachloroiridium (III) potassium salt was added to give $1\times10^{-4}$ mol per 1 mol of silver at 10 minutes post initiation of the addition of the solution C and the solution D in its entirety. Moreover, at 5 seconds after completing the addition of the solution C, a potassium iron (II) hexacyanide aqueous solution was added at a total amount of $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The silver halide dispersion was kept at 38° C. with stirring, and thereto was added 5 mL of a 0.34% by weight methanol solution of 1,2-benzoisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizer A and a spectral sensitizer B with a molar ratio of 3:1 was added thereto at $1.2\times10^{-3}$ mol in total of the spectral sensitizer A and B per 1 mol of silver. At one minute later, 1.3 mL of a 0.8% by weight N,N'-dihydroxy-N",N"-diethylmelamine in methanol was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce silver halide emulsion-1.

Grains in thus prepared silver halide emulsion were silver iodobromide grains having a mean equivalent spherical diameter of 0.042 μm, a variation coefficient of equivalent spherical diameter of 20%, which uniformly include iodine at 3.5 mol %. Grain size and the like were determined from the average of 1000 grains using an electron microscope. The {100} face ratio of this grain was found to be 80% using a Kubelka-Munk method.

<<Preparation of Silver Halide Emulsion-2>>

Preparation of silver halide emulsion-2 was conducted in a similar manner to the process in the preparation of the silver halide emulsion-1 except that: the temperature of the liquid upon the grain formation step was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium iron (II) hexacyanide was deleted. The precipitation/desalting/water washing /dispersion were carried out similarly to the silver halide emulsion-1. Furthermore, the spectral sensitization, chemical sensitization, and addition of 5-methyl-2-mercaptobenzimidazole and 1-phenyl-2-heptyl-5-mercapto-1,3,4-triazole were executed similarly to the silver halide emulsion-1 except that: the amount of the tellurium sensitizer C to be added was changed to $1.1\times10^{-4}$ mol per 1 mol of silver; the amount of the methanol solution of the spectral sensitizer A and a spectral sensitizer B with a molar ratio of 3:1 to be added was changed to $7.0\times10^{-4}$ mol in total of the spectral sensitizer A and the spectral sensitizer B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion-2. The emulsion grains in the silver halide emulsion-2 were pure cubic silver bromide grains having a mean equivalent spherical diameter of 0.080 0m and a variation coefficient of equivalent spherical diameter of 20%.

<<Preparation of Silver Halide Emulsion-3>>

Preparation of silver halide emulsion-3 was conducted in a similar manner to the process in the preparation of the silver halide emulsion-1 except that the temperature of the liquid upon the grain formation step was altered from 30° C. to 27° C. The precipitation/desalting/water washing/dispersion were carried out similarly to the silver halide emulsion-1. Silver halide emulsion-3 was obtained similarly to the silver halide emulsion-1 except that: the addition of the methanol solution of the spectral sensitizer A and the spectral sensitizer B was changed to the solid dispersion (aqueous gelatin solution) at a molar ratio of 1:1 with the amount to be added being $6.0\times10^{-3}$ mol in total of the spectral sensitizer A and spectral sensitizer B per 1 mol of silver; the amount of the tellurium sensitizer C to be added was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. The grains in the silver halide emulsion-3 were silver iodobromide grains having a mean equivalent spherical diameter of 0.034 μm and a variation coefficient of equivalent spherical diameter of 20%, which uniformly include iodine at 3.5 mol %.

<<Preparation of Mixed Emulsion A for Coating Solution>>

The silver halide emulsion-1 at 70% by weight, the silver halide emulsion-2 at 15% by weight and the silver halide emulsion-3 at 15% by weight were dissolved, and thereto was added benzothiazolium iodide at $7\times10^{-3}$ mol per 1 mol of silver with a 1% by weight aqueous solution.

Further, as "a compound that can be one-electron-oxidized to provide a one-electron oxidation product, which releases one or more electrons", the compound Nos. 1, 2 and 3 were added respectively in an amount of $2\times10^{-3}$ mol per 1 mol of silver contained in silver halide.

Thereafter, as "a compound having an adsorptive group and a reducible group", the compound Nos. 1 and 2 were added respectively in an amount of $5\times10^{-3}$ mol per 1 mol of silver halide.

Further, water was added thereto to give the content of silver halide of 38.2 g in terms of silver per 1 kg of the mixed emulsion for coating solution. Then, 1-(3-methylureidophenyl)-5-mercaptotetrazole was added to give 0.34 g per 1 kg of the mixed emulsion for coating solution.

2) Preparations of Dispersion of Silver Salt of Fatty Acid A to C

A fatty acid having a mole ratio as described in Table 1 in an amount of 0.25 mol in total, 423 L of distilled water, 49.2 L of 5 mol/L sodium hydroxide solution, 120 L of t-butyl alcohol were admixed, and subjected to a reaction with stirring at 75° C. for one hour to give a solution of a sodium salt of fatty acid. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of a sodium salt of fatty acid and the total amount of the aqueous silver nitrate solution with sufficient stirring at a constant flow rate over 93 minutes and 15 seconds, and 90 minutes, respectively. Upon this operation, during first 11 minutes following the initiation of adding the aqueous silver nitrate solution, the added material was restricted to the aqueous silver nitrate solution alone. The addition of the solution of a sodium salt of fatty acid was thereafter started, and during 14 minutes and 15 seconds following the completion of adding the aqueous silver nitrate solution, the added material was restricted to the solution of a sodium salt of fatty acid alone. The temperature inside of the reaction vessel was then set to be 30° C., and the temperature outside was controlled so that the liquid temperature could be kept constant. In addition, the temperature of a pipeline for the addition system of the solution of a sodium salt of fatty acid was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of a sodium salt of fatty acid was added and the position, at which the aqueous silver nitrate solution was added, was arranged symmetrically with a shaft for stirring located at a center. Moreover, both of the positions were adjusted to avoid contact with the reaction liquid.

After completing the addition of the solution of a sodium salt of fatty acid, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of fatty acid was thus obtained. The resulting solid matters were stored as a wet cake without drying.

When the shape of the resulting particles of the silver salt of fatty acid was evaluated by an electron micrography, a flake crystal was revealed having a= 0.14 μm, b=0.4 μm and c=0.6 μm on the average value, with a mean aspect ratio of 5.2, a mean equivalent spherical diameter of 0.52 μm and a variation coefficient of equivalent spherical diameter of 15% (a, b and c were defined as aforementioned.).

To the wet cake corresponding to 260 kg of a dry solid matter content, were added 19.3 kg of polyvinyl alcohol (trade name: PVA-217) and water to give the total amount of 1000 kg. Then, a slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1260 kg/cm$^2$ to give a dispersion of the silver salt of fatty acid. For the cooling manipulation, coiled heat exchangers were equipped in front of and behind the interaction chamber respectively, and accordingly, the temperature for the dispersion was set to be 18° C. by regulating the temperature of the cooling medium.

TABLE 1

| | Fatty acid composition (mol %) | | | |
|---|---|---|---|---|
| Dispersion No. | Behenic acid | Arachidinic acid | Stearic acid | Lignoceric acid |
| A | 55 | 19 | 22 | 4 |
| B | 80 | 8 | 10 | 2 |
| C | 95 | 3 | 1 | 1 |

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours. Thereafter, 0.2 g of a benzoisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion. Particles of the reducing agent included in the resulting reducing agent dispersion had a median diameter of 0.40 μm, and a maximum particle diameter of 1.4 μm or less. The resultant reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent-2 dispersion had a median diameter of 0.50 μm, and a maximum particle diameter of 1.6 μm or less. The resultant reducing agent-2 dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 4 hours. Thereafter, 0.2 g of a benzoisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resultant hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of a development accelerator-1 and 20 kg of a 10% by weight aqueous solution of modified polyvinyl alcohol (manufactured by Kuraray Co., Ltd., Poval MP203) was added 10 kg of water, and thoroughly mixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the development accelerator to be 20% by weight. Accordingly, a development accelerator-1 dispersion was obtained. Particles of the development accelerator included in the resulting development accelerator dispersion had a median diameter of 0.48 μm, and a maximum particle diameter of 1.4 μm or less. The resultant development accelerator dispersion was subjected to filtration with a polypropylene filter having a pore size of 3.0 μm to remove foreign substances such as dust, and stored.

6) Preparation of Dispersion of Color-tone-adjusting Agent-1

Also concerning solid dispersion of color-tone-adjusting agent-1, dispersion was executed in a similar manner to development accelerator-1, and thus a dispersion of 15% by weight was obtained.

7) Preparations of Halogen Releasing Compound

<<Preparation of Dispersion of Halogen Releasing Compound having No Water-solubilizing Group>>

A halogen releasing compound having no water-solubilizing group (shown in Table 2) in an amount of 10 kg, 10 kg of a 20% by weight aqueous solution of modified polyvinyl alcohol (manufactured by Kuraray Co., Ltd., Poval MP203), 0.4 kg of a 20% by weight aqueous solution of sodium triisopropylnaphthalenesulfonate and 14 kg of water were added, and thoroughly admixed to give a slurry. This slurry was fed with a diaphragm pump, and was subjected to dispersion with a horizontal sand mill (UVM-2: manufactured by IMEX Co., Ltd.) packed with zirconia beads having a mean particle diameter of 0.5 mm for 5 hours. Thereafter, 0.2 g of a benzoisothiazolinone sodium salt and water were added thereto, thereby adjusting the concentration of the halogen releasing compound having no water-solubilizing group to be 26% by weight. Accordingly, a dispersion of halogen releasing compound having no water-solubilizing group was obtained. Particles of the halogen releasing compound having no water-solubilizing group included in the resulting dispersion of halogen releasing compound having no water-solubilizing group had a median diameter of 0.41 μm, and a maximum particle diameter of 2.0 μm or less. The resultant dispersion of halogen releasing compound having no water-solubilizing group was subjected to filtration with a polypropylene filter having a pore size of 10.0 μm to remove foreign substances such as dust, and stored.

<<Preparation of Solution of Halogen Releasing Compound having a Water-solubilizing Group>>

A halogen releasing compound having a water-solubilizing group (shown in Table 2) in an amount of 5.0 g was dissolved in 100 g of mixed solvent, methanol/distilled water=1/1 (weight ratio), to give a 5% by weight solution.

8) Preparation of Phthalazine Compound-1 Solution

Modified polyvinyl alcohol MP203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight phthalazine compound-1 solution.

9) Preparations of Mercapto Compound Solution

<<Preparation of Aqueous Solution of Mercapto Compound-1>>

A mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

A mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give a slurry. Zirconia beads having a mean particle diameter of 0.5 mm were provided in an amount of 800 g, and charged in a vessel with the slurry. Dispersion was performed with a dispersing machine (1/4G sand grinder mill: manufactured by IMEX Co., Ltd.) for 25 hours. Thereto was added water to adjust so that the concentration of the pigment became 5% by weight to obtain pigment-1 dispersion. Particles of the pigment included in the resulting pigment dispersion had a mean particle diameter of 0.21 μm.

11) Preparation of SBR Latex Solution

To a polymerization tank of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1, 3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ration of $Na^+$ ion:$NH_4^+$ ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., solid matter concentration of 44% by weight, the equilibrium moisture content at 25° C. and 60% RH of 0.6% by weight, ionic conductance of 4.80 mS/cm (measurement of the ionic conductance performed using a conductivity meter CM-30S manufactured by Toa Electronics Ltd. for the latex stock solution (44% by weight) at 25° C.).

2. Preparations of Coating Solutions

1) Preparations of Coating Solution for Image Forming Layer

The dispersion of the silver salt of fatty acid obtained as described above in an amount of 1000 g (see Table 2), 135 mL of water, 36 g of the pigment-1 dispersion, the halogen releasing compound, 171 g of the phthalazine compound-1 solution, 1060 g of the SBR latex (Tg: 17° C.) solution, 75 g of the reducing agent-1 dispersion, 75 g of the reducing agent-2 dispersion, 55 g of the hydrogen bonding compound-1 dispersion, 15.6 g of the development accelerator-1 dispersion, 2.1 g of the color-tone-adjusting agent-1 dispersion, 8 mL of the mercapto compound-1 aqueous solution and 8 mL of the mercapto compound-2 aqueous solution were serially added. The coating solution for the image forming layer prepared by adding 140 g of the mixed emulsion A for coating solution thereto followed by thorough mixing just prior to the coating was fed directly to a coating die and coated.

2) Coating Solution for Intermediate Layer

To 1000 g of polyvinyl alcohol PVA-205 (manufactured by Kuraray Co., Ltd.), 163 g of the pigment-1 dispersion, 33 g of a 18.5% by weight aqueous solution of blue dye-1 (manufactured by Nippon Kayaku Co., Ltd.: Kayafect turquoise RN liquid 150), 27 mL of a 5% by weight aqueous solution of di(2-ethylhexyl) sodium sulfosuccinate and 4200 mL of a 19% by weight solution of methyl methacrylate/styrene/butyl acrylate/hydroxyethyl methacrylate/acrylic acid copolymer (weight ratio of the copolymerization of 57/8/28/5/2) latex were added 27 mL of a 5% by weight aqueous solution of aerosol OT (manufactured by American Cyanamid Co.), 135 mL of a 20% by weight aqueous solution of ammonium secondary phthalate and water to give total amount of 10000 g. The mixture was adjusted with sodium hydroxide to give the pH of 7.5. Accordingly, the coating solution for the intermediate layer was prepared, and was fed to a coating die to provide 8.9 mL/$m^2$.

Viscosity of the coating solution was 58 mPa·s which was measured with a B type viscometer at 40° C. (No. 1 rotor, 60 rpm).

3) Coating Solution for First Layer of Surface Protective Layers

In 840 mL of water were dissolved 100 g of inert gelatin and 10 mg of benzoisothiazolinone, and thereto were added 180 g of a 19% by weight solution of methyl methacrylate/styrene/butyl acrylate/hydroxyethyl methacrylate/acrylic acid copolymer (weight ratio of the copolymerization of 57/8/28/5/2) latex, 46 mL of a 15% by weight methanol solution of phthalic acid and 5.4 mL of a 5% by weight aqueous solution of di(2-ethylhexyl) sodium sulfosuccinate, and were mixed. Immediately before coating, 40 mL of a 4% by weight chrome alum which had been mixed with a static mixer was added to give a coating solution for the first layer of the surface protective layers, which was fed to a coating die so that 18.6 mL/$m^2$ could be provided.

Viscosity of the coating solution was 20 mPa·s which was measured with a B type viscometer at 40° C. (No. 1 rotor, 60 rpm).

4) Coating Solution for Second Layer of Surface Protective Layers

In 800 mL of water were dissolved 100 g of inert gelatin and 10 mg of benzoisothiazolinone, and thereto were added 40 g of a 10% by weight liquid paraffin emulsion, 40 g of a 10% by weight emulsion of dipentaerythritol hexa-isostearate, 180 g of a 19% by weight solution of methyl methacrylate/styrene/butyl acrylate/hydroxyethyl methacrylate/acrylic acid copolymer (weight ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of di(2-ethylhexyl) sodium sulfosuccinate, 4 g of polymethyl methacrylate fine particles (mean particle diameter of 0.7 μm, volume weighted mean distribution of 30%) and 21 g of polymethyl methacrylate fine particles (mean particle diameter of 3.6 μm, volume weighted mean distribution of 60%), and the obtained mixture was mixed to give a coating solution for the surface protective layer, which was fed to a coating die so that 8.3 mL/$m^2$ could be provided.

Viscosity of the coating solution was 19 mPa·s which was measured with a B type viscometer at 40° C. (No. 1 rotor, 60 rpm).

3. Preparations of Photothermographic Material

Reverse surface of the back surface was subjected to simultaneous overlaying coating by a slide bead coating method in order of the image forming layer, intermediate layer, first layer of the surface protective layers and second layer of the surface protective layers starting from the undercoated face, and thus sample of photothermographic material was produced. In this method, the temperature of the coating solution was adjusted to 31° C. for the image forming layer and intermediate layer, to 36° C. for the first layer of the surface protective layers, and to 37° C. for the second layer of the surface protective layers.

The coating amount of each compound (g/m$^2$) for the image forming layer is as follows.

| | |
|---|---|
| Silver salt of fatty acid | 5.27 |
| Pigment (C.I. Pigment Blue 60) | 0.036 |
| Halogen releasing compound (see Table 2) | |
| Phthalazine compound-1 | 0.18 |
| SBR latex | 9.43 |
| Reducing agent-1 | 0.39 |
| Reducing agent-2 | 0.39 |
| Hydrogen bonding compound-1 | 0.28 |
| Development accelerator-1 | 0.048 |
| Color-tone-adjusting agent-1 | 0.006 |
| Mercapto compound-1 | 0.001 |
| Mercapto compound-2 | 0.003 |
| Silver halide (on the basis of Ag content) | 0.13 |

Conditions for coating and drying are as follows.

Coating was performed at the speed of 180 m/min. The clearance between the leading end of the coating die and the support was 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of 100C to 20° C. Transportation with no contact was carried out, and the coated support was dried with an air of the dry-bulb of 23° C. to 45° C. And the wet-bulb of 15° C. to 21° C. in a helical type contactless drying apparatus.

After drying, moisture conditioning was performed at 25° C. in the humidity of 40% RH to 60% RH. Then, the film surface was heated to be 70° C. to 90° C., and after heating, the film surface was cooled to 25° C.

Thus prepared photothermographic material had a matt degree of 550 seconds on the image forming layer side surface, and 130 seconds on the back surface as Beck's smoothness. In addition, measurement of pH of the film surface on the image forming layer side surface gave the result of 6.0.

Chemical structures of the compounds used in Examples of the invention are shown below.

Spectral sensitizer A

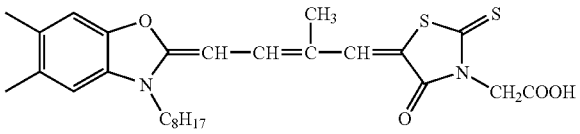

-continued

Spectral sensitizer B

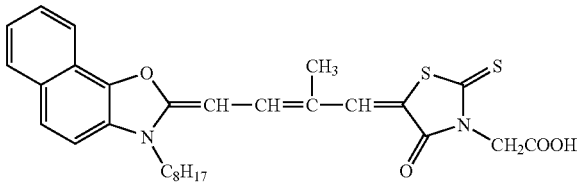

Tellulium sensitizer C

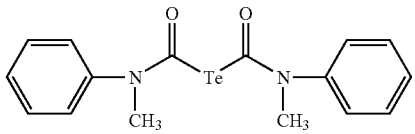

Base precursor-1

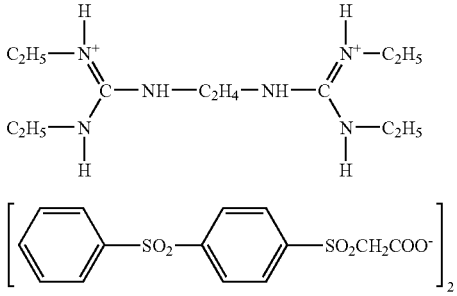

Cyanine dye-1

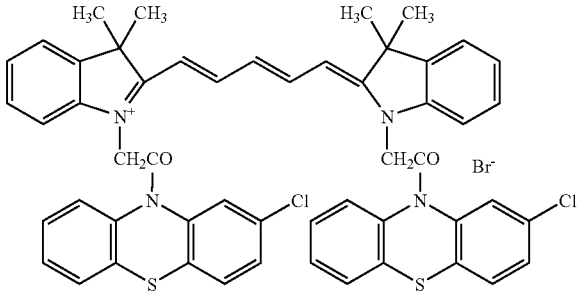

Blue dye-1

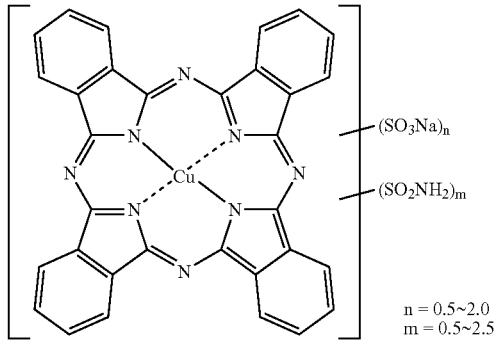

Compound 1 that can be one-electron-oxidized to provide a one-electron oxidation product which releases one or more electrons

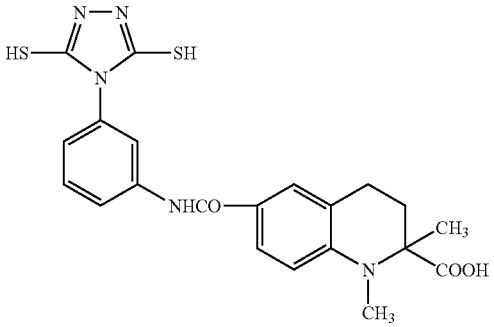

Compound 2 that can be one-electron-oxidized to provide a one-electron oxidation product which releases one or more electrons

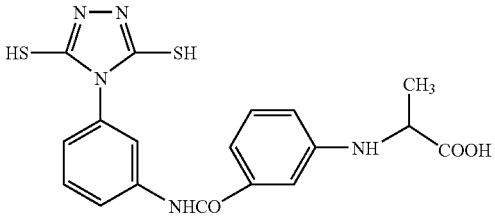

Compound 3 that can be one-electron-oxidized to provide a one-electron oxidation product which releases one or more electrons

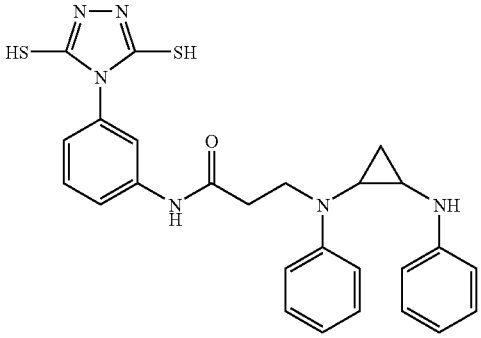

Compound 1 having adsorptive group and reducible group

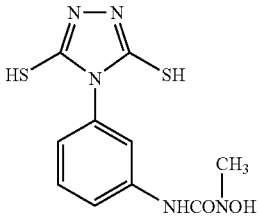

Compound 2 having adsorptive group and reducible group

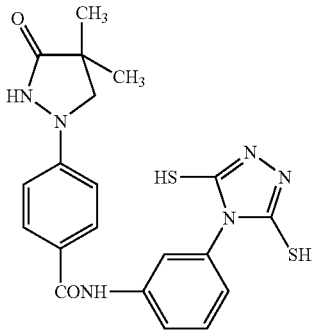

Reducting agent-1

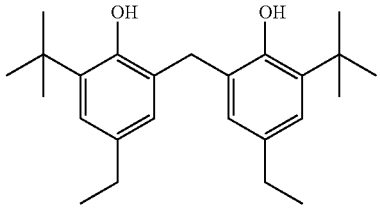

Reducing agent-2

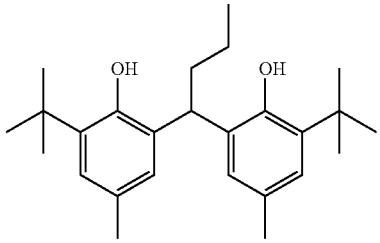

Hydrogen bonding compound-1

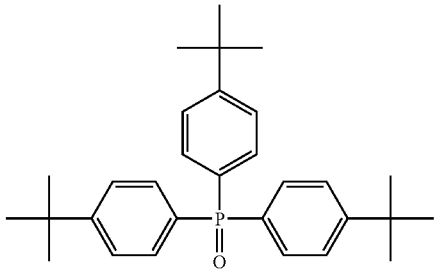

Mercapto compound-1

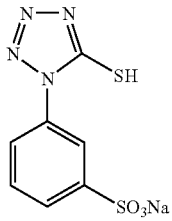

Mercapto compound-2

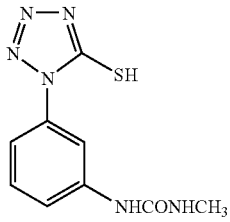

-continued

Phthalazine compound-1

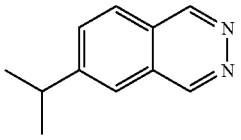

Development accelerator-1

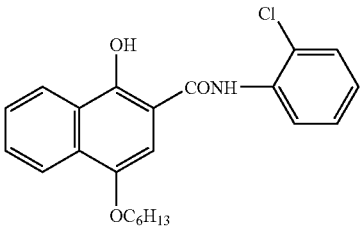

Color-tone-adjusting agent-1

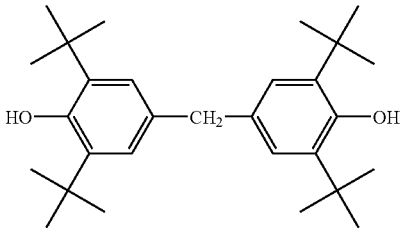

F-1

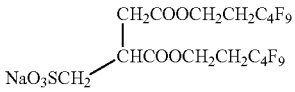

F-2

Mixture of

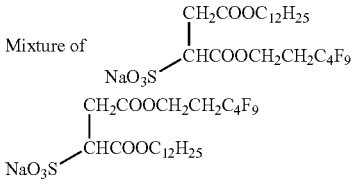

and

4. Evaluation of Photographic Properties 4-1. Preparation

The resulting sample was cut into a half-cut size (43 cm in length×35 cm in width), and was wrapped with the following packaging material under an environment of 25° C. And 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

4-2. Exposure and Thermal Development

To each sample, exposure and thermal development (10 seconds in total, with 3 panel heaters set to 107° C.–121° C.–121° C.) with Fuji Medical Dry Laser Imager DRYPIX 7000 (equipped with 660 nm laser diode having an maximum output of 50 mW (IIIB)) were performed. Evaluation on an image obtained was performed with a densitometer.

4-3. Evaluation (Method of Evaluation)

1) Evaluation of Photographic Properties

Fog: Fog is expressed in terms of the density of the unexposed part (Dmin).

Dmax: Dmax is a saturated maximum density obtained with increasing the exposure value.

Sensitivity: Sensitivity is the inverse of the exposure value giving image density of 1.0. The sensitivities are shown in relative value, detecting the sensitivity of Sample No. 1 to be 100.

2) Evaluation of Image Storability

After thermal developing process, the samples were stored for two months under the environment of 50° C. And 65% RH, and thereafter the increase of fog of each sample was measured to evaluate the image storability. The increases of fog are shown in relative value, detecting the increase of fog in Sample No. 1 to be 100. The smaller the relative value of fog, the more difficult in fogging and being more excellent.

3) Evaluation of Raw Stock Storability

Before thermal developing process, the samples were stored for one month under the environment of 30° C. And 55% RH. Thereafter the samples were processed, and the variations of fog and gradation of each sample when processed were measured to evaluate the raw stock storability. The increases of fog are shown in relative value, detecting the increase of fog in Sample No. 1 to be 100. The smaller the relative value of fog, the more difficult in fogging and being more excellent. Further, the variations of gradation are shown in relative value of the gradation after the storage, detecting the gradation before the storage to be 100. The nearer to 100 is the value, the smaller is the variation of gradation and being more excellent.

(Result of Evaluation)

The results obtained are shown in Table 2.

It is apparent from Table 2 that, the water-insoluble halogen releasing compound had a small ability of preventing fog when used alone, and in the case of increasing the addition amount to obtain sufficient effect, Dmax became low. And, the variation of gradation at raw stock storage was big and it was not capable of practical use. Further, concerning the water-soluble halogen releasing compound, the ability of preventing fog of the compound was not sufficient when used alone, and in the case of increasing the addition amount, the decrease of sensitivity becams big. And, the variation of gradation at raw stock storage was big and it was not capable of practical use. But it is understood that when the water-soluble halogen releasing compound of the invention and the water-insoluble halogen releasing compound of the invention were used in combination, an unexpectedly big effect of preventing fog was obtained and the variation of gradation at raw stock storage became low. Further, it is understood that by using the halogen releasing compounds of the invention in combination, the image storability could also be improved largely. Particularly, when the silver salt of fatty acid, which has a content of behenic acid in the range of 50% to 80% and has a high development performance and is capable of design high sensitivity, is used as a silver-supplying compound, the deterioration of image storability that causes a problem can be improved remarkably.

TABLE 2

| Sample No. | Silver salt of fatty acid No. | Water-soluble halogen releasing compound No. | Addition amount(mol/m$^2$) | Water-insoluble halogen releasing compound No. | Addition amount(mol/m$^2$) | Photographic properties Dmin | Dmax | Sensitivity | Image storability | Raw stock storability ΔDmin | Gradation variation | Remarks |
|---|---|---|---|---|---|---|---|---|---|---|---|---|
| 1 | A | — | — | H-5 | 0.51 | 0.23 | 3.88 | 100 | 100 | 100 | 85 | Comparative |
| 2 | " | — | — | H-5 | 0.85 | 0.20 | 3.65 | 95 | 80 | 70 | 70 | Comparative |
| 3 | " | P-50 | 0.17 | — | — | 0.24 | 3.90 | 98 | 95 | 90 | 130 | Comparative |
| 4 | " | P-50 | 0.34 | — | — | 0.19 | 3.73 | 86 | 90 | 80 | 150 | Comparative |
| 5 | " | P-50 | 0.17 | H-5 | 0.51 | 0.17 | 3.87 | 99 | 40 | 35 | 110 | Invention |
| 6 | " | P-50 | 0.17 | 1b-30 | 0.51 | 0.18 | 3.84 | 100 | 50 | 45 | 105 | Invention |
| 7 | " | A-1 | 0.17 | H-5 | 0.51 | 0.18 | 3.85 | 100 | 55 | 50 | 105 | Invention |
| 8 | " | A-1 | 0.17 | 1b-30 | 0.51 | 0.17 | 3.89 | 99 | 35 | 30 | 110 | Invention |
| 9 | B | P-50 | 0.08 | H-5 | 0.60 | 0.22 | 3.92 | 110 | 65 | 35 | 95 | Invention |
| 10 | " | P-50 | 0.17 | H-5 | 0.51 | 0.20 | 3.94 | 105 | 55 | 30 | 100 | Invention |
| 11 | " | P-50 | 0.34 | H-5 | 0.34 | 0.19 | 3.97 | 95 | 60 | 35 | 105 | Invention |
| 12 | " | A-1 | 0.08 | 1b-30 | 0.60 | 0.21 | 3.95 | 115 | 60 | 30 | 95 | Invention |
| 13 | " | A-1 | 0.17 | 1b-30 | 0.51 | 0.19 | 3.98 | 110 | 50 | 25 | 100 | Invention |
| 14 | " | A-1 | 0.34 | 1b-30 | 0.34 | 0.18 | 4.02 | 100 | 55 | 30 | 105 | Invention |
| 15 | C | — | — | 1b-30 | 0.51 | 0.25 | 3.94 | 115 | 150 | 140 | 80 | Invention |
| 16 | " | A-1 | 0.17 | — | — | 0.26 | 3.92 | 105 | 160 | 130 | 125 | Invention |
| 17 | " | A-1 | 0.17 | 1b-30 | 0.51 | 0.21 | 3.90 | 110 | 90 | 75 | 100 | Invention |
| 18 | " | A-1 | 0.17 | H-4 | 0.51 | 0.20 | 3.88 | 105 | 80 | 85 | 105 | Invention |
| 19 | " | P-50 | 0.17 | 1b-30 | 0.51 | 0.20 | 3.86 | 105 | 75 | 90 | 105 | Invention |
| 20 | " | P-50 | 0.17 | H-4 | 0.51 | 0.21 | 3.90 | 110 | 90 | 70 | 100 | Invention |

Example 2

Photothermographic materials were prepared in a similar manner to the process of photothermographic materials prepared in Example 1 except that changing the reducing agent-1 and the reducing agent-2 to R-2 and R-17 in equivalent mole. The temperature of thermal development was set to 110° C.–124° C.–124° C., and the time period for development was changed to 12 seconds. The samples were evaluated similar to Example 1.

Also in these cases, similar to Example 1, it is understood that by using the water-soluble halogen releasing compound of the invention and the water-insoluble halogen releasing compound of the invention in combination, image storability and raw stock storability can be improved without deteriorating fog and Dmax.

What is claimed is:

1. A photothermographic material comprising at least a photosensitive silver halide, a non-photosensitive silver-supplying compound, a reducing agent and a binder on at least one surface of a support, wherein the photothermographic material further comprises at least one kind of halogen releasing compound having a water-solubilizing group represented by the following formula (A) and at least one kind of halogen releasing compound having no water-solubilizing group, and a gradation in a photographic characteristic curve of the photothermographic material is 2.5 to 4.0:

$$R_1—SO_2—C(R_2)R_3—(CO)_m—(L)_n—SG \qquad \text{Formula (A)}$$

wherein, in formula (A), $R_1$ is an aliphatic group or a cyclic group: $R_2$ and $R_3$ are each independently a hydrogen atom or a bromine atom, provided that at least one of them is a bromine atom: L is a divalent aliphatic linking group; m and n are each independently 0 or 1; and SG is a solubilizing group with a pKa value of 8 or less.

2. The photothermographic material according to claim 1, wherein the halogen releasing compound having no water-solubilizing group is at least one compound selected from compounds represented by the following formula (H) and compounds represented by any one of the following formulae (1a) to (1c):

$$Q—(Y)n\text{-}C(Z_1)(Z_2)(X) \qquad \text{Formula (H)}$$

wherein, in formula (H), Q represents an alkyl group, an aryl group or a heterocyclic group; Y represents a divalent linking group; n represents 0 or 1; $Z_1$ and $Z_2$ each represent a halogen atom, and X represents a hydrogen atom or an electron-attracting group;

$$R—Y_1(L_1)_{n1}—CX_1X_2X_3 \qquad \text{Formula (1a)}$$

wherein, in formula (1a), $X_1$, $X_2$ and $X_3$ each independently represent a hydrogen atom or a substituent, provided that at least one of $X_1$, $X_2$ and $X_3$ is a halogen atom; $L_1$ represents a sulfonyl group; n1 represents 0 or 1; $Y_1$ represents —N($R_1$)—, a sulfur atom, an oxygen atom, a selenium atom or —($R_2$)C═C($R_3$)—; $R_1$, $R_2$ and $R_3$ each independently represent a hydrogen atom or a substituent; and R represents a hydrogen atom, a halogen atom, an aliphatic group, an aryl group or a heterocyclic group;

$$R—Y_2—L_2—CX_1X_2X_3 \qquad \text{Formula (1b)}$$

wherein, in formula (1b), $X_1$, $X_2$ and $X_3$ each independently represent a hydrogen atom or a substituent, provided that at least one of $X_1$, $X_2$ and $X_3$ is a halogen atom; $L_2$ represents a carbonyl group or a sulfinyl group; $Y_2$ represents —N($R_1$)—, a sulfur atom, an oxygen atom, a selenium atom or —($R_2$)C═C($R_3$)—; $R_1$, $R_2$, and $R_3$ each independently represent a hydrogen atom or a substituent; and R represents a hydrogen atom, a halogen atom, an aliphatic group, an aryl group or a heterocyclic group;

$$R—Y_3—(L_3)_{n2}—CX_1X_2X_3 \qquad \text{Formula (1c)}$$

wherein, in formula (1c), $X_1$, $X_2$ and $X_3$ each independently represent a hydrogen atom or a substituent, provided that at least one of $X_1$, $X_2$ and $X_3$ is a halogen atom; $L_3$ represents a sulfonyl group, a carbonyl group or a sulfinyl group; $n_2$ represents 2 or 3; $Y_3$ represents a single bond, —N($R_1$)—, a sulfur atom, an oxygen atom, a selenium atom or —($R_2$)C═C($R_3$)—; $R_1$, $R_2$ and $R_3$ each independently represent a hydrogen atom or a substituent; and R represents a hydrogen atom, a halogen atom, an aliphatic group, an aryl group or a heterocyclic group.

3. The photothermographic material according to claim 1, wherein the halogen releasing compound having no water-solubilizing group is a compound selected from compounds represented by any one of the following formulae (1a) to (1c):

$$R—Y_1(L_1)_{n1}—CX_1X_2X_3 \quad \text{Formula (1a)}$$

wherein, in formula (1a), $X_1$, $X_2$ and $X_3$ each independently represent a hydrogen atom or a substituent, provided that at least one of $X_1$, $X_2$ and $X_3$ is a halogen atom; $L_1$ represents a sulfonyl group; n1 represents 0 or 1; $Y_1$ represents —N($R_1$)—, a sulfur atom, an oxygen atom, a selenium atom or —($R_2$)C═C($R_3$)—; $R_1$, $R_2$ and $R_3$ each independently represent a hydrogen atom or a substituent; and R represents a hydrogen atom, a halogen atom, an aliphatic group, an aryl group or a heterocyclic group;

$$R—Y_2—L_2—CX_1X_2X_3 \quad \text{Formula (1b)}$$

wherein, in formula(1b), $X_1$, $X_2$ and $X_3$ each independently represent a hydrogen atom or a substituent, provided that at least one of $X_1$, $X_2$ and $X_3$ is a halogen atom; $L_2$ represents a carbonyl group or a sulfinyl group; $Y_2$ represents —N($R_1$)—, a sulfur atom, an oxygen atom, a selenium atom or —($R_2$)C═C($R_3$)—; $R_1$, $R_2$, and $R_3$ each independently represent a hydrogen atom or a substituent; and R represents a hydrogen atom, a halogen atom, an aliphatic group, an aryl group or a heterocyclic group;

$$R—Y_3—(L_3)_{n2}—CX_1X_2X_3 \quad \text{Formula (1c)}$$

wherein, in formula (1c), $X_1$, $X_2$ and $X_3$ each independently represent a hydrogen atom or a substituent, provided that at least one of $X_1$, $X_2$ and $X_3$ is a halogen atom; $L_3$ represents a sulfonyl group, a carbonyl group or a sulfinyl group; $n_2$ represents 2 or 3; $Y_3$ represents a single bond, —N($R_1$)—, a sulfur atom, an oxygen atom, a selenium atom or —($R_2$)C═C($R_3$)—; $R_1$, $R_2$ and $R_3$ each independently represent a hydrogen atom or a substituent; and R represents a hydrogen atom, a halogen atom, an aliphatic group, an aryl group or a heterocyclic group.

4. The photothermographic material according to claim 1, wherein the non-photosensitive silver-supplying compound is a silver salt of fatty acid with a silver behenate content of 50% by mole to 85% by mole.

5. The photothermographic material according to claim 1, wherein an amount of coated silver is from 0.6 g/$m^2$ to 1.9 g/$m^2$.

6. The photothermographic material according to claim 1, wherein a time period for thermal development is from 6 seconds to 12 seconds.

* * * * *